US005478704A

United States Patent [19]

Taniguchi et al.

[11] Patent Number: 5,478,704

[45] Date of Patent: Dec. 26, 1995

[54] METHOD FOR FORMING COLOR IMAGES

[75] Inventors: Masato Taniguchi; Nobutaka Ohki; Mitsuru Yamamoto; Akimitsu Haijima, all of Kanagawa, Japan

[73] Assignee: Fuji Photo Film Co., Ltd., Kanagawa, Japan

[21] Appl. No.: 291,459

[22] Filed: Aug. 17, 1994

Related U.S. Application Data

[63] Continuation of Ser. No. 978,885, Nov. 19, 1992, abandoned.

[30] Foreign Application Priority Data

Nov. 22, 1991 [JP] Japan ..... 3-332819
Jun. 16, 1992 [JP] Japan ..... 4-180551

[51] Int. Cl.[6] ..... G03C 5/18; G03C 5/26

[52] U.S. Cl. ..... 430/435; 430/434; 430/442; 430/467; 430/484; 430/567; 430/957; 430/544

[58] Field of Search ..... 430/505, 506, 430/380, 467, 484, 567, 957, 434, 435, 442, 544, 553, 555, 557, 558

[56] References Cited

U.S. PATENT DOCUMENTS

| | | | |
|---|---|---|---|
| 3,148,062 | 9/1964 | Whitmore et al. . | |
| 3,930,863 | 1/1976 | Shiba et al. . | |
| 4,439,520 | 3/1984 | Kofron et al. . | |
| 4,861,701 | 8/1989 | Burns et al. . | |
| 5,032,494 | 7/1991 | Kurematsu et al. | 430/567 |
| 5,043,254 | 8/1991 | Nakagawa et al. | 430/380 |
| 5,176,987 | 1/1993 | Nakamura et al. | 430/484 |

FOREIGN PATENT DOCUMENTS

| | | |
|---|---|---|
| 0410450A2 | 7/1990 | European Pat. Off. . |
| 59-129849 | 7/1984 | Japan . |
| 61-14635 | 1/1986 | Japan . |
| 03246542 | 11/1991 | Japan . |
| 807899 | 5/1957 | United Kingdom . |

*Primary Examiner*—Richard L. Schilling
*Assistant Examiner*—Geraldine Letscher
*Attorney, Agent, or Firm*—Sughrue, Mion, Zinn, Macpeak & Seas

[57] ABSTRACT i) A method of forming color images improved in color reproducibility and sharpness, which comprises providing a silver halide color photographic material which has on a support at least one emulsion layer unit constituted of at least two silver halide emulsion layers having the same color sensitivity and different photographic speeds, and which contains at least one DIR compound represented by the following general formula (II) in at least one layer selected from said emulsion layer unit and other constituent layers; exposing said color photographic material, and processing said color photographic material with a color developer containing at least one compound represented by the following general formula (I):

(I)

wherein $R_1$ represents an alkyl group or a hydroxyalkyl group containing; $R_2$ represents an alkylene group containing, or a straight-chain or branched hydroxyalkyiene group containing 3 to 6 carbon atoms; $R_3$ represents a substituent group; n represents 0 or an integer from 1 to 4;

A—Q (II)

with the substituents as defined herein the specification.

15 Claims, 1 Drawing Sheet

METHOD FOR FORMING COLOR IMAGES

This is a continuation of application Ser. No. 07/978,885, filed Nov. 19, 1992, now abandoned.

FIELD OF THE INVENTION

The present invention relates to a method for the formation of color images using a silver halide color photographic material and, more particularly, to a method of forming color images which uses a silver halide color photographic material and yet can ensure excellent color reproducibility and high image sharpness.

BACKGROUND OF THE INVENTION

In recent years, color photographic material makers have proceeded with development of photographic materials which have high sensitivity and can produce images of high quality, and thereby have supplied users' needs.

To enhance image quality, improvements in graininess, sharpness and color reproducibility have been carried out. As an effective measure for such improvements, it is already known to incorporate into a photographic material compounds of the kind which can release a development inhibitor or a precursor thereof in proportion to the image density at the time of development.

Representative compounds of that kind are the DIR compounds and the DIR couplers disclosed, e.g., in U.S. Pat. Nos. 3,148,062, 3,227,554, 3,379,529, 3,615,506, 3,617,291, 3,632,345 and 3,639,417, JP-A-49-129536 (U.S. Pat. No. 3,930,863), JP-A-51-6724 (U.S. Pat. No. 4,063,950), JP-A-62-166334 and JP-A-63-37346 (U.S. Pat. No. 4,861,701) (The term "JP-A" as used herein means an "unexamined published Japanese patent application"). The characteristic effect of such compounds consists in making it feasible to improve sharpness of images through reduction of the size of image grains and through an edge effect. Such compounds also make ti posibble to improve color reproducibility through an interlayer effect, and they make it possible to control the image tone.

Since such a compound can release a development inhibitor or a precursor thereof only after a reaction with an oxidation product of a developing agent in the development step, it can be easily imagined that the diffusibility of a developing agent into a photographic material and the reactivity between the compound and the oxidation product of the developing agent have a great influence upon image quality. However, it is still a difficult subject to illuminate details and improvements are made mostly by trial and error.

As for the compounds usable as color developing agents, a great number of proposals to use paraphenylenediamines, especially N,N-dialkyl-p-phenylenediamines, have so far been subjected. Such proposals are cited in detail in JP-A-03-246542.

Of the compounds proposed, 4-amino-3-methyl-N-ethyl-N-β-hydroxyethylaniline and 4-amino-3-methyl-N-ethyl-N-β-methanesulfonamidoethylaniline are the color developing agents in prevailing use at present.

As for the art of providing silver halide color photographic materials having not only high sensitivity but also excellent graininess and sharpness, the use of tabular silver halide grains having an aspect ratio (or the ratio of the diameter to the thickness of each grain) of at least 8:1 has been proposed, e.g., in JP-A-58-113934 (U.S. Pat. No. 4,439,520).

However, tabular silver halide grains have a disadvantage in that they cause a decrease in the interlayer effect. The interlayer effect improves image quality, and when this effect is decreased color reproducibility is lowered. In order to obviate such a disadvantage, the combined use of these tabular silver halide grains and a compound capable of releasing a diffusible development inhibitor has been proposed in JP-A-59-129849 and JP-A-61-14635.

As a result of examining influences of DIR compounds upon the improvement in image quality when compounds other than the prevailingly used 4-amino-3-methyl-N-ethyl-N-β-hydroxyethylaniline and 4-amino-3-methyl-N-ethyl-N-β-methanesulfonamidoethylaniline are used as color developing agents, it has now been found that higher sharpness than has been achieved in the past and an improvement in color reproducibility due to the interlayer effect can be obtained by using the compounds disclosed as color developing agents in British Patent 807,899 and EP-A-0410450.

Further, it has also been found that the use of the foregoing compounds as color developing agents can overcome the disadvantage that an interlayer effect is reduced by the use of tabular silver halide grains.

SUMMARY OF THE INVENTION

Therefore, an object of the present invention is to provide a method of forming color images which can ensure an enhancement of image qualities, especially sharpness, and an improvement of color reproducibility by an interlayer effect.

The foregoing object has been attained by a method of forming color images that comprises providing a silver halide color photographic material which has on a support at least one light-sensitive emulsion layer unit constituted of at least two silver halide emulsion layers having the same color sensitivity and different photographic speeds, and which contains at least one DIR compound represented by the following general formula (II) in at least one layer selected from the emulsion layer unit and other constituent layers; exposing the color photographic material; and processing said color photographic material with a color developer containing at least one compound represented by the following general formula (I) as a developing agent for silver halide color photography:

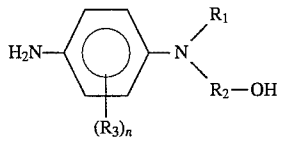

(I)

wherein $R_1$ represents a straight-chain or branched alkyl group containing 1 to 6 carbon atoms, or a straight-chain or branched hydroxyalkyl group containing 3 to 6 carbon atoms; $R_2$ represents a straight-chain or branched alkylene group containing 3 to 6 carbon atoms, or a straight-chain or branched hydroxyalkylene group containing 3 to 6 carbon atoms; $R_3$ represents a substituent group; n represents 0 or an integer from 1 to 4; and when n is 2 or more the multiple substituent groups represented by the $R_3$ groups may be the same or different, while when n is zero $R_3$ represents a hydrogen atom;

A—Q (II)

wherein A represents a group capable of causing cleavage of Q by reacting with an oxidation product of aromatic primary amine developing agent; and Q represents a a development inhibitor moiety or a group capable of releasing a development inhibitor moiety.

The foregoing object of the invention has also been attained by a method of forming color images that comprises providing a silver halide color photographic material which has on a support at least one light-sensitive emulsion layer unit constituted of at least two silver halide emultion layers having the same color sensitivity and different photographic speeds, and in which at least one layer selected from said emulsion layer unit or other constituent layers comprises a light-sensitive silver iodobromide emulsion in which at least 50% (based on a projected area) of the silver halide grains contained in the emulsion are tabular silver halide grains having an average aspect ratio of at least 2; exposing the color photographic material; and processing the color photographic material with a color developer containing at least one compound represented by general formula (I) as described above.

Moreover, in a preferred embodiment of the invention, the above photographic material which contains tabular silver halide grains having an average aspect ratio of at least 2 also contains at least one DIR compound represented by the above general formula (II) in at least one layer selected from the emulsion layer unit or other constituent layers.

In accordance with the method of the present invention, color images can be provided which have excellent color reproducibility through improvements in an interlayer effect and in color turbidity, and which are excellent in sharpness as represented, e.g., by the MTF value.

The method of the present invention can fully achieve its effects particularly upon multilayer photographic materials such as photograph-taking color photosensitive materials (e.g., those having high Ag coverage, those comprising emulsion layers which each are constituted of 2 or 3 layers having the same color sensitivity, and those having high ISO speed).

In addition, the color developing agents relating to the present invention are effective in particular for photographic materials using emulsions of the type which often cause a drop in color reproducibility, such as tabular grain silver halide emulsions.

Figure 1:
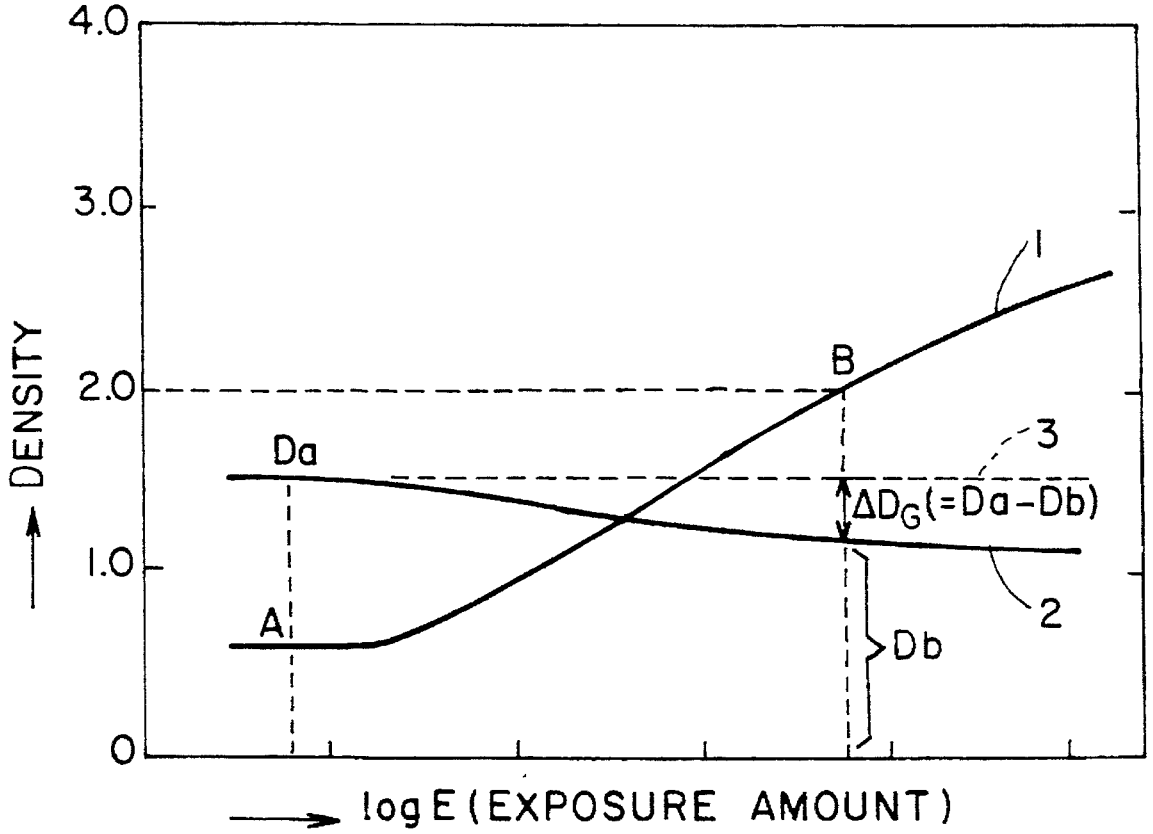
FIG. 1 is a graph illustrating schematically the interlayer effect produced in Example 1.

Therein, Curve 1 represents the characteristic curve of the yellow color image formed in the blue-sensitive emulsion layer, Curve 2 represents the density curve of the magenta color developed in the green-sensitive emulsion layer by uniform exposure to green light, and Line 3 represents a line extended from Da.

DETAILED DESCRIPTION OF THE INVENTION

The expression "light-sensitive emulsion comprising tabular silver iodobromide grains" as used above refers to an emulsion in which at least 50%, on a projected area basis, of all the silver halide grains contained in the emulsion are grains having an average aspect ratio of at least 2.

Although the color developing agent used in the present invention does not any particular effect upon improving sharpness and the interlayer effect when used by itself, we have found, as described above, that a synergistic effect which greatly surpasses our expectation can be produced when the color developing agent of the invention is used for the development-processing of a multi-layer color photographic material which contains a DIR compound in its photographic constituent layer(s) and/or has at least one light-sensitive emulsion layer comprising tabular silver halide grains, especially iodobromide grains, as described above.

It is more preferable in the processing of the multi-layer color photographic material having the light-sensitive emultion layers comprising tabular silver halide grains and containing a DIR compound as described above with the foregoing color developing agent.

The developing agent of general formula (I) used for silver halide color photography, and specific constitutions of processing steps employed in the present invention, are described below in detail.

In the general formula (I), $R_1$ represents a straight-chain or branched alkyl group containing 1 to 6 carbon atoms or a straight-chain or branched hydroxy-alkyl group containing 3 to 6 carbon atoms. (The number and the position of the hydroxy group are optional. However the hydroxyl group can not be positioned at the α-carbon atom (with respect to the nitrogen atom)). Specific examples thereof include a methyl group, an ethyl group, an n-propyl group, an isopropyl group, an n-butyl group, a sec-butyl group, an n-hexyl group, a neopentyl group, a 3-hydroxypropyl group, a 4-hydroxybutyl group, a 5-hydroxypentyl group, a 6-hydroxyhexyl group, a 4-hydroxypentyl group, a 3-hydroxybutyl group, a 4-hydroxy-4-methylpentyl group, a 5,6-dihydroxyhexyl group, and so on.

$R_2$ represents a straight-chain or branched alkylene group containing 3 to 6 carbon atoms, or a straight-chain or branched hydroxyalkylene group which may contain one or more hydroxy groups. Specific examples thereof include a trimethylene group, a tetramethylene group, a pentamethylene group, a hexamethylene group, a 1-methylethylene group, a 2-methylethylene group, a 2-methyltrimethylene group, a 3-methyltrimethylene group, a 2-methylpentamethylene group, a 2-methylpentamethylene group, a 2-ethyltrimethylene group, a 3-hydroxypentamethylene, and so on.

When $R_1$ represents a straight-chain or branched alkyl group in the general formula (I), the number of carbon atoms in the alkyl group ranges preferably from 1 to 4. Of such groups, methyl, ethyl and n-propyl groups are preferred, ethyl and propyl groups are more preferred, and an ethyl group is most preferred. When $R_1$ is a straight-chain or branched alkyl group containing 1 to 4 carbon atoms, $R_2$ is preferably a straight-chain or branched alkylene group containing 3 or 4 carbon atoms, more preferably a trimethylene or a tetramethylene group, and most preferably a tetramethylene group. On the other hand, the number of carbon atoms in $R_2$ ranges preferably from 4 to 6, more preferably 5 or 6, when $R_1$ represents a straight-chain or branched hydroxyalkyl group.

In general formula (I), $R_1$ is more preferably a straight-chain or branched alkyl group containing 1 to 4 carbon atoms than a straight-chain or branched hydroxyalkyl group containing 3 to 6 carbon atoms.

$R_3$ represents a substituent group with specific examples including a halogen atom, an alkyl group, an aryl group, a heterocyclic group, a cyano group, a nitro group, a hydroxyl group, —COOM or —$SO_3M$ (M: H,$NH_4$, an alkali metal atom such as Na and K), an alkoxy group, an aryloxy group, an acylamino group, an amino group, an alkylamino group, an anilino group, an ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclicoxy group, an azo group, an acyloxy group, a carbamoyloxy group, a silyl group, a silyloxy group, an aryloxycarbonylamino group, an imido group, a heterocyclicthio group, a sulfinyl group, a phosphonyl group (—$PO(OR)_2$ wherein R represents an alkyl or aryl group), an aryloxycarbonyl group and an acyl group. These groups may be further substituted with at least one of an alkyl group, an alkenyl group, an alkinyl group, an aryl group, a hydroxyl group, a nitro group, a cyano group, a halogen atom, a sulfonamido group, a sulfonyl group, an alkoxy group, an acetamido group, —COOM or —$SO_3M$ (M: the same as defined herein above), a carbamoyl group, a carbamoylamino group, a hydroxy aliphatic acid amido group, an aryloxy group, a hydroxy acyl group, an acylamino group and another group made up of oxygen, nitrogen, sulfur and/or carbon atoms. The range of the carbon number of these groups are the same as that of groups shown as $R_3$.

In the present invention an acyl, sulfinyl, sulfonyl, sulfonamido, azo and imido groups (or moiety) represent RCO—, RSO—, $RSO_2$—, $RSO_2NH$—, RN=N— and

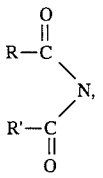

respectively, wherein R and R' each represents a saturated or unsaturated aliphatic or alicyclic hydrocarbon residual group or an aryl group, and R and R' may be combined to form a closed ring imido group.

More specifically, a halogen atom represented by $R_3$ is, e.g., a fluorine or chlorine atom. An alkyl group represented by $R_3$ is one which contains 1 to 16 carbon atoms (this number does not contain the number of substituent which is substituted to the group; the same hereinafter), preferably a straight-chain, branched or cyclic alkyl group containing 1 to 6 carbon atoms, with specific examples including methyl, ethyl, propyl, isopropyl, t-butyl, 2-hydroxyethyl, 3-hydroxypropyl, benzyl, 2-methanesulfonamidoethyl, 3-methanesulfonamidopropyl, 2-methanesulfonylethyl, 2-methoxyethyl, cyclopentyl, 2-acetamidoethyl, 2-carboxylethyl, 2-carbamoylethyl, 3-carbamoylpropyl, n-hexyl, 2-hydroxypropyl, 4-hydroxybutyl, 2-carbamoylaminoethyl, 3-carbamoylaminopropyl, 4-carbamoylaminobutyl, 4-carbamoylbutyl, 2-carbamoyl- 1-methylethyl and 4-nitrobutyl.

An aryl group represented by $R_3$ is one which contains 6 to 24 carbon atoms, with specific examples including phenyl, naphthyl and p-methoxyphenyl. A heterocyclic group represented by $R_3$ is a saturated or unsaturated, 5- or 6-membered hetero ring containing 1 to 5 carbon atoms and at least one oxygen, nitrogen or sulfur atom, wherein one or more hereto atoms may be present and a plurality of hetero atoms may differ in kind and the hetero ring may be condensed with an aromatic nucleus, with specific examples including 2-furyl, 2-thienyl, 2-pyrimidinyl, 2-benzotriazolyl, imidazolyl and pyrazolyl.

An alkoxy group represented by $R_3$ is one which contains 1 to 16 carbon atoms, preferably 1 to 6 carbon atoms, with specific examples including methoxy, ethoxy, isopropoxy, 2-methoxyethoxy and 2-methanesulfonylethoxy. An aryloxy group represented by $R_3$ is one which contains 6 to 24 carbon atoms, with specific examples including phenoxy, p-methoxyphenoxy and m-(3-hydroxypropionamido)phenoxy. An acylamino group represented by $R_3$ is one which contains 1 to 16 carbon atoms, preferably 1 to 6 carbon atoms, with specific examples including acetamido, 2-methoxypropionamido and p-nitrobenzoylamido.

An alkylamino group represented by $R_3$ is one which contains 1 to 16 carbon atoms, preferably 1 to 6 carbon atoms, with specific examples including dimethylamino, diethylamino and 2-hydroxyethylamino. An anilino group represented by $R_3$ is one which contains 6 to 24 carbon atoms, with specific examples including anilino, m-nitroanilino and N-methylanilino. An ureido group represented by $R_3$ is one which contains 1 to 16 carbon atoms, preferably 1 to 6 carbon atoms, with specific examples including ureido, methylureido, N,N-diethylureido and 2-methanesulfonamidoethylureido.

A sulfamoylamino group represented by $R_3$ is one which contains 0 to 16 carbon atoms, preferably 0 to 6 carbon atoms, with specific examples including dimethylsulfamoylamino, methylsulfamoylamino and 2-methoxyethylsulfamoylamino. An alkylthio group represented by $R_3$ is one which contains 1 to 16 carbon atoms, preferably 1 to 6 carbon atoms, with specific examples including methylthio, ethylthio and 2-phenoxyethylthio. An arylthio group represented by $R_3$ is one which contains 6 to 24 carbon atoms, with specific examples including phenylthio, 2-carboxyphenylthio and 4-cyanophenylthio. An alkoxycarbonylamino group represented by $R_3$ is one which contains 2 to 16 carbon atoms, preferably 2 to 6 carbon atoms, with specific examples including methoxycarbonylamino, ethoxycarbonylamino and 3-methanesulfonylpropoxycarbonylamino.

A sulfonamido group represented by $R_3$ is one which contains 1 to 16 carbon atoms, preferably 1 to 6 carbon atoms, with specific examples including methanesulfonamido, p-toluenesulfonamido and 2-methoxyethanesulfonamido. A carbamoyl group represented by $R_3$ is one which contains 1 to 16 carbon atoms, preferably 1 to 6 carbon atoms, with specific examples including carbamoyl, N,N-dimethylcarbamoyl and N-ethylcarbamoyl. A sulfamoyl group represented by $R_3$ is one which contains 0 to 16 carbon atoms, preferably 0 to 6 carbon atoms, with specific examples including sulfamoyl, diethylsulfamoyl and ethylsulfamoyl.

A sulfonyl group represented by $R_3$ is an aliphatic or aromatic sulfonyl groups which contains 1 to 16 carbon atoms, preferably 1 to 6 carbon atoms, with specific examples including methanesulfonyl, ethanesulfonyl and 2-chloroethanesulfonyl. An alkoxycarbonyl group represented by $R_3$ is one which contains 2 to 16 carbon atoms, preferably 2 to 6 carbon atoms, with specific examples including methoxycarbonyl, ethoxycarbonyl and t-butoxycarbonyl. A heterocyclic oxy group represented by $R_3$ has a 5- or 6-membered, saturated or unsaturated ring which contains 1 to 5 carbon atoms and at least one oxygen, nitrogen or sulfur atom, wherein the number of hereto atom and the kind of hereto atom may be one or plural, with specific examples including 1-phenyltetrazolyl-5-oxy, 2-tetrahydropyranyloxy and 2-pyridyloxy.

An azo group represented by $R_3$ is one which contains 1 to 16 carbon atoms, preferably 1 to 6 carbon atoms, with specific examples including phenylazo, 2-hydroxy- 4-propanoylphenylazo and 4-sulfophenylazo. An acyloxy group represented by $R_3$ is one which contains 1 to 16 carbon atoms, preferably 1 to 6 carbon atoms, with specific examples including acetoxy, benzoyloxy and 4-hydroxybutanoyloxy. A carbamoyloxy group represented by $R_3$ is one which contains 1 to 16 carbon atoms, preferably 1 to 6 carbon atoms, with specific examples including N,N-dimethylcarbamoyloxy, N-methylcarbamoyloxy and N-phenylcarbamoyloxy.

A silyl group represented by $R_3$ is one which contains 3 to 16 carbon atoms, preferably 3 to 6 carbon atoms, which specific examples including trimethylsilyl, isopropyldiethylsilyl and t-butyldimethylsilyl. A silyloxy group represented by $R_3$ is one which contains 3 to 16 carbon atoms, preferably 3 to 6 carbon atoms, with specific examples including trimethylsilyloxy, triethylsilyloxy and diisopropylethylsilyloxy. An aryloxycarbonylamino group represented by $R_3$ is one which contains 7 to 24 carbon atoms, with specific examples including phenoxycarbonylamino, 4-cyanophenoxycarbonylamino and 2,6-dimethoxyphenoxycarbonylamino.

An imido group represented by $R_3$ is one which contains 4 to 16 carbon atoms, with specific examples including N-succinimido and N-phthalimido. A heterocyclic thio group represented by $R_3$ has a 5- or 6-membered, saturated or unsaturated hetero ring which contains 1 to 5 carbon atoms and at least one oxygen, nitrogen or sulfur atom, wherein the number of hetero atom and the kind of hetero atom may be one or plural, with specific examples including 2-benzothiazolylthio and 2-pyridylthio.

A sulfinyl group represented by $R_3$ is one which contains 1 to 16 carbon atoms, preferably 1 to 6 carbon atoms, with specific examples including methanesulfinyl, benzenesulfinyl and ethanesulfinyl. A phosphonyl group represented by $R_3$ is one which contains 2 to 16 carbon atoms, preferably 2 to 6 carbon atoms, with specific examples including methoxyphosphonyl, ethoxyphosphonyl and phenoxyphosphonyl. An aryloxycarbonyl group represented by $R_3$ is one which contains 7 to 24 carbon atoms, with specific examples including phenoxycarbonyl, 2-methylphenoxycarbonyl and 4-acetamidophenoxycarbonyl. An acyl group represented by $R_3$ is one which contains 1 to 16 carbon atoms, preferably 1 to 6 carbon atoms, with specific examples including acetyl, benzoyl and 4-chlorobenzoyl.

Among the aforementioned groups, a halogen atom, an alkyl group, an alkoxy group, an amino group, a ureido group, a sulfamoylamino group and an alkoxycarbonylamino group are preferred as $R_3$.

n represents 0 or an integer from 1 to 4. When n is two or more,the plural $R_3$ groups may be the same or different, or they may form a ring by combining with each other. When the $R_3$ groups form a ring, the ring is not particularly limited as to the number of constituent atoms. However, it is preferable to form a 5-, 6- or 7-membered ring, more preferably a 5-, 6-, or 7-membered hydrocarbon ring.

Of the compounds represented by the general formula (I), those represented by the general formula (XI) illustrated below are preferred over others:

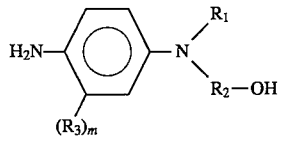

(XI)

In the above formula, $R_1$, $R_2$ and $R_3$ have the same meanings as in general formula (I), respectively, and m represents 0 or 1. When m=0, $R_3$ represents a hydrogen atom.

In the general formula (XI), the case in which m=0 is preferred. Also preferred are the cases in which m is 1 and $R_3$ represents a 1-4C (i.e., 1 to 4 carbon atom) straight-chain or branched alkyl group or a 1-4C straight-chain or branched alkoxy group. Specific examples of $R_3$ in such cases include a methyl group, an ethyl group, an n-propyl group, an isopropyl group, a sec-butyl group, a methoxy group, an ethoxy group, an isopropoxy group, and so on.

It is more preferable in the general formula (XI) that m is 1 and $R_3$ is an alkyl group. Therein, it is most preferable that the alkyl group should be a methyl group or an ethyl group.

Since the compounds represented by the general formula (I) are quite unstable when preserved in the form of free amines, it is generally desirable that they be produced and preserved as the salt of an inorganic or organic acid and should be converted to the form of free amines in a processing solution. Suitable examples of inorganic or organic acids used for producing salts of the compounds of the general formula (I) include hydrochloric acid, sulfuric acid, phosphoric acid, p-toluenesulfonic acid, methanesulfonic acid, naphthalene-1,5-disulfonic acid, and so on. Of the above-cited acids, sulfuric acid and p-toluenesulfonic acid are preferably used to form a salt. Sulfuric acid is more preferably used in producing the salts. For instance, Compound I-12 illustrated below may be obtained in the form of sulfate having a melting point of 112°–114° C. (recrystallized from ethanol), and Compound I-2 illustrated below may be obtained in the form of sulfate having a melting point of 158°–160° C.

Specific examples of typical developing agents which are represented by the general formula (I) are illustrated below. However, the invention should not be construed as being limited to these examples.

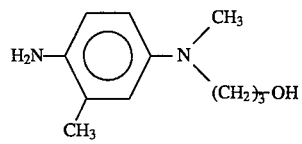

I-1

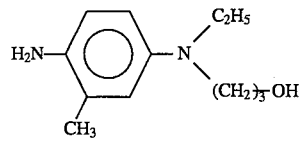

I-2

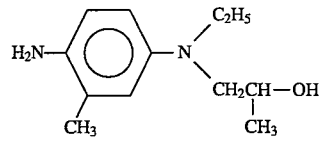

I-3

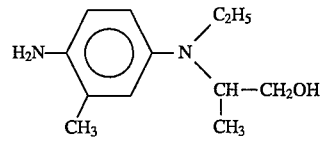

I-4

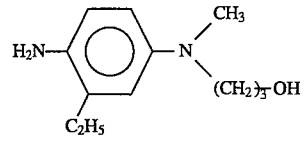

I-5

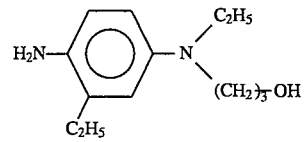

I-6

-continued
I-7
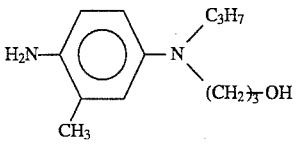
I-8
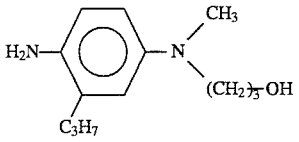
I-9
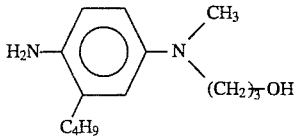
I-10
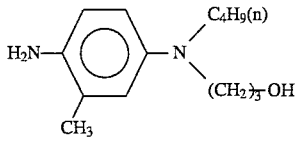
I-11
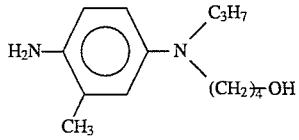
I-12
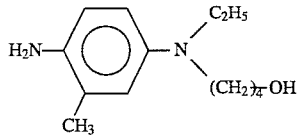
I-13
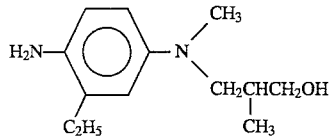
I-14
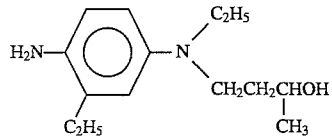
I-15
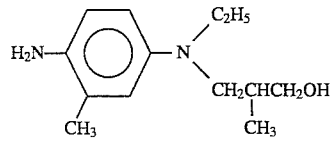
I-16
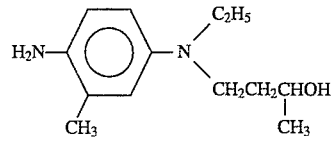
I-17
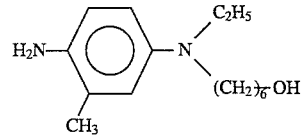
-continued
I-18
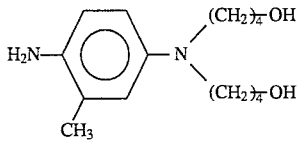
I-19
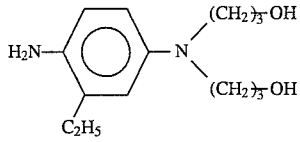
I-20
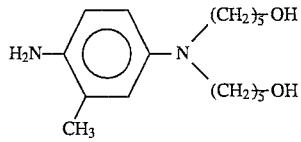
I-21
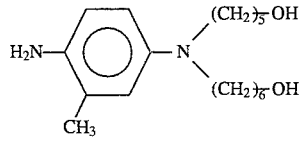
I-22
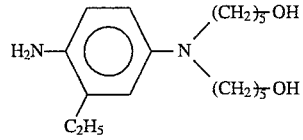
I-23
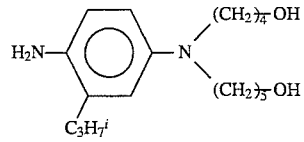
I-24
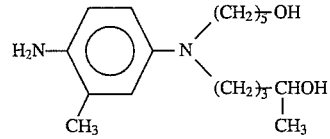
I-25
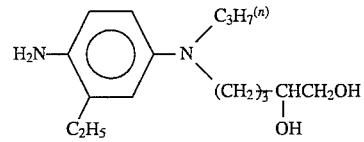
I-26
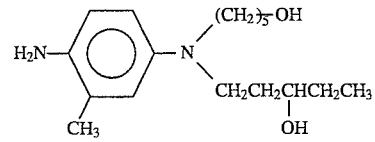
I-27
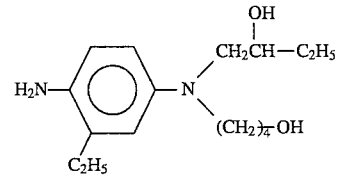

-continued
I-28
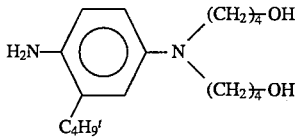
I-29
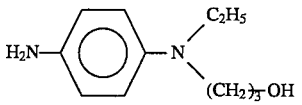
I-30
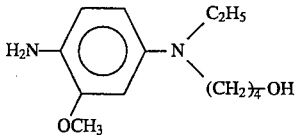
I-31
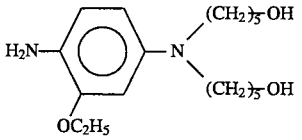
I-32
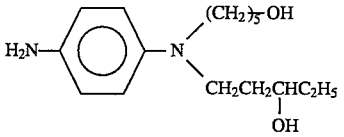
I-33
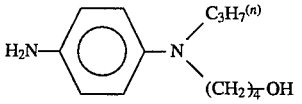
I-34
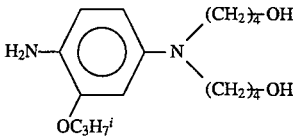
I-35
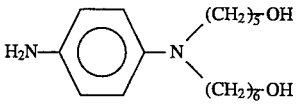
I-36
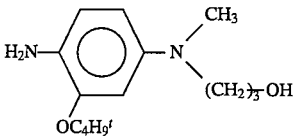
I-37
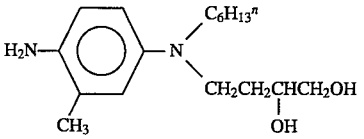
I-38
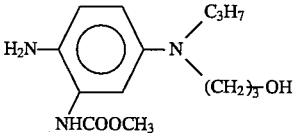
-continued
I-39
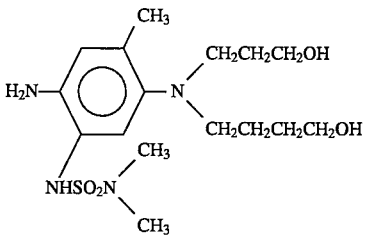
I-40
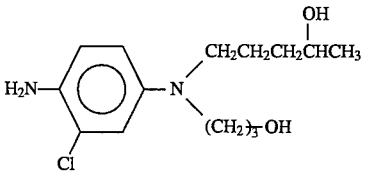
I-41
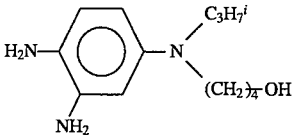
I-42
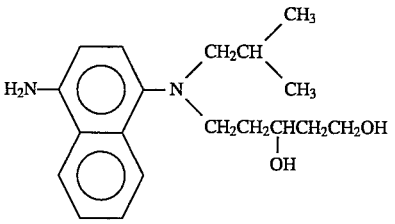
I-43
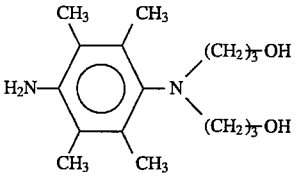
I-44
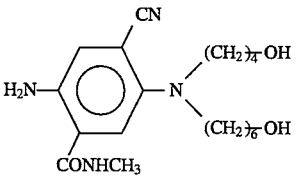
I-45
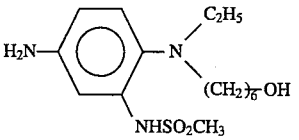
I-46
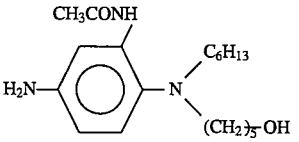
(In the present invention, in examples of compounds alkyl groups which are not specifically marked with n, i, or t represent n-alkyl groups)

-continued

I-47

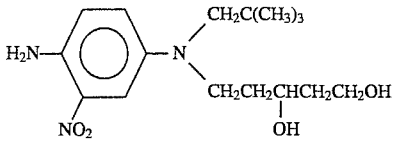

I-48

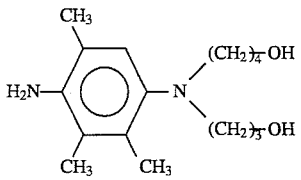

I-49

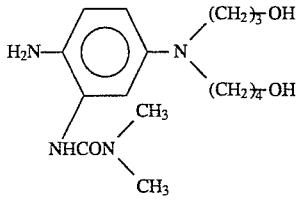

I-50

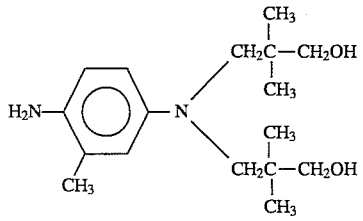

Of the compounds represented by the general formula (I), Compound I-2, Compound I-12 and Compound I-20 illustrated above are preferred. In particular, Compound I-12 is used to advantage.

The color developing agent of the present invention is preferably used in an amount of from 0.1 to 20 g, particularly preferably from 1 to 15 g, per liter of developer.

The processing with the developer is performed preferably at a temperature of from 20° to 50° C., more preferably from 30° to 45° C.

The color developing agents of the present invention can be prepared with ease according to the method described in *Journal of American Chemical Society*, vol. 73, p. 3100 (1951).

The color developing agent of the present invention can be used independently (i.e., alone), or can advantageously be combined for use with another known p-phenylenediamine derivative. Representative examples of the compounds which can be used in conjunction with the color developing agent of the present invention are described below. However, such compounds should not be construed as being limited to the following examples.

D-1 N,N-diethyl-p-phenylenediamine,

D-2 2-amino-5-diethylaminotoluene,

D-3 2-amino-5-(N-ethyl-N-laurylamino)toluene,

D-4 4-[N-ethyl-N-(β-hydroxyethyl)amino]aniline,

D-5 2-methyl-4-[N-ethyl-N-(β-hydroxyethyl)amino]aniline,

D-6 4-amino-3-methyl-N-ethyl-N-[-β-(methanesulfonamido)ethyl]aniline,

D-7 N-(2-amino-5-diethylaminophenylethyl-)methanesulfonamide,

D-8 N,N-dimethyl-p-phenylenediamine,

D-9 4-amino-3-methyl-N-ethyl-N-methoxyethylaniline,

D-10 4-amino-3-methyl-N-ethyl-N-β-ethoxyethylaniline,

D-11 4-amino-3-methyl-N-ethyl-N-β-butoxyethylaniline.

Of the above-cited p-phenylenediamine derivatives, the compounds denoted as D-5 and D-6 are preferred in particular as those to be combined with the developing agent of the present invention. These p-phenylenediamine derivatives also are generally used in the form of a salt, such as a sulfate, a hydrochloride, a sulfite, a p-toluenesulfonate, a nitrate, a naphthalene-1,5-disulfonate, or so on. A suitable amount of an aromatic primary developing agent to be used in combination with the color developing agent of the present invention from about 0.1 g to about 20 g per 1 l of developer. A suitable amount of the developing agent used in combination ranges from 1/10 to 10 mole per mol of the developing agent of the present invention represented the formula (I).

The color developer used in the present invention is generally made alkaline, and it is preferably an alkaline aqueous solution adjusted to pH 9–12.5.

In general, the color developer used in the present invention contains pH buffers such as carbonates, borates or phosphates of alkali metals, and development inhibitors or antifoggants such as chlorides, bromides, iodides, benzimidazoles, benzothiazoles or mercapto compounds. In addition, it may optionally contain various kinds of preservatives, e.g., hydroxylamine, diethylhydroxylamine, sulfites, hydrazines such as N,N-biscarboxymethylhydrazine, phenylsemicarbazides, triethanolamine, catecholsulfonic acids, etc.; organic solvents such as ethylene glycol, diethylene glycol, etc.; development accelerators such as benzyl alcohol, polyethylene glycol, quaternary ammonium salts, amines, etc.; dye-forming couplers; competing couplers; an auxiliary developing agent such as 1-phenyl-3-pyrazolidone; a viscosity providing agent; and various kinds of chelating agents represented by aminopolycarboxylic acids, aminopolyphosphonic acids, alkylphosphonic acids and phosphonocarboxylic acids, with specific examples including ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphoric acid, nitrilo-N,N,N-trimethylenephosphonic acid, ethylenediamine-N,N,N',N'-tetramethylenephosphonic acid, ethylenediamine-di(o-hydroxyphenylacetic acid), and salts of these acids.

In performing a reversal processing operation, color development generally follows black-and-white development. In the black-and-white development it is suitable to use a black-and-white developer containing a conventional black-and-white developing agent such as a dihydroxybenzene e.g., hydroquinone, a 3-pyrazolidone e.g., 1-phenyl-3-pyrazolidone, or an aminophenol e.g., N-methyl-p-aminophenol, independently or in combinations of two or more thereof. The pH of such black-and-white and color developers ranges generally from 9 to 12. The amount of these developers to be replenished, though it depends on the kind of color photographic materials processed, is generally at most 3 l per $m^2$ of the photographic material processed. Further, it is feasible to reduce the amount of each replenisher to 500 ml or less by lowering the bromide ion concentration in the replenisher. When the replenisher is used in a reduced amount, it is desirable that evaporation and aerial oxidation of the developer should be prevented from occurring by reducing the contact area between air and the developer in a processing tank.

The contact area between air and the photographic processing solution in a processing tank can be represented by an opening ratio defined as follows:

Opening ratio =

[contact area ($cm^2$) between air and the processing solution] ÷

[volume of processing tank ($cm^3$)]

The opening ratio described above is preferably below 0.1, more preferably from 0.001 to 0.05. For the purpose of lowering the opening ratio, not only a means of placing a shield such as a floating cover on the surface of the processing solution in a processing tank, but also a method of using a mobile cover as disclosed in JP-A-01-82033, a slit development processing method as disclosed in JP-A-63-216050, and so on can be employed. It is desirable that reduction of the opening ratio be carried out in every step, including not only both the color and black-and-white development steps but also the various steps subsequent thereto, e.g., bleaching, bleach-fixing, fixing, washing and stabilization steps. Also, the amount of the replenisher used can be reduced by adopting a means to inhibit the accumulation of bromide ion in the developer.

The color development time is generally chosen within the range of from 2 to 10 minutes, but it can be shortened by carrying out development under high temperature and high ph conditions, and by using a color developing agent in a high concentration.

Photographic emulsion layers are generally subjected to a bleach-processing after color development. The bleach-processing may be carried out simultaneously with a fixation-processing (blix-processing), or separately therefrom. In order to further increase the processing speed, a blix-processing may be carried out after the bleach-processing. Also, a processing may be carried out with two successive bleach-fix baths, a fixation-processing may be carried out before the blix-processing, or the bleach-processing may be carried out after the blix-processing. That is, any manner may be employed in desilvering, if desired. As a typical beaching agent, it is suitable to Fe(III) organic complex salts, e. g. , a complex salts of aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid, glycol-ether-diaminetetraacetic acid, etc., citric acid, tartaric acid, malic acid, and so on. Among these complex salts, (aminopolycarbonato)iron(III) complex salts, such as (ethylenediaminetetraacetonato)iron(III) complex salts and (1,3-diaminopropanetetraacetonato)iron(III) complex salts, are particularly favored from the viewpoints of rapid processing and prevention of environmental pollution. In addition, (aminopolycarbonato)iron(III) complex salts are especially useful in both bleaching and bleach-fixing solutions. The bleaching or bleach-fixing solution utilizing an (aminopolycarbonato)-iron(III) complex salt as cited above is generally adjusted to pH 4.0–8. For the purpose of speeding up the processing, the processing baths may be adjusted to a pH value lower than the above-described range.

In the bleaching bath, the bleach-fixing solution, and/or prebaths thereof, a bleach accelerator can be used, if desired. Specific examples of useful bleach accelerators include mercapto group- or disulfido linkage-containing compounds as disclosed in U.S. Pat. No. 3,893,858, West German Patent 1,290,812, JP-A-53-95630, and *Research Disclosure*, No. 17129 (July, 1978); thiazolidine derivatives as disclosed in JP-A-50-140129; thiourea derivatives as disclosed in U.S. Pat. No. 3,706,561; iodides as disclosed in JP-A-58-16235; polyoxyethylene compounds as described in West German Patent 2,748,430; polyamine compounds as disclosed in JP-B-45-8836 (The term "JP-B" as used herein means an "examined Japanese patent publication"); and bromide ion. Among these compounds, compounds containing a mercapto group or a disulfido linkage are favored over others because of their great effects upon bleach acceleration. In particular, those disclosed in U.S. Pat. No. 3,893,858, West German Patent 1,290,812 and JP-A-53-95630 are preferred. In addition, the compounds disclosed in U.S. Pat. No. 4,552,834 are desirable, too. Bleach accelerators as cited above may be incorporated in photosensitive materials. In the bleach-fix processing of color photographic materials for photograph-taking use, such bleach accelerators as described above are especially effective.

In addition to the above-cited compounds, it is desirable to add organic acids to bleaching and bleach-fixing solution to prevent bleach stains. Particularly preferred organic acids are compounds having an acid dissociation constant (pKa) from 2 to 5, with specific examples including acetic acid and propionic acid.

As examples of the fixing agent which can be used in a fixing solution and a bleach-fixing solution, mention may be made of thiosulfates, thiocyanates, thioether compounds, thioureas, and a large quantity of iodide. In general, thiosulfates are used as fixing agents. In particular, ammonium thiosulfate can be used in the widest range. It is also desirable that thiosulfates be used in combination with thiocyanates, thioether compounds, thioureas, or so on. As for the preservatives of the fixing solution and the bleach-fixing solution, sulfites, bisulfites, carbonylbisulfite adducts, or sulfinic acid compounds as disclosed in EP-A-0294769 are preferably employed. Further, it is desirable for stabilization of the fixing solution and the bleach-fixing solution that various kinds of aminopolycarboxylic acids and organic phosphonic acids be added thereto.

Furthermore, it is desirable in the present invention that compounds having pKa 6.0 to 9.0, preferably imidazoles such as imidazole, 1-methylimidazole, 1-ethylimidazole, 2-methylimidazole and the like, be added to the fixing solution or the bleach-fixing solution in an amount of 0.1–10 mole/l for the purpose of pH adjustment.

It is desirable that desilvering operations as a whole be completed in the shortest possible time, so long a poor desilvering is not caused thereby. A preferable desilvering time is from 1 to 3 minutes, particularly preferably from 1 to 2 minutes. The preferred desilvering temperature ranges from 25° to 50° C., more preferably from 35° to 45° C. In the preferred temperature range, the desilvering speed is increased and generation of stain after processing can be effectively inhibited.

In the desilvering step, it is desirable that agitation be reinforced as much as possible. Examples of methods of reinforcing the agitation which can be adopted in practice include the method disclosed in JP-A-62-183460 which consists of making a jet of processing solution collide with the emulsion face of the photographic material, the method disclosed in JP-A-62-183461 which consists of heightening the agitation effect by using a means of rotation, the method of heightening the agitation effect by moving the photographic material as a wiper blade equipped in the processing solution is brought into contact with the emulsion face to produce turbulent flows over the emulsion face, and the method of increasing the circulated flow rate of the processing solution over all. The above-cited means to reinforce agitation are effective for each of a bleaching solution, a bleach-fixing solution and a fixing solution. It is thought that an improvement in agitation can accelerate the feeding of the bleaching agent and the fixing agent into emulsion films to result in speedup of the desilvering processing. The foregoing means to improve agitation are more effective when a bleach accelerator is used, and they can remarkably heighten the acceleration effect and can remove the action that bleach accelerators inhibit fixation.

After the desilvering processing, the silver halide color photographic material is, in general, subjected to a washing and/or stabilization processing. The volume of washing water required in the washing processing can be set variously depending on the characteristics and end-use purposes of the photosensitive materials to be processed, the temperature of the washing water, the number of washing tanks (e.g., 2–4), the way of replenishing washing water, e.g., as to whether or not the current of water flows in the counter direction, and other various conditions.

According to the multistage counter current process, the volume of washing water can be sharply decreased. However, the process has a disadvantage, e.g., in that bacteria which have propagated themselves in the tanks because of an increase in residence time of water in the tanks produces suspended matter, and the resulting suspended matter sticks to the photosensitive materials processed therein. As a means of solving such a problem as described above, the method of lowering calcium and magnesium ion concentrations, as disclosed in JP-A-62-288838, can be employed to great advantage. Further, bactericides such as the isothiazolone compounds and thiabendazole compounds disclosed in JP-A-57-8542; chlorine-containing germicides such as sodium salt of chlorinated isocyanuric acid; and other germicides such as benzotriazoles can be used, as described in Hiroshi Horiguchi, *Bohkin Bohbai no Kagaku* (which means "Antibacterial and Moldproof Chemistry"), Sankyo Shuppan (1986); *Biseibutsu no Mekkin Sakkin Bohbai Gijutsu* (which means "Arts of Sterilizing and Pasteurizing Microbes, and Proofing Against Molds"), compiled by Eisei Gijutsukai, published by Kogyo Gijutsu Kai in 1982; and *Bohkin-Bohbazai Jiten* (which means "Thesaurus of Antibacterial Agents and Antimolds"), compiled by Nippon Bohkin Bohbai Gakkai.

A suitable pH of the washing water in the processing of the photographic material of this invention ranges from 4 to 9, more preferably from 5 to 8. The washing temperature and time can be chosen variously depending on the characteristics and the intended use of the photosensitive materials to be processed. In general they are chosen from the range of 20 seconds to 10 minutes at temperatures from 15° C. to 45° C., and they are preferably within the range of 30 seconds to 5 minutes at temperatures from 25° C. to 40° C.

Also, the photographic material of this invention can be processed directly with a stabilizer instead of undergoing the above-described washing processing. For such a stabilization processing, all of the known methods, such as described in JP-A-57-8543, JP-A-58-14834 and JP-A-60-220345, can be applied.

On the other hand, a stabilization processing operation may be carried out subsequently to the above-described washing operation. As an example of such a case, a stabilizing solution containing a dye stabilizing agent and a surfactant, which is used as the final processing solution for color photographic materials for photograph-taking use, can be given. Suitable examples of a dye stabilizing agent which can be used therein include aldehydes such as formaldehyde, glutaraldehyde and the like, N-methylol compounds, hexamethylenetetramines and aldehyde-bisulfite adducts. Various kinds of chelating agents and antimolds can also be added to the stabilizing solution. Further, it is preferable that the stabilizing solution should contain azolylmethylamines as disclosed in JP-A-59-93058 and Japanese Patent Application 3-142708.

The solution overflowing the washing bath and/or the stabilizing bath in proportion to replenishment can be reused in another processing step, such as a desilvering step.

Every processing solution used in the present invention is used in the temperature range of from 10° to 50° C. Though a standard temperature is generally within the range of 33° C. to 38° C., temperatures higher than the above range can be chosen with the intention of reducing the processing time through acceleration of the processing, or those lower than the foregoing range can be chosen in order to achieve an improvement in image quality and enhancement of the stability of the processing solution.

Next, DIR compounds represented by the general formula (II) will be described in detail.

A in the general formula (II) represents a coupler group (moiety), a redox moiety or a precursor of a redox moiety.

When A represents a coupler groups, the general formula (II) is preferably a DIR coupler represented by the general formulae (III), (IV) or (V):

$$\text{A-DI} \quad \text{(III)}$$

$$\text{A-(TIME)}_a\text{-DI} \quad \text{(IV)}$$

$$\text{A-(TIME)}_i\text{-RED-DI} \quad \text{(V)}$$

In the above formulae, A represents a coupler group (coupler moiety) which can release DI, $(\text{TIME})_a$-DI, $(\text{TIME})_i$-RED-DI or -RED-DI (when i=0) by a coupling reaction with an oxidation product of an aromatic primary amine developing agent, TIME represents a timing group capable of breaking the bond with DI or RED -DI after the release from A by the coupling reaction, RED represents a group capable of breaking the bond with DI by reacting with the oxidation product of a developing agent after splits off from A or TIME, DI represents a development inhibitor moiety, a represents 1 or 2, and i represents 0 or 1. When a is 2, the two (TIME) groups may represent the same moiety or different ones.

Specific examples of coupler groups represented by A are described below.

When A represents a yellow color image-forming coupler group, coupler groups of a pivaloylacetanilide coupler, a benzoylacetanilide coupler, malone diester coupler, malone diamide coupler, dibenzoylmethane coupler, benzothiazolylacetamide coupler, malone ester monoamide coupler, benzoxazolylacetamide coupler, benzimidazolylacetamide coupler and cycloalkanoylacetamide coupler can be given as examples. Also, the coupler groups of couplers disclosed in U.S. Pat. Nos. 5,021,332 and 5,021,330, and EP-A2-0421221 (U.S. Pat. No. 5,035,987) are included in examples of those represented by A.

When A represents a magenta color image-forming coupler group, coupler groups of a 5-pyrazolone coupler, a pyrazolobenzimidazole coupler, a pyrazolotriazole coupler, a pyrazoloimidazole coupler and a cyanoacetophenone coupler can be given as examples.

When A represents a cyan color image-forming coupler groups, a phenyl coupler and a naphthol coupler can be given as examples. Also, the coupler groups of couplers disclosed in U.S. Pat. No. 4,746,602 and EP-A2-0249453 (U.S. Pat. No. 4,818,672) are included in examples those represented by A.

Further, A may be a coupler groups which leaves substantially no color image. Coupler groups of this type include, e.g., coupler groups of an indanone coupler and an acetophenone coupler, and those of the elution type as disclosed in EP-A-0443530 (U.S. Pat. No. 5,151,343) and EP-A-0444501 (U.S. Pat. No. 5,026,628).

When A represents a coupler group in the general formulae (III), (IV) and (V), suitable examples of A include coupler groups represented by the following general formulae (Cp-1), (Cp-2), (Cp-3), (Cp-4), (Cp-5), (Cp-6), (Cp-7), (Cp-8), (Cp-9) and (Cp-10), respectively. They are preferred because of their high coupling speed:

(Cp-1)

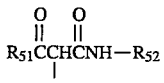

(Cp-2)

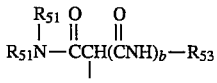

(Cp-3)

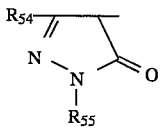

(Cp-4)

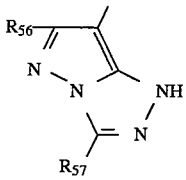

(Cp-5)

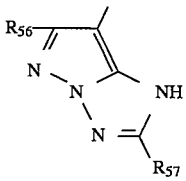

(Cp-6)

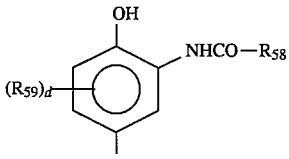

(Cp-7)

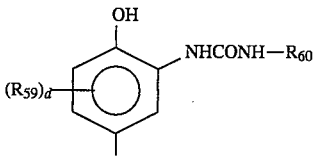

(Cp-8)

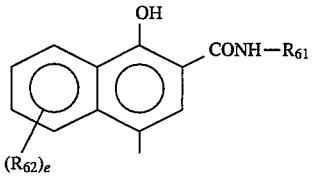

(Cp-9)

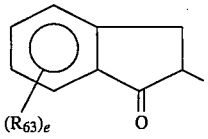

-continued (Cp-10)

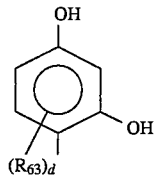

In each of the foregoing formulae, the free bond shown at the coupling site designates the bonding position of a coupling eliminable group.

When $R_{51}$, $R_{52}$, $R_{53}$, $R_{54}$, $R_{55}$, $R_{56}$, $R_{57}$, $R_{58}$, $R_{59}$, $R_{60}$, $R_{61}$, $R_{62}$ or $R_{63}$ in the above formulae contains a nondiffusible group, the group is chosen so that the total number of carbon atoms contained in the corresponding coupler group may range from 8 to 40, preferably from 10 to 30, while in other cases it is desirable that the total number of carbon atoms should be below 15. When a coupler group assumes a bis, telomer or polymer form, one of the above-cited substituents represents a divalent group, to which a constitutional repeating unit is connected. In such cases, the total number of carbon atoms may exceed the above-described range.

$R_{51}$ to $R_{63}$, b, d and e are described below in detail.

In the following description, $R_{41}$ represents an alkyl group, an aryl group or a heterocyclic group, $R_{42}$ represents an aryl group or a heterocyclic group, and $R_{43}$, $R_{44}$ and $R_{45}$ each represents a hydrogen atom, an alkyl group, an aryl group or a heterocyclic group. $R_{51}$ has the same meaning as $R_{43}$. $R_{52}$ and $R_{53}$ each have the same meaning as $R_{43}$. b represents 0 or 1. $R_{54}$ represents the same meaning as $R_{41}$, $R_{41}CO(R_{43})N$—, $R_{41}SO_2(R_{43})N$—, $R_{41}(R_{43})N$—, $R_{41}S$—, $R_{43}O$— or $R_{45}(R_{43})NCON(R_{44})$—. $R_{55}$ has the same meaning as $R_{41}$. $R_{56}$ and $R_{57}$ each has the same meaning as $R_{43}$, or represents $R_{41}S$—, $R_{43}O$—, $R_{41}CO(R_{43})N$— or $R_{41}So_2(R_{43})N$—. $R_{58}$ has the same meaning as $R_{41}$. $R_{59}$ represents a group having the same meaning as $R_{41}$, or represents $R_{41}CO(R_{43})N$—, $R_{41}OCO(R_{43})N$—, $R_{41}SO_2(R_{43})N$—, $R_{43}(R_{44})NCO$ $(R_{45})N$—, $R_{41}O$—, $R_{41}S$—, a halogen atom or $R_{41}(R_{43})N$—. d represents 0 or an integer from 1 to 3. When d is 2 or 3, the plural $R_{59}$ groups may represent the same substituent group or different ones. $R_{60}$ has the same meaning as $R_{41}$. $R_{61}$ has the same meaning as $R_{41}$. $R_{62}$ has the same meaning as $R_{41}$, or represents $R_{41}CONH$—, $R_{41}OCONH$—, $R_{41}SO_2NH$—, $R_{43}(R_{44})NCONH$—, $R_{43}(R_{44})NSO_2NH$—, $R_{43}O$—, $R_{41}S$—, a halogen atom or $R_{41}NH$—. $R_{63}$ has the same meaning as $R_{41}$, or represents $R_{43}CO(R_{44})N$—, $R_{43}(R_{44})NCO$—, $R_{41}SO_2(R_{43})N$—, $R_{41}(R_{43})NSO_2$—, $R_{41}SO_2$—, $R_{43}OCO$—, $R_{43}OSO_2$—, a halogen atom, a nitro group, a cyano group or $R_{43}CO$—. e represents 0 or an integer from 1 to 4. When a plurality of $R_{62}$ groups or $R_{63}$ groups are present, they may be the same or different.

The alkyl group in the above description includes saturated or unsaturated, chain or cyclic, straight-chain or branched chain, substituted or unsubstituted alkyl groups containing 1 to 32 carbon atoms, preferably 1 to 22 carbon atoms. Typical examples thereof include methyl, cyclopropyl, isopropyl, n-butyl, t-butyl, i-butyl, t-amyl, n-hexyl, cyclohexyl, 2-ethylhexyl, n-octyl, 1,1,3,3-tetramethylbutyl, n-decyl, n-dodecyl, n-hexadecyl and n-octadecyl.

The aryl group in the above description includes aryl groups containing 6 to 20 carbon atoms, preferably substituted or unsubstituted phenyl and naphthyl groups.

The heterocyclic group in the above description includes 3- to 8-membered, substituted or unsubstituted heterocyclic groups containing 1 to 20, preferably 1 to 7, carbon atoms and one or more of hetero atoms selected from a nitrogen, an oxygen and a sulfur atom. The heterocyclic group may be condensed with a benzene ring. Typical examples thereof include 2-pyridyl, 2-benzoxazolyl, 2-imidazolyl, 2-benzimidazolyl, 1-indolyl, 1,3,4-thiadiazole-2-yl, 1,2,4-triazole-2-yl and 1-indolinyl.

Suitable examples of substituent groups which each of the foregoing alkyl, aryl and heterocyclic groups may have include a halogen atom, $R_{47}O$—, $R_{46}S$—, $R_{47}CO(R_{48})N$—, $R_{47}(R_{48})NCO$—, $R_{46}OCO(R_{47})N$—, $R_{46}SO_2(R_{47})N$—, $R_{47}(R_{48})NSO_2$—, $R_{46}SO_2$—, $R_{47}OCO$—, $R_{47}NCO(R_{48})N$—, $R_{47}CONHSO_2$—, $R_{47}NHCONHSO_2$—, a group having the same meaning as $R_{46}$, $R_{47}(R_{48})N$—, $R_{46}COO$—, $R_{47}OSO_2$—, a cyano group and a nitro group. In this description, $R_{46}$ represents an alkyl group, an aryl group or a heterocyclic group, and $R_{47}$, $R_{48}$ and $R_{49}$ each represent an alkyl, an aryl or heterocyclic group, or a hydrogen atom. The alkyl, aryl and heterocyclic groups described in this paragraph have the same meanings as defined hereinbefore, respectively.

Below, $R_{51}$ to $R_{63}$, b, d and e are described with regard to their respective preferable scopes.

$R_{51}$ is preferably an alkyl, aryl or heterocyclic group. $R_{52}$ and $R_{55}$ are each preferably an aryl group. $R_{53}$ is preferably an aryl group when b=1, while when b=0 $R_{53}$ is preferably a heterocyclic group. $R_{54}$ is preferably $R_{41}CONH$— or $R_{41}(R_{43})N$—. $R_{56}$ and $R_{57}$ are each preferably an alkyl group, $R_{41}O$— or $R_{41}S$—. $R_{58}$ is preferably an alkyl or aryl group.

In the general formula (Cp-6), it is preferable that $R_{59}$ is a chlorine atom, an alkyl group or $R_{41}CONH$—, that d is 1 or 2 and that $R_{60}$ is an aryl group. In the general formula (Cp-7), it is preferable that $R_{59}$ is $R_{41}CONH$—, d is 1 and $R_{61}$ is an alkyl or aryl group. In the general formula (Cp-8), it is preferable that e is 0 or 1 and that $R_{62}$ is $R_{41}OCONH$—, $R_{41}CONH$— or $R_{41}SO_2NH$—, and it is preferable that they are located at the 5-position of the naphthol ring. In the general formula (Cp-9), it is preferable that $R_{63}$ is $R_{41}CONH$—, $R_{41}SO_2NH$—, $R_{41}(R_{43})NSO_2$—, $R_{41}SO_2$—, $R_{41}(R_{43})NCO$—, a nitro group or a cyano group. In the general formula (Cp-10), it is preferable that $R_{63}$ is $R_{43}NCO$—, $R_{43}OCO$— or $R_{43}CO$—.

The development inhibitor represented by DI is described below.

Examples of the development inhibitor containing the group represented by DI include those disclosed in *Research Disclosure*, vol. 76, No. 17643 (December 1978), U.S. Pat. Nos. 4,477,563, 5,021,332, 5,026,628, 3,227,554, 3,384,657, 3,615,506, 3,617,291, 3,733,201, 3,933,500, 3,958,993, 3,961,959, 4,149,886, 4,259,437, 4,095,984 and 4,782,012, and British Patents 1,450,479 and 5,034,311. More specifically, DI is preferably is a heterocyclic thio group, a heterocyclic seleno group or a triazolyl group (namely, a 1,2,3-triazolyl or 1,2,4-triazolyl group, either of which may be fused together with another ring). In particular, a tetrazolylthio group, a tetrazolylseleno group, a 1,3,4-oxadiazolylthio group, a 1,3,4-thiadiazolylthio group, a 1-or 2-benzotriazolyl group, a 1,2,4-triazole-1-(or 4-)yl group, a 1,2,3-triazole-lyl group, a 2-benzothiazolylthio group, a 2-benzoxazolylthio group, a 2-benzimidazolylthio group or derivatives thereof are preferred. Preferred development inhibitor moieties are represented by the following general formulae DI-1 to DI-6.

DI-1

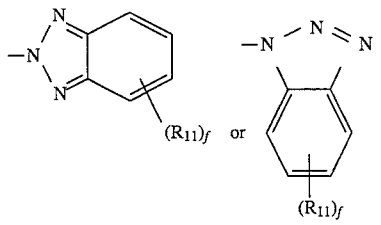

DI-2

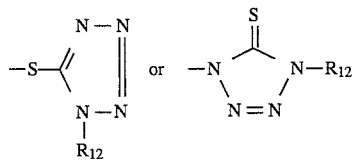

DI-3

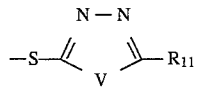

DI-4

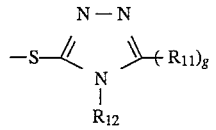

DI-5

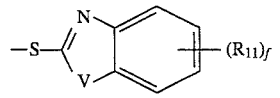

DI-6

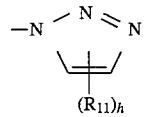

In the foregoing formulae, $R_{11}$ represents a halogen atom (e.g., bromine, chlorine), an alkoxycarbonyl group containing 2 to 20, preferably 2 to 10 carbon atoms (e.g., methoxycarbonyl, isoamyloxycarbonyl), an acylamino group containing 2 to 20, preferably 2 to 10 carbon atoms (e.g., hexanamido, benzamido), a carbamoyl group containing 1 to 20, preferably 1 to 10 carbon atoms (e.g., N-butylcarbamoyl, N,N-diethylcarbamoyl, N-mesylcarbamoyl), a sulfamoyl group containing 1 to 20, preferably 1 to 10 carbon atoms (e.g., N-butylsulfamoyl), an alkoxy group containing 1 to 20, preferably 1 to 10 carbon atoms (e.g., methoxy, benzyloxy), an aryloxy group containing 6 to 20, preferably 6 to 10 carbon atoms (e.g., phenoxy, 4-methoxyphenoxy, naphthoxy), an aryloxycarbonyl group containing 7 to 21, preferably 7 to 11 carbon atoms (e.g., phenoxycarbonyl), an alkoxycarbonylamino group containing 1 to 20, preferably 1 to 10 carbon atoms (e.g., ethoxycarbonylamino), a cyano group, a nitro group, an alkylthio group containing 1 to 20, preferably 1 to 10 carbon atoms (e.g., methylthio, hexylthio), an ureido group containing 1 to 20, preferably 1 to 10 carbon atoms (e.g., N-phenylureido), an aryl group containing 6 to 10 carbon atoms (e.g., phenyl, naphthyl, 4-methoxyphenyl), a heterocyclic group containing 1 to 10 carbon atoms and at least one hetero atom selected, e.g., from a nitrogen, an oxygen or a sulfur atom (which is a 3- to 12-membered, preferably 5- or 6-membered, single or condensed ring, with examples including 2-pyridyl, 1-pyrrolyl, morpholino and indolyl), an alkyl group containing 1 to 20, preferably 1 to 10 carbon atoms (which may be a straight-chain, branched or cyclic, saturated or unsaturated alkyl group, with examples including methyl, ethyl, butoxycarbonylmethyl, 4-methoxybenzyl and benzyl), an acyl group containing 1 to 20, preferably 2 to 10 carbon atoms (e.g., acetyl, benzoyl), an arylthio group containing 6 to 10, preferably 6 to 10 carbon atoms (e.g., phenylthio, naphthylthio), or an aryloxycarbonylamino group containing 7 to 11 carbon atoms (e.g., phenoxycarbonylamino). The above-cited groups may further have one or more substituent groups. Examples of suitable such substituent groups, include the groups described in this paragraph.

In the foregoing formulae, $R_{12}$ represents an aryl group containing 6 to 10 carbon atoms (e.g., phenyl, naphthyl, 4-methoxyphenyl, 3-methoxycarbonylphenyl), a heterocyclic group containing 1 to 10 carbon atoms and at least one hereto atom selected, e.g., from a nitrogen, an oxygen or a sulfur atom (which is a 3- to 12-membered, preferably 5- or 6-membered, single or condensed ring, with examples including 2-pyridyl, 1-pyrrolyl, morpholino and indolyl), or an alkyl group containing 1 to 20, preferably 1 to 10 carbon atoms (which may be a straight-chain, branched or cyclic, saturated or unsaturated alkyl group, with examples including methyl, ethyl, butoxycarbonylmethyl, 4-methoxybenzyl and benzyl). V represents an oxygen atom or a sulfur atom. f represents an integer from 1 to 4, g represents 0 or 1, and h represents 1 or 2.

The group represented by TIME is described below.

TIME may represent any linkage group so long as it can release DI or RED-DI after it splits off from A at the time of development-processing. Specific examples of such a linkage group include those disclosed in U.S. Pat. Nos. 4,146,396, 4,652,516 and 4,698,297 which utilize the cleavage reaction of hemiacetals, the timing groups disclosed in U.S. Pat. Nos. 4,248,962, 4,847,185 and 4,857,440 which can cause a cleavage reaction by the utilization of an intramolecular nucleophilic substitution reaction, the timing groups disclosed in U.S. Pat. Nos. 4,409,323 and 4,421,845 which can cause a cleavage reaction by the utilization of an electron transfer reaction, the groups disclosed in U.S. Pat. No. 4,546,073 which can cause a cleavage reaction through hydrolysis of an iminoketal, and the groups disclosed in West German Patent Application (OLS) 2,626,317 which can cause a cleavage reaction through hydrolysis of an ester. TIME is attached to A via a hetero atom contained in TIME, preferably via an oxygen, sulfur or nitrogen atom. Linkage groups preferred as TIME are represented by the following general formulae (T-1), (T-2) and (T-3):

$$*\text{—}W\text{—}(X{=}Y)_j\text{—}C(R_{21})R_{22}\text{—}** \quad \text{(T-1)}$$

$$*\text{—}W\text{—}CO\text{—}** \quad \text{(T-2)}$$

$$*\text{—}W\text{—}LINK\text{—}E\text{—}** \quad \text{(T-3)}$$

In the above formulae, * is a mark for the position at which each group is attached to A in the general formulae (IV) and (V); ** is a mark for the position at which each group is attached to DI (in the case where a=1) or TIME (in the case where a=2) in the general formula (IV), or to RED-DI in the general formula (V); W represents an oxygen atom, a sulfur atom or >N-$R_{23}$; X and Y each represents a methine group or a nitrogen atom; j represents 0, 1 or 2; and $R_{21}$, $R_{22}$ and $R_{23}$ each represents a hydrogen atom or a substituent group. When X and Y each represents a substituted methine, any two among the substituent groups which X and Y have, $R_{21}$, $R_{22}$ and $R_{23}$ may combine with each other to form a ring structure (such as a benzene or pyrazole ring). Of course, they may not form any ring structure. In the general formula (T-3), E represents an electrophilic group, and LINK represents a linkage group bringing about such a steric relation between W and E that these groups can undergo an intramolecular nucleophilic displacement reaction.

Specific examples of TIME represented by the general formula (T-1) are illustrated below.

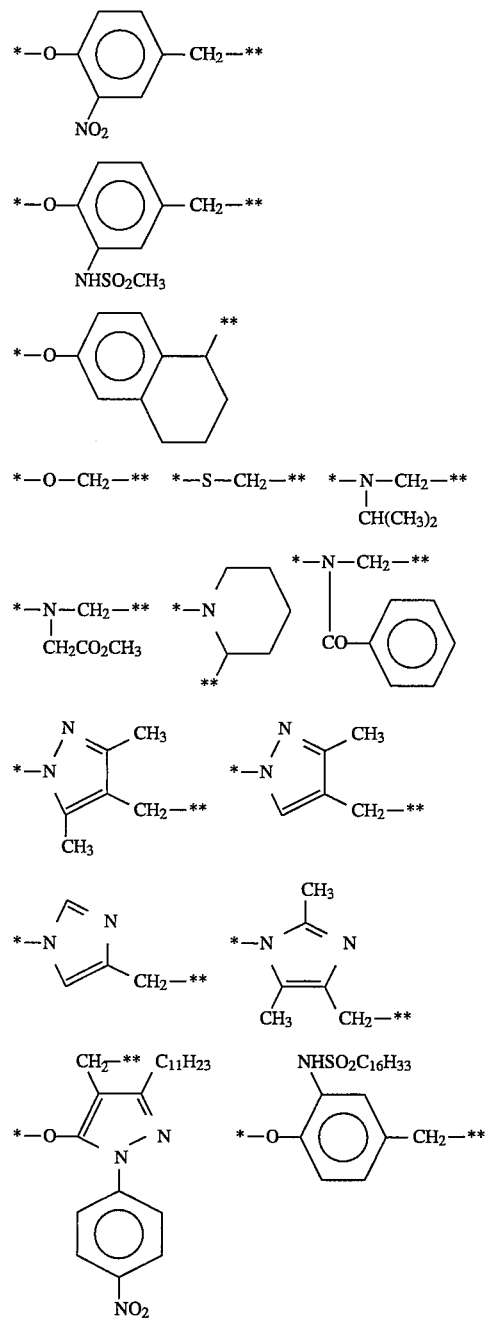

Specific examples of TIME represented by the general formula (T-2) are illustrated below.

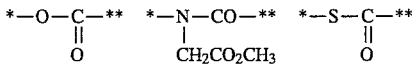

Specific examples of TIME represented by the general formula (T-3) are illustrated below.

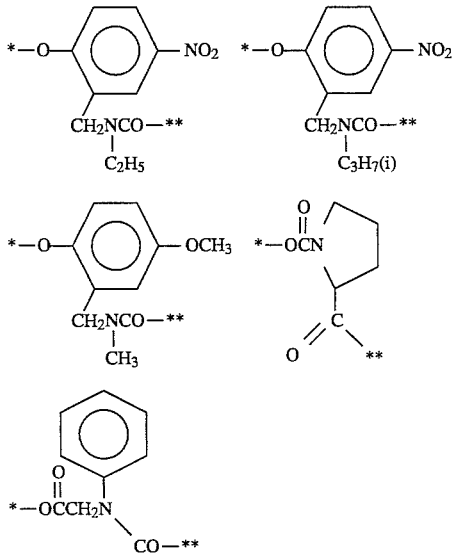

Specific examples of $(TIME)_a$ in the case where a=2 the general formula (IV) are illustrated below.

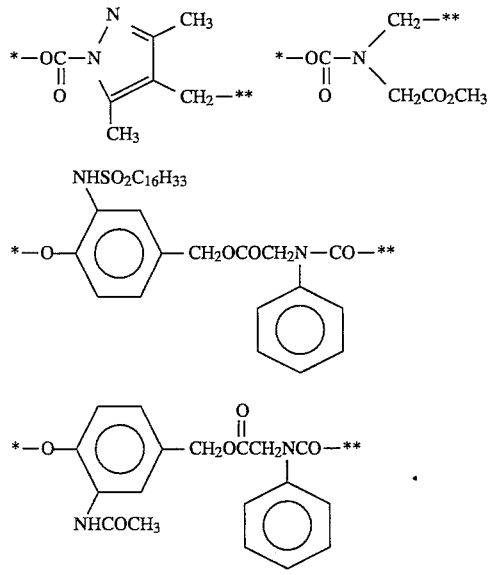

-continued

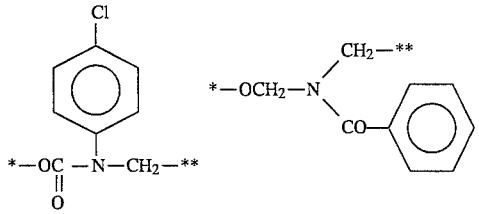

The group represented by RED in the general formula (V) is described below in detail.

RED splits off from A (in the case where i=0) or TIME (in the case where i=1) in the form of RED-DI, and said RED-DI can undergo a cross-oxidation reaction with an oxidative substance present at the time of development, e.g., the oxidation product of a developing agent. Any group may be used as RED so long the bond between RED and DI is cleaved when RED-DI undergoes oxidation. Suitable examples of RED include a hydroquinone, a catechol, a pyrogallol, a 1,4-naphthohydroquinone, a 1,2-naphthohydroquinone, a sulfonamidophenol, a hydrazide and a sulfonamidonaphthol groups. Specific examples of such residues are disclosed, e.g., in JP-A-61-230135 (U.S. Pat. Nos. 4,740,453 and 5,142,029), JP-A-62-251746 (U.S. Pat. No. 4,791,049), JP-A-61-278852 (U.S. Pat. No. 4,770,982), U.S. Pat. Nos. 3,364,022, 3,379,529, 4,618,571, 3,639,417 and 4,684,604, and *J. Org. Chem.*, vol. 29, p. 588 (1964).

Of the above-cited residues, those derived from hydroquinones, 1,4-naphthohydroquinones, 2-(or 4-)sulfoamidophenols, pyrogallols and hydrazides are preferred in particular. When the corresponding redox compounds have a phenolic OH group, the residues thereof are attached to A or TIME via the oxygen atom of said phenolic OH.

Of the couplers represented by the general formulae (III), (IV) and (V), respectively, the couplers represented by the general formulae (IV) and (V), and especially those represented by the general formula (V), are preferable in the respect that greater effects can be produced in the processing with a color developer containing the color developing agent of the general formula (I) . More specifically, color reproducibility and other image qualities can be heightened synergistically when functional couplers of the kind which release a compound incapable of producing any development inhibiting effect upon the coupling reaction but which can release a development inhibitor through a subsequent reaction of said released compound, for example, timing type DIR couplers as represented by the general formula (IV) and couplers as represented by the general formula (V), are used in combination with the color developing agents described above. Detailed explanations for this point will be given in the Examples.

Examples of the DIR couplers represented by the general formula (III) are illustrated below. However, the invention should not be construed as being limited to these examples:

(III-1)
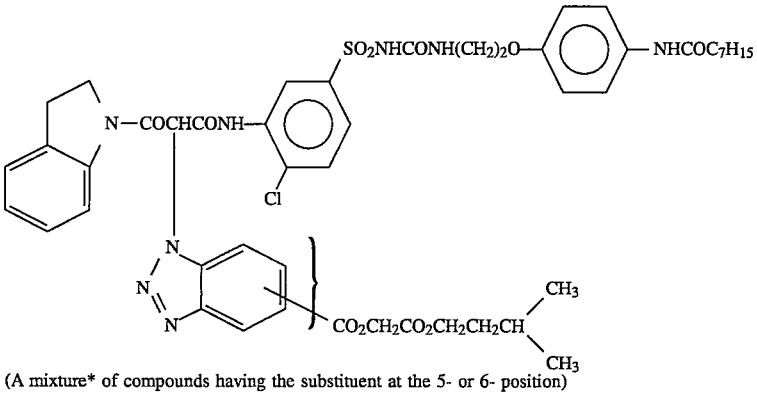
(A mixture* of compounds having the substituent at the 5- or 6- position)
(III-2)
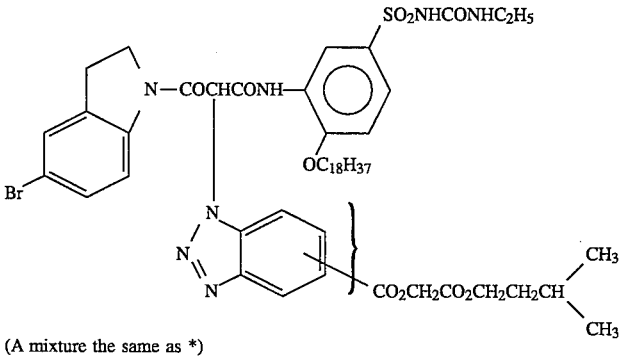
(A mixture the same as *)
(III-3)
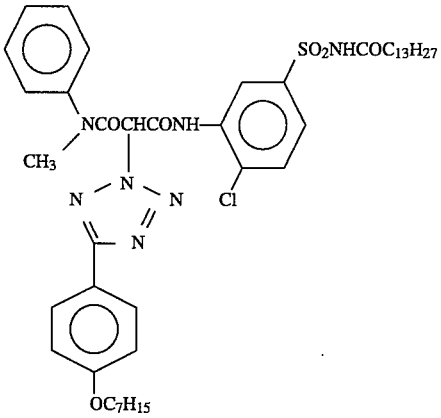
(III-4)
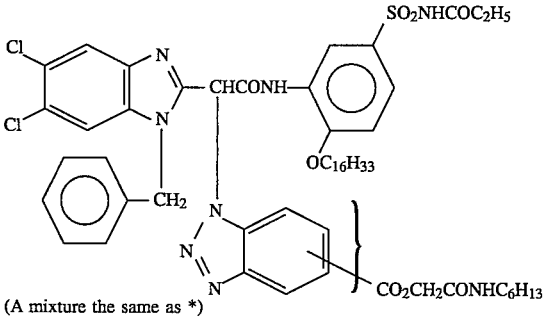
(A mixture the same as *)

-continued
(III-5)
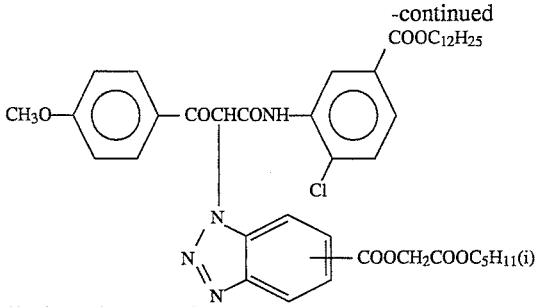
(A mixture the same as *)
(III-6)
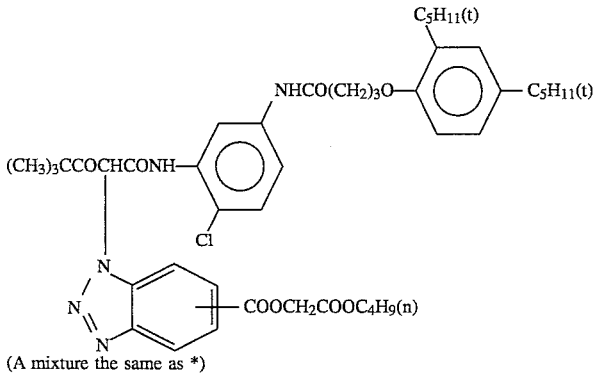
(A mixture the same as *)
(III-7)
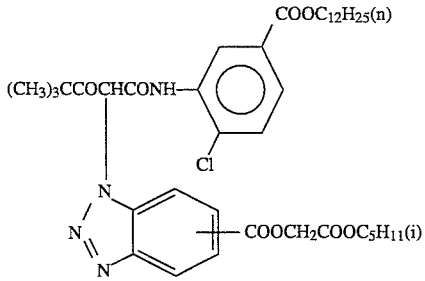
(A mixture the same as *)
(III-8)
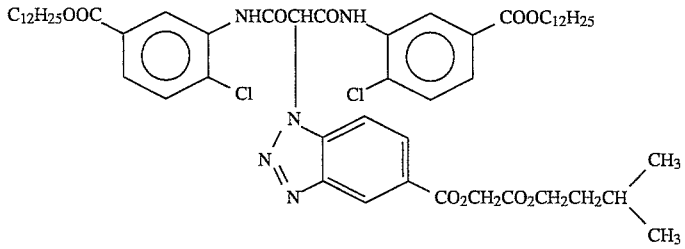

-continued
(III-9)
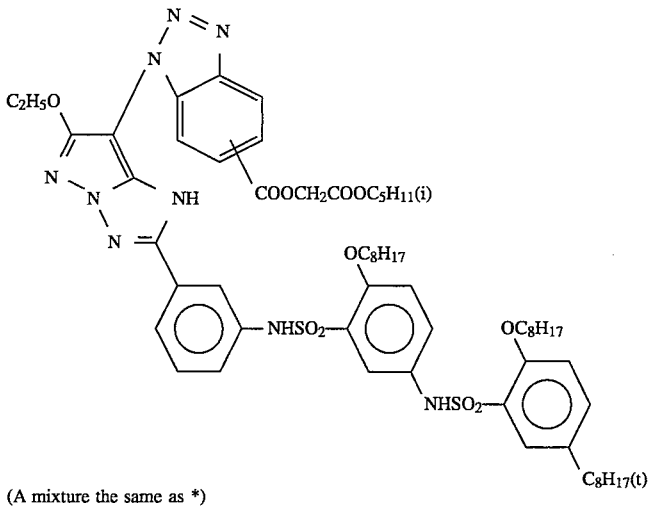
(A mixture the same as *)
(III-10)
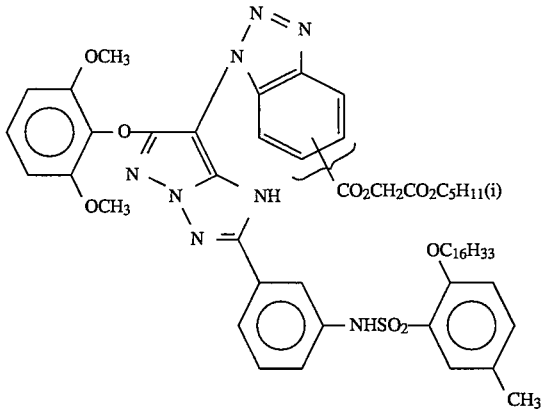
(A mixture the same as *)
(III-11)
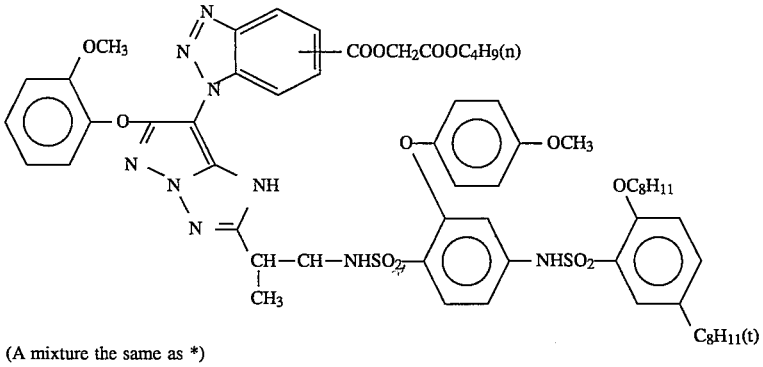
(A mixture the same as *)

-continued
(III-12)
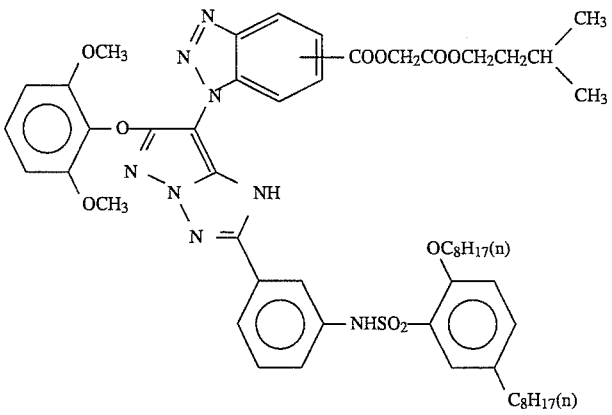
(III-13)
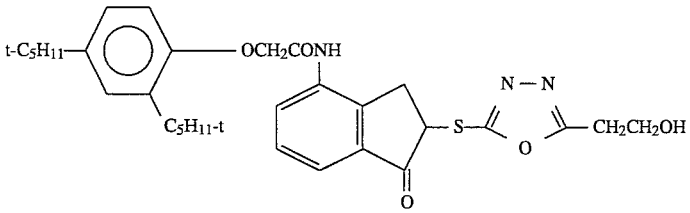
(III-14)
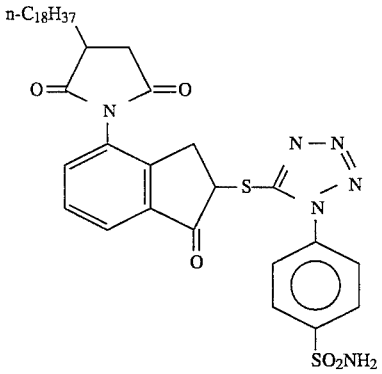
(III-15)
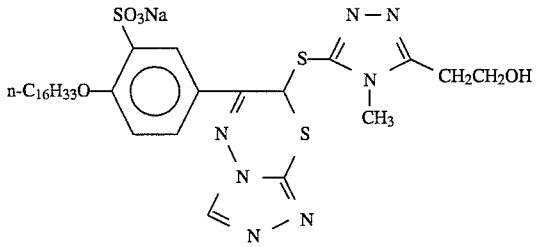
Additional specific examples of DIR couplers represented by general formula (III) include the following.
(III-16): the DIR coupler which corresponds to ExY-2 in Example 1 of EP-A2-0438148,
(111-17): the DIR coupler which corresponds to MC-(29) illustrated as a specific example of the compound represented by the general formula (I) in JP-A-03-134663 and (111-18): the DIR coupler shown below which corresponds to (28) illustrated as a specific example of the compound represented by the general formula (Y) in JP-A-03-127050

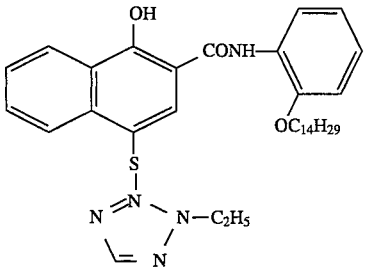

Representatives examples of the DIR couplers represented by the general formula (IV) are illustrated below. However, the invention should not be construed as being limited to these examples:

(IV-1)

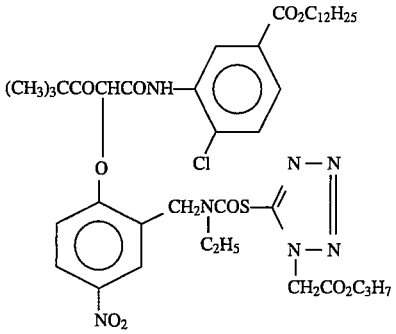

(IV-2)

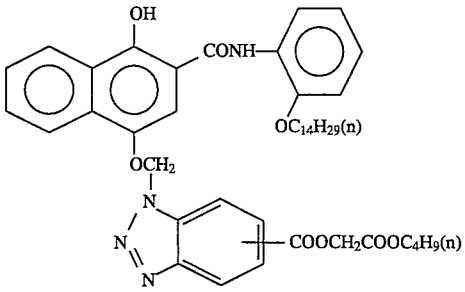

(A mixture the same as *)

(IV-3)

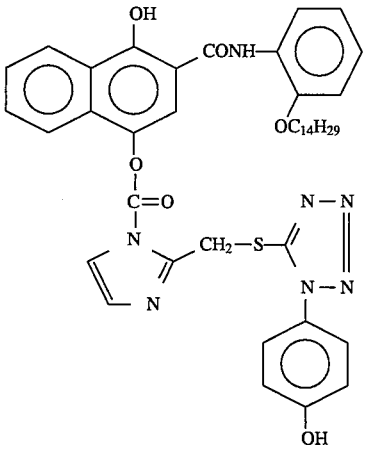

(IV-4)

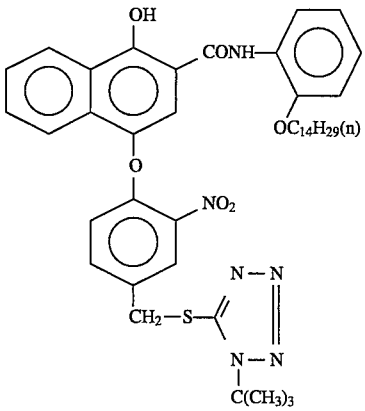

(IV-5)

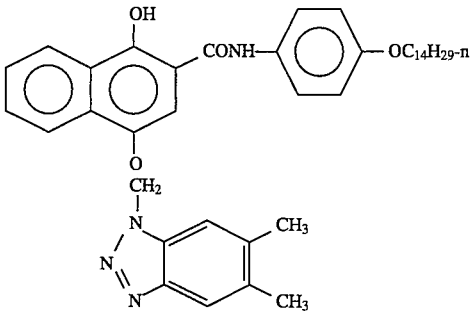

(IV-6)

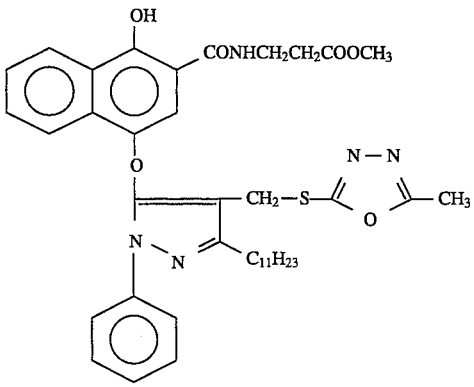

-continued
(IV-7)
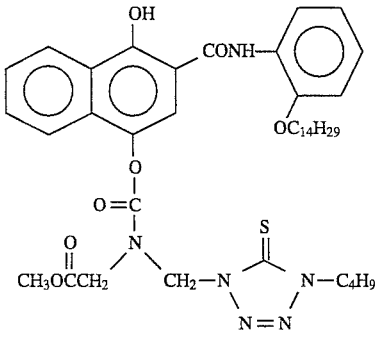
(IV-8)
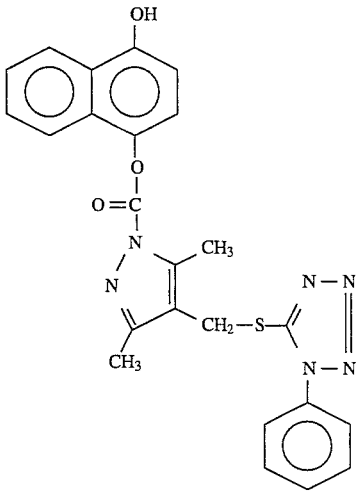
(IV-9)
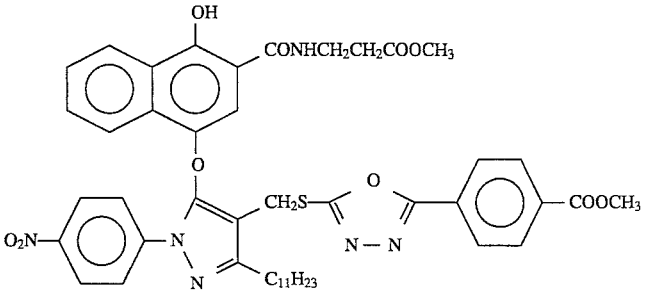
(IV-10)
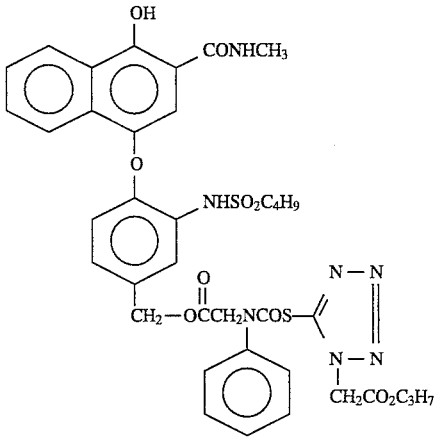
(IV-11)
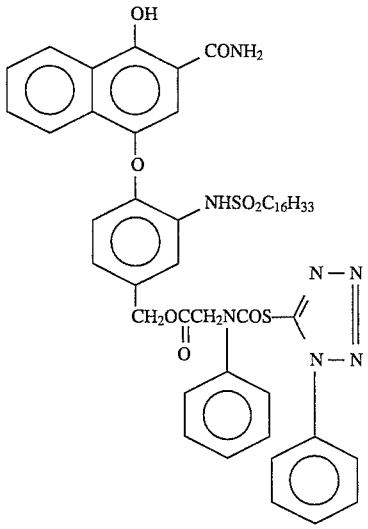
(IV-12)
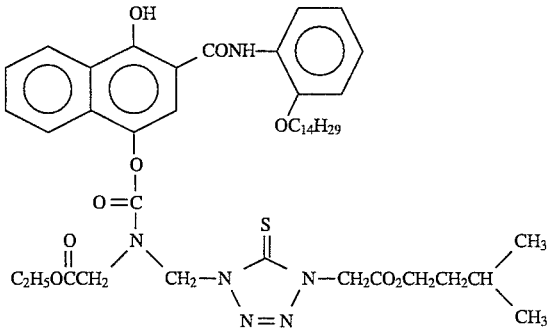

Other examples of couplers represented by the general formula (IV) include:

(IV-13):the coupler which corresponds to Compound 14 in JP-A-02-39147 (U.S. Pat. No. 4,962,018), (IV-14):the coupler which corresponds to Compound 7 in JP-A-02-48655 (U.S. Pat. No. 4,782,012),

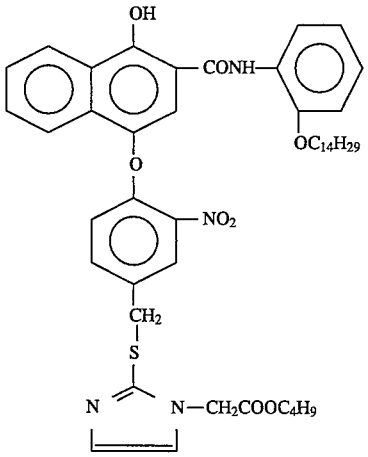

(IV-15):the coupler which corresponds to D-25 cited as exemplified compound in JP-A-02-219047,

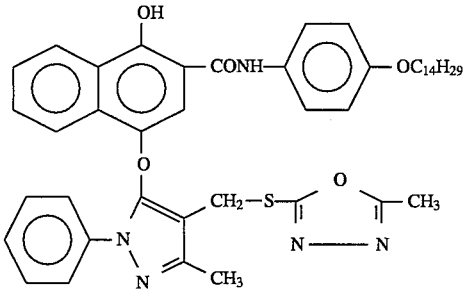

(IV-16):the coupler which corresponds to (14) illustrated as a specific example of the general formula (Y) in JP-A-03-127050, (IV-17):the coupler which corresponds to Coupler 2 illustrated in column 41 of U.S. Pat. No. 5,021,322, (IV-18):the coupler which corresponds to Ex-10 in Example 1 of JP-A-01-106056, and (IV-i9):the coupler which corresponds to D-26 cited as an exemplified compound in JP-A-03-127057.

Representative examples of the DIR couplers represented by the general formula (V) are illustrated below. However, the invention should not be construed as being limited to these examples:

(V-1)

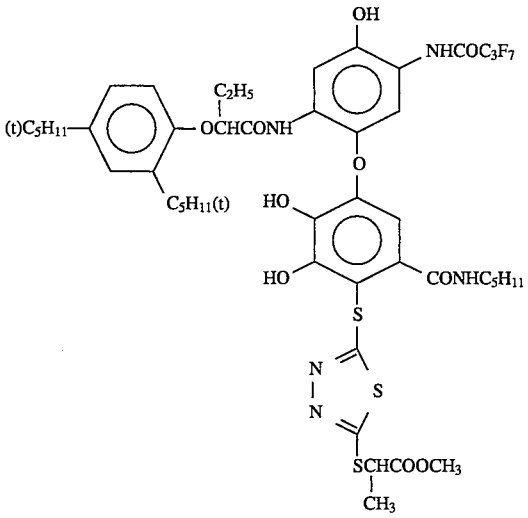

-continued (V-2)

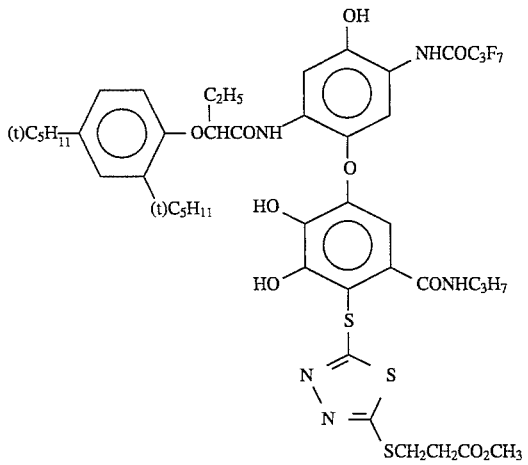

(V-3)

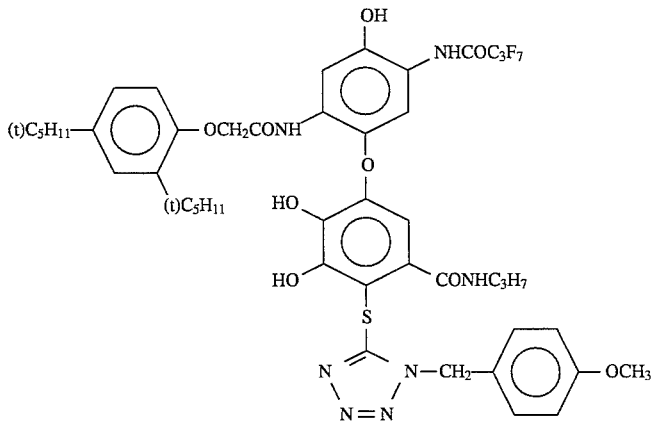

When A represents a redox moiety or a precursor thereof, the general formula (II) is represented by the following general formula (VI):

$$B—(L)_n—(G)_m—(Time)_t—X \quad (VI)$$

In the above formula, B represents a redox moiety or a precursor thereof which enables the release of —$(Time)_t$—X only when it undergoes oxidation upon photographic development processing. Time represents a timing group, and X represents a development inhibitor moiety. L represents a divalent linkage group, and G represents an acidic group. n, m and t each represents 0 or 1.

Further detailed description of the general formula (VI) is given below.

Examples of a redox moiety represented by B include those following the Kendall-Pelz rule, such as hydroquinone, catechol, p-aminophenol, o-aminophenol, 1,3-naphthalenediol, 1,4-naphthalenediol, 1,6-naphthalenediol, 1,2-aminonaphthol, 1,4-aminonaphthol, 1,6-aminonaphthol, gallic acid esters, gallic acid amides, hydrazine, hydroxylamino, pyrazolidone and reductone.

It is desirable that the amino groups contained in redox moiety cited above should be substituted with a sulfonyl group containing 1 to 25 carbon atoms or an acyl group containing 1 to 25 carbon atoms. Suitable examples of such a sulfonyl group include substituted or unsubstituted aliphatic and aromatic sulfonyl groups. Suitable examples of such an acyl group include substituted or unsubstituted aliphatic and aromatic acyl groups. Hydroxyl or amino group which constitute a redox moiety represented by B may be protected with a blocking group which can release its blocking group upon development processing. Examples of such a blocking group include those containing 1 to 25 carbon atoms, such as an acyl group, an alkoxycarbonyl group, a carbamoyl group, and the groups disclosed in JP-A-59-197037 and JP-A-59-201057. These blocking groups may further combine, if possible, with some of the substituents of B described below to form 5-, 6- or 7-membered rings.

The redox moiety represented by B may be substituted by certain substituents at replaceable positions thereof. Examples of such substituents include those containing no more than 25 carbon atoms, for example, an alkyl group (C (carbon atom number): 1 to 25), an aryl group (C: 6 to 25), an alkylthio group, (C: 1 to 25), an arylthio group (C: 6 to 25), an alkoxy group (C: 1 to 25), an aryloxy group (C: 6 to 25), an amino group (C: 0 to 25), an amido group (C: 1 to 25), an alkyl-or aryl-sulfonamido group (C: 1 to 20 or 6 to 25, respectively), an alkoxycarbonylamino group (C: 2 to 25), an ureido group (C: 1 to 25), a carbamoyl group (C: 1 to 25), an alkoxycarbonyl group (C; 2 to 25), a sulfamoyl group (C: 0 to 25), an alkyl- or aryl-sulfonyl group (C: 1 to 25 or 6 to 25, respectively), cyano group, a halogen atom, an aliphatic- or aromatic-acyl group (C: 1 to 25 or 6 to 25, respectively), —COOM or —$SO_3M$ (M: H, alkali metal atom such as Na and K, $NH_4$), a sulfo group, a nitro group, a heterocyclic group and a group of the formula -$(L)_n$-$(G)_m$-$(Time)_t$-X. These substituents may further be substituted with one or more of these substituent groups described in this paragraph. Moreover, any pair of these substituents may combine with each other, if possible, to form a saturated or unsaturated carbon ring or a saturated or unsaturated hereto ring.

Moieties preferred as B include a hydroquinone, catechol, a p-aminophenol, an o-aminophenol, a 1,4-naphthalenediol, a 1,4-aminonaphthol, a gallic acid ester, a gallic acid amide and a hydrazine moieties. Of these redox moieties, a hydroquinone, a catechol, a p-aminophenol, an o-aminophenol and a hydrazine moieties are more preferred, and a hydroquinone and a hydrazine moieties are most preferred.

L represents a divalent linkage group, with suitable examples including an alkylene group, an alkenylene group, an arylene group, an oxyalkylene group, an oxyarylene group, an aminoalkyleneoxy group, an aminoaikenyleneoxy group, an aminoaryleneoxy group and an oxygen atom.

G represents an acidic group, with suitable examples including —CO—, —COCO—, —CS—, —SO—, —$SO_2$—, —$PO(OR_{11})$— and —$C(=NR_{12})$—. Herein, $R_{11}$ represents an alkyl, aryl or heterocyclic group, and $R_{12}$ represents a hydrogen atom or a group represented by $R_{11}$. Of those groups, —CO—, —COCO—, —$PO(OR_{11})$— and —$C(=NR_{12})$— are preferred as G, —CO— and —COCO— are more preferred, and —CO— is most preferred.

n and m each represents 0 or 1, and preferable number changes depending on the nature of the B groups. For instance, n=0 is preferable and n=m=0 is more preferable when B represents a hydroquinone, a catechol, an aminophenol, a naphthalenediol, an aminonaphthol or a gallic acid ester moiety. The combination of n=0 and m=1 is preferable when B represents a hydrazine moiety, and n=m=1 is preferable when B represents a pyrazolidone moiety.

-$(Time)_t$-X is a group capable of being released only when the redox moiety represented by B in the general formula (VI) undergoes a cross-oxidation reaction upon development to be converted to the oxidized compound.

"Time" is a timing group linked with B via a sulfur, nitrogen, oxygen or selenium atom in Time and, more specifically, Time is a group capable of releasing X from the moiety -$(Time)_t$-X (which was released upon development) through at least one reaction step. Suitable examples of Time include the groups disclosed in U.S. Pat. Nos. 4,248,962 and 4,409,323, British Patent 2,096,783, U.S. Pat. No. 4,146,396, JP-A-51-146828 (British Patent 1,531,927), JP-A-57-56837, and so on. Two or more of the timing groups disclosed therein may be combined to serve as Time.

X represents a development inhibitor moiety. Examples of a suitable development inhibitor include a compound containing a mercapto group attached to a hetero ring and a heterocyclic compound capable of producing an iminosiiver. Specific examples of a compound containing a mercapto group attached to a hetero ring include substituted or unsubstituted mercaptoazoles (such as 1-phenyl-5-mercaptotetrazole, 1-propyl-5-mercaptotetrazole, 1-butyl-5-mercaptotetrazole, 2-methylthio-5-mercapto-1,3,4-thiadiazole, 3-methyl-4-phenyl-5-mercapto-1,2,4-triazole, 1-(4-ethylcarbamoylphenyl)-2-mercaptoimidazole, 2-mercaptobenzoxazole, 2-mercaptobenzimidazole, 2-mercaptobenzothiazole, 2-mercaptobenzoxazole, 2-phenyl-5-mercapto-1,3,4-oxadiazole, 1-{3-(3-methylureido)phenyl}-5-mercaptotetrazole, 1-(4-nitrophenyl)-5-mercaptotetrazole, 5-(2-ethylhexanoylamino)- 2-mercaptobenzimidazole, etc.), substituted or unsubstituted mercaptoazaindenes (such as 6-methyl- 4-mercapto-1,3,3a,7-tetraazaindene, 4,6-dimethyl-2-mercapto-1,3,3a,7-tetraazaindene, etc.) and substituted or unsubstituted mercaptopyrimidines (such as 2-mercaptopyrimidine, 2-mercapto-4-methyl-6-hydroxypyrimidine, etc.).

Specific examples of a heterocyclic compound capable of producing an iminosilver include substituted or unsubstituted triazoles (such as 1,2,4-triazole, benzotriazole, 5-methylbenzotriazole, 5-nitrobenzotriazole, 5-bromobenzotriazole, 5-n-butylbenzotriazole, 5,6-dimethylbenzotriazole, etc.), substituted or unsubstituted indazoles (such as indazole, 5-nitroindazole, 3-nitroindazole, 3-chloro-5-nitroindazole, etc.) and substituted or unsubstituted benzimidazoles (such as 5-nitrobenzimidazole, 5,6-dichlorobenzimidazole, etc.).

Also, X may be a group which first becomes a compound having a development inhibiting effect when released from Time of the general formula (VI) and then undergoes a certain chemical reaction with a developer component to be converted to a compound substantially incapable of inhibiting development or having a considerably reduced effect upon development inhibition. Examples of a functional group undergoing such a chemical reaction as described above include an ester group, a carbonyl group, an imino group, an ammonium group, a Mickel's addition accepting group, and an imido group. Specific examples of a development inhibitor of such a deactivation type include 1-(3-phenoxycarbonylphenyl)-5-mercaptotetrazole, 1-(4-phenoxycarbonylphenyl) -5-mercaptotetrazole, 1-(3-maleinimidophenyl)-5-mercaptotetrazole, 5-phenoxycarbonylbenzotriazole, 5-(4-cyanophenoxycarbonyl)benzotriazole, 2-phenoxycarbonylmethylthio-5-mercapto-1,3,4-thiadiazole, 5-nitro-3-phenoxycarbonylimidazole, 5-(2,3-dichloropropyloxycarbonyl)benzotriazole, 1-(4-benzoyloxyphenyl)-5-mercaptotetrazole, 5-(2-methanesulfonylethoxycarbonyl)2-mercaptobenzothiazole, 5-cinnamoylaminobenzotriazoie, 1-(3-vinylcarbonylphenyl)-5-mercaptotetrazole, 5-succinimidomethylbenzotriazole, 2-{4-succinimidophenyl}-5-mercapto-1,3,4-oxadiazole, and 6-phenoxycarbonyl-2-mercaptobenzoxazole.

Of the compounds represented by the general formula (VI), compounds represented by the following general formulae (VII) and (VIII) are preferred over others:

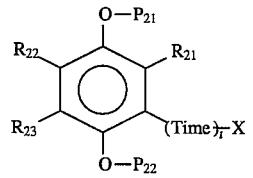

(VII)

In the above formula, $R_{21}$, $R_{22}$ and $R_{23}$ each represent a hydrogen atom, or a substituent group (substitutable to hydroquinone nucleus); $P_{21}$ and $P_{22}$ each represents a hydrogen atom or a blocking group which can be released upon development processing; and Time, X and t have the same meanings as in the general formula (VI), respectively.

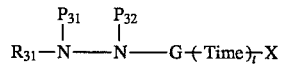

(VIII)

In the above formula, $R_{31}$ represents an aryl group, a heterocyclic group, an alkyl group, an aralkyl group, an alkenyl group, or an alkynyl group; $P_{31}$ and $P_{32}$ each represents a hydrogen atom, or a blocking group which can be released upon development processing; and G, Time, X and t have the same meanings as in the general formula (VI), respectively.

A detailed description of the general formula (VII) is given below. As for the substituents represented by $R_{21}$, $R_{22}$ and $R_{23}$, respectively, the substituents described as substituents for B in the general formula (VI) can be given as examples. $R_{22}$ and $R_{23}$ preferably are a hydrogen atom, an alkylthio group, an arylthio group, an alkoxy group, an aryloxy group, an amido group, a sulfonamido group, an alkoxycarbonylamino group or a ureido group. $R_{22}$ and $R_{23}$ are more preferably a hydrogen atom, an alkylthio group, an alkoxy group, an amido group, a sulfonamido group, an alkoxycarbonylamino group or a ureido group. Of these groups, an amido group, an alkoxycarbonylamino group and an ureido group are most preferred. These substituents are advantageous in the respect that they can heighten the activity of the compounds represented by the general formula (VII).

$R_{21}$ preferably represents a hydrogen atom, a carbamoyl group, an alkoxycarbonyl group, a sulfamoyl group, an alkyl or aryl-sulfonyl group, a cyano group, an acyl group or a heterocyclic group. $R_{21}$ more preferably represents a hydrogen atom, a carbamoyl group, an alkoxycarbonyl group, a sulfamoyl group or a cyano group. Also, $R_{22}$ and $R_{23}$ may combine with each other to complete a ring.

Examples of blocking groups represented by $P_{21}$ and $P_{22}$ include the groups described as blocking groups for the hydroxyl group contained in B of the general formula (VI).

$P_{21}$ and $P_{22}$ preferably represent hydrogen atom is preferable.

X preferably represents a mercaptoazoles or benzotriazole moiety. Suitable examples of mercaptoazoles include mercaptotetrazoles, 5-mercapto-1,3,4-thiadiazoles and 5-mercapto-1,3,4-oxadiazoles.

In particular, 5-mercapto-1,3,4-thiadiazole moiety is most suitable for X.

A detailed description of the general formula (VIII) is given below.

The aryl group represented by $R_{31}$ includes those containing 6 to 20 carbon atoms, e.g., phenyl and naphthyl groups. The heterocyclic group represented by $R_{31}$ includes 5- to 7-membered rings containing at least of one nitrogen, oxygen and sulfur atom, e.g., furyl and pyridyl groups. The alkyl group represented by $R_{31}$ includes alkyl groups containing 1 to 30 carbon atoms, e.g., methyl, hexyl and octadecyl groups. The aralkyl group represented by $R_{31}$ includes aralkyl groups containing 7 to 30 carbon atoms, e.g., benzyl and trityl groups. The alkenyl group represented by $R_{31}$ includes alkenyl groups containing 2 to 30 carbon atoms, e.g., propargyl group. Of these groups, an aryl group, especially a phenyl group, is preferred over others.

Examples of the blocking group represented by $P_{31}$ and $P_{32}$ include the groups described as a blocking group for the amino group represented by B in the general formula (VI). However, a hydrogen atom is preferred as $P_{31}$ and $P_{32}$.

It is desirable in the general formula (VIII) that G be —CO— and that X be one of the groups described as X in the general formula (VII).

$R_{21}$ or $R_{23}$ in the general formula (VII) and $R_{31}$ in the general formula (VIII) may be substituted. As for the substituent those groups may have, a so-called ballast group for providing diffusion resistance or a group capable of adsorbing to silver halide grains, especially a ballast group, is preferably used.

When $R_{31}$ is a phenyl group, an electron donating group is preferred as a substituent thereof. Suitable examples of such an electron donating group include sulfonamido, amido, alkoxy and ureido groups. When $R_{21}$, $R_{22}$, $R_{23}$ or $R_{31}$ contains a ballast group, it is particularly preferable that a polar group, such as a hydroxyl group, a carboxyl group, a sulfo group etc., should be contained in the molecule.

The total amount of the compound represented by formula (II) in the photographic material of present invention is preferably $1.0\times10^{-7}$–$1.0\times10^{-3}$ mol/m$^2$, more preferably $5.0\times10^{-7}$–$1.0\times10^{-4}$ mol/m$^2$, and most preferably $1.0\times10^{-6}$–$5.0\times10^{-5}$ mol/m$^2$.

The DIR compound represented by formula (II) may be incorporated into any photographic layer in the photographic material. The layer may be a light-sensitive emulsion layer or a light-insensitive emultion layer such as an interlayer, a protective layer or a antihalation layer. When the DIR compound is incorporated into two or more layers, the layers may be or may not be adjacent to each other.

The DIR coupler represented by formulae (III), (IV) and (V) is preferably incorporated into a light-sensitive emulsion layer,and although the DIR coupler represented by formula (VI) may be incorporated into any layer in the photographic material, it is preferably incorporated into a light-insensitive layer.

The DIR compound can be incorporated into the photographic layer in the same manner as that of couplers disclosed hereinafter.

in order to more specifically describe the import of the present invention, specific examples of the compounds represented by the general formula (VI) are illustrated below. However, compounds usable in the present invention should not be construed as being limited to these examples:

(VI-1)

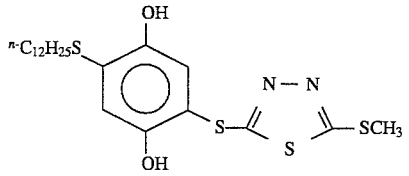

(VI-2)

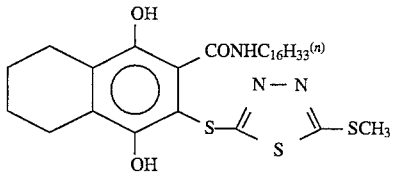

-continued
(VI-3)
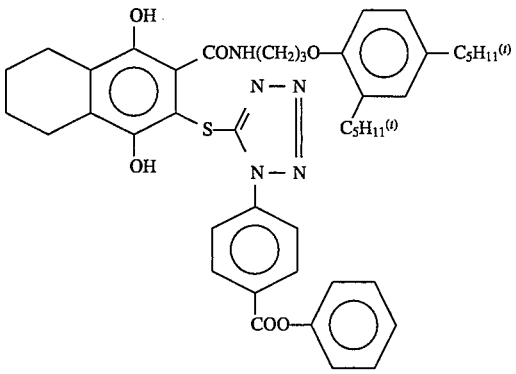
(VI-4)
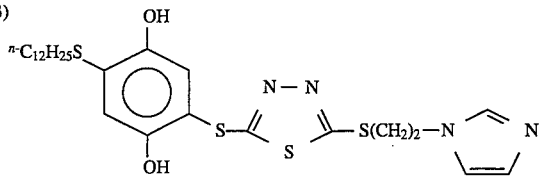
(VI-5)
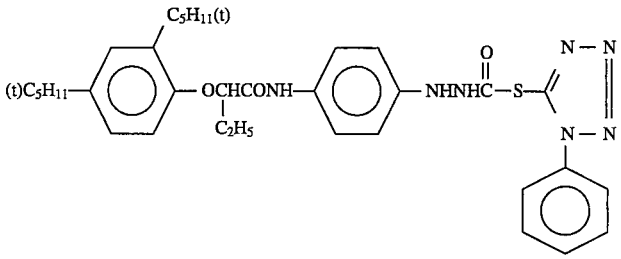
(VI-6)
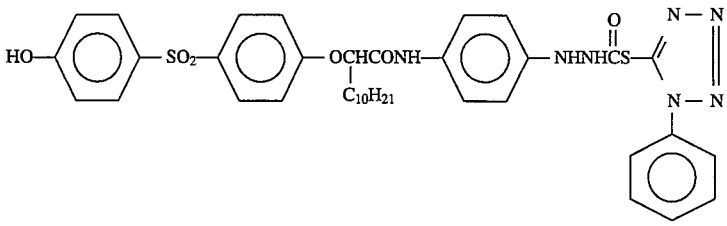
(VI-7)
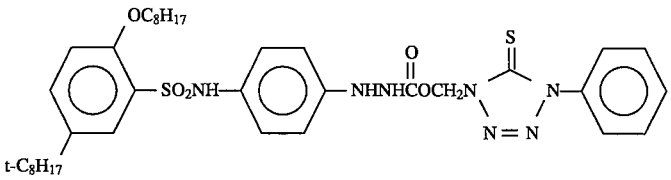
(VI-8)
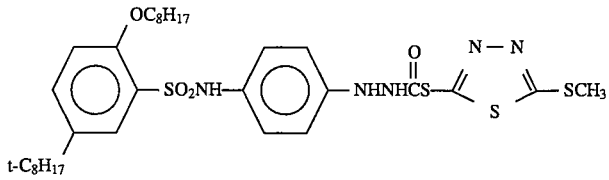
(VI-9)
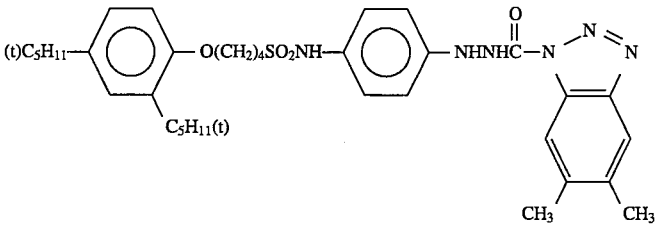

-continued
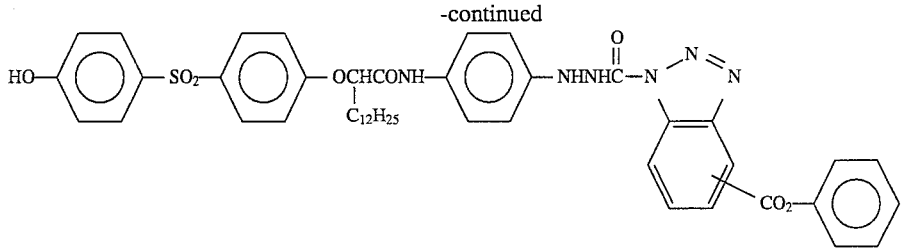
(VI-10)
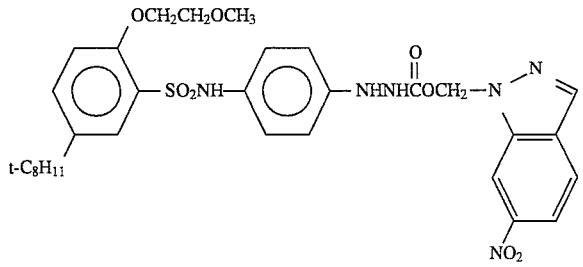
(VI-11)
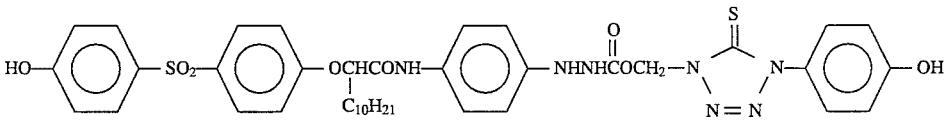
(VI-12)
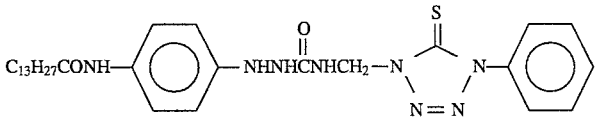
(VI-13)
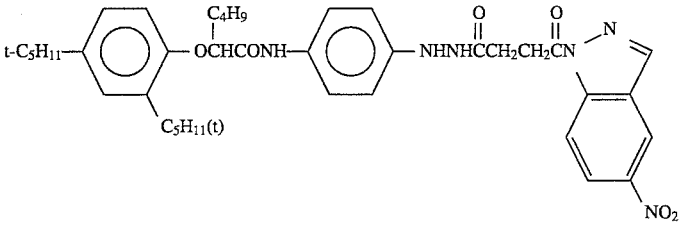
(VI-14)
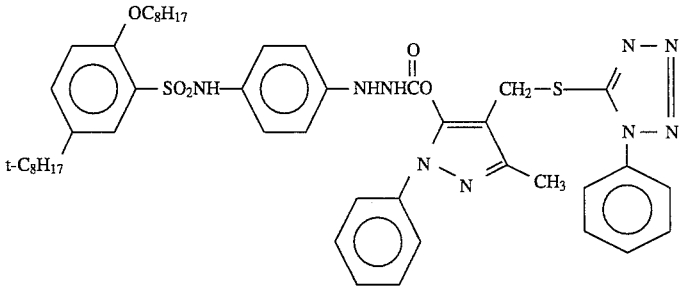
(VI-15)
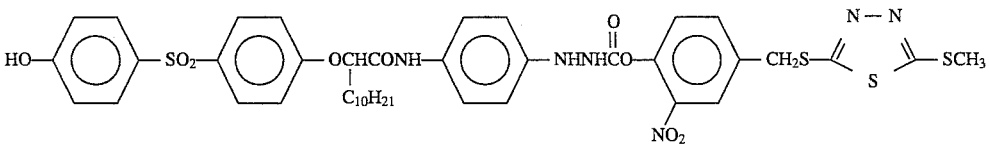
(VI-16)

-continued
(VI-17)
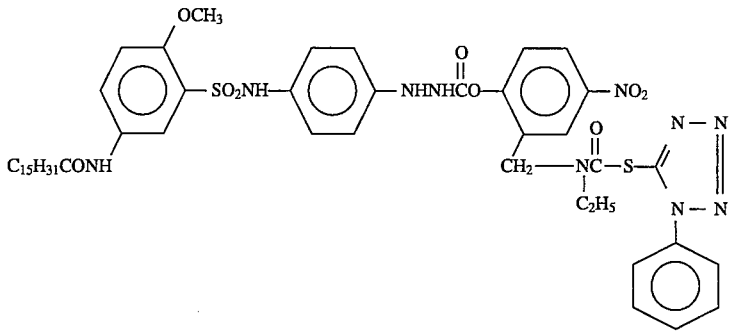
(VI-18)
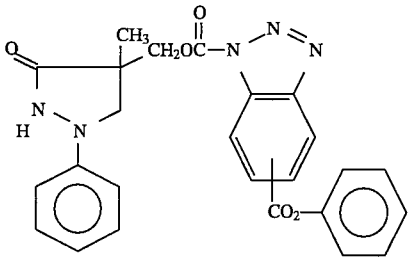
(VI-19)
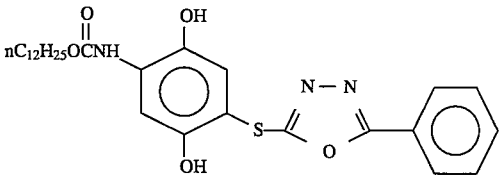
(VI-20)
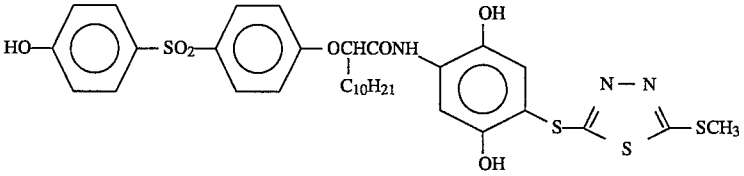
(VI-21)
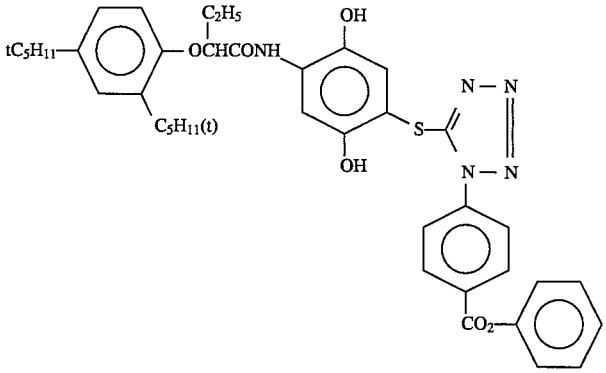
(VI-22)
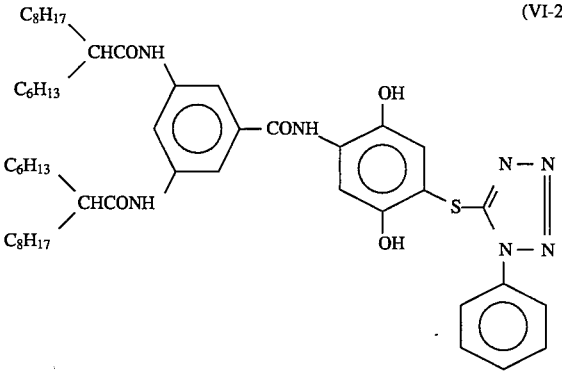
(VI-23)
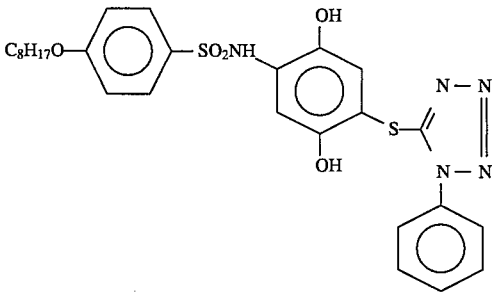

-continued (VI-24)

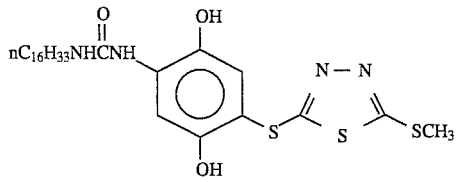

(VI-25)

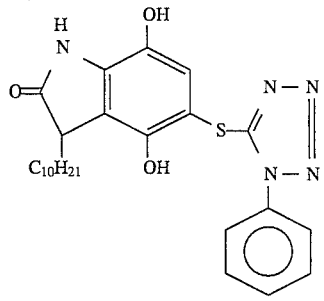

(VI-26)

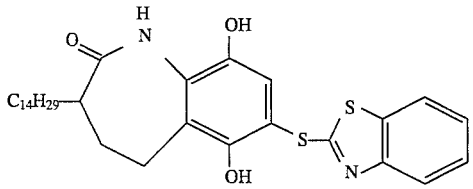

(VI-27)

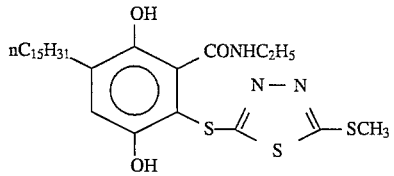

(VI-28)

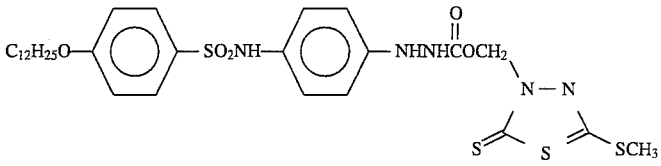

(VI-29)

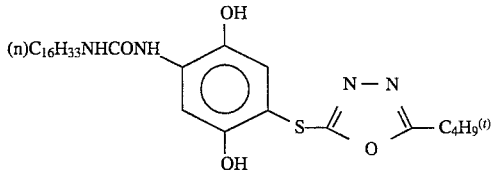

In addition, specific examples 2 and 3 of general formula (I) in JP-A-03-226744, specific examples 1, 2, 3 and 6 of general formula (I) in JP-A-03-226745, specific example 1 of general formula (I) in JP-A-03-226746 and specific examples from I-1 to I-16 and from I-18 to I-58 of general formula (I) JP-A-63-25653 can be given as other examples of the compounds represented by the general formula (VI).

The compounds represented by the general formula (VI) can be prepared according to the methods described in JP-A-49-129536 (U.S. Pat. No. 3,930,863), JP-A-52-57828 (U.S. Pat. No. 4,108,663), JP-A-60-21044 (U.S. Pat. No. 4,459,351), JP-A-60-233642 (U.S. Pat. No. 4,636,456), JP-A-60-233648, JP-A-61-18946, JP-A-61-156043 (U.S. Pat. No. 4,740,453), JP-A-61-213847, JP-A-61-230135 (U.S. Pat. Nos. 740,453 and 5,142,029), JP-A-61-236459 (U.S. Pat. No. 4,770 990), JP-A-62-62352, JP-A-62-103639 , U.S. Pat. Nos. 3,379,529, 3,620,746, 4,332,828, 4,377,634 and 4,684,604, and so on.

It is desirable that the compounds of the general formulae (III), (IV) and (V) should be used for photogtaph-taking color negative films, while the compounds of the general formula (VI) should be used for photograph-taking color reversal films.

Tabular grain silver halide emulsions for use in the present invention are described below in detail.

The term "average aspect ratio" used in describing tabular grain silver halide emulsions signifies the average value of the diameter to thickness ratio of the silver halide grains. In other words, the aspect ratio refers to the average of the values obtained with individual silver halide grains by dividing their diameter by their thickness. The term "diameter" as used herein refers to the diameter of the circle having the same area as the projected area of each grain, which can be determined by observation under a microscope or an electron microscope. Accordingly, an average aspect ratio of 2 or more means that the diameter of this circle is no less than two times the thickness of the grain.

The tabular silver halide grains used in the silver halide emulsion of the present invention have an average diameter of at least 2 times, the average thickness preferably from 3 to 20, more preferably from 4 to 15, particularly preferably from 5 to 10 times. The proportion of the tabular silver halide grains to all of the silver halide grains contained in an emulsion layer is about 50%, preferably about 70%, particularly preferably about 85%, on a projected area basis.

A silver halide photographic material prepared using the emulsion described above can provide excellent sharpness. The excellent sharpness is attributable to extreme slightness of the light scattering from the emulsion layer using the emulsion of the above-described kind, in contrast to that from conventional emulsion layers. This can be easily confirmed by experiments familiar to one skilled in the art. Though the reason for the slightness of the light scattering from the emulsion layer using the tabular grain silver halide emulsion is not yet clear, it can be assumed that the slightness results from the parallel orientation of the main faces of the tabular silver halide grains to the support surface.

The diameter of the tabular silver halide grains preferably is in the range of 0.2 to 20 μm, more preferably 0.3 to 10.0 μm, and particularly preferably 0.4 to 5.0 μm. As for their thickness, it is preferably below 0.5 μm. The term "diameter" of tabular silver halide grain refers to the diameter of the circle having the same area as the projected area of said grain, while the term "thickness" refers to the distance between two parallel faces which construct said grain.

Tabular silver halide grains which are more preferred in the present invention are those having a grain diameter of 0.3 to 10.0 μm, a grain thickness of not larger than 0.3 μm and an average aspect ratio (diameter/thickness) of from 5 to 10. It is undesirable to increase these structural factors beyond the foregoing upper limits, because photographic materials comprising such grains sometimes come to have abnormal photographic properties due to folding-up, winding-up or contact with a sharp article.

It is more advantageous to use silver halide photographic emulsions in which tabular silver halide grains having a diameter of from 0.4 to 5.0 μm and an average aspect ratio of at least 5 are contained in a proportion of at least 85% to all of the silver halide grains on a projected area basis.

The silver halide used to prepare the tabular emulsion grains used in the present invention may be either silver iodobromide or silver chloroiodobromide. The iodide content of the silver halide is preferably not more than 30 mol %, more preferably from 2 to 25 mol %, and particularly preferably 5 to 15 mol %. The halogen composition of a mixed halide may have a uniform or a localized distribution.

In case where tabular silver iodobromide grains are used, for instance, the grains may have a layer structure constructed by plural layers having different iodide content. Suitable examples of the halogen composition and the halogen distribution in the tabular silver halide grains are described, e.g., in JP-A-58-113927 (U.S. Pat. Nos. 4,433,048 and 4,434,226), JP-A-58-113928 (U.S. Pat. No. 4,434,226), JP-A-59-99433 (U.S. Pat. No. 4,665,012), JP-A-59-119344 (U.S. Pat. No. 4,459,353) and JP-A-59-119350 (U.S. Pat. No. 4,490,458).

The tabular grains can be chosen from those formed by (111) faces, (100) faces or a mixture of (111) and (100) faces.

As for the site at which latent images are formed, there can be employed any kind of grains, that is, grains of the kind which form latent images predominantly at the surface, those of the kind which form latent images mainly inside the grains, or those of the kind which form latent images both on the surface and inside the grains.

As for the size distribution among the grains, it may be narrow or broad.

Although the tabular grain silver halide emulsions which can be used in the present invention are described, e.g., in Cugnac's and Chateau's reports; Duffin, *Photographic Emulsion Chemistry, pages* 66–72, Focal press, New York (1966); and P. H. Trivelli & W. F. Smith, *Phot. Journal*, volume 80, page 285 (1940), such emulsions can be prepared with ease by reference to the methods disclosed in JP-A-58-113927 (U.S. Pat. Nos. 4,433,048 and 4,434,226), JP-A-58-113928 (U.S. Pat. No. 4,434,226) and JP-A-58-127921 (U.S. Pat. No. 4,585,729).

For instance, the grains can be obtained by forming seed crystals containing not less than 40 wt % of tabular grains in an atmosphere having a pBr of 1.3 or less and a relatively high pAg, and by simultaneously adding to this system silver and halogen solutions as the pBr of the atmosphere is maintained at a level similar to the above. In the course of the grain growth, it is desirable that silver and halogen solutions should be added so as not to cause new nucleation.

In the tabular grain silver halide emulsion, the sizes of the tabular grains can be controlled by properly setting the temperature, properly selecting the kind and the quality of solvents to be used and controlling the addition speeds of the silver salt and halides upon grain growth.

Further, the grain size, the grain shape (including the diameter/thickness ratio), the grain size distribution and the speed of grain growth can be controlled by using a silver halide solvent as needed in the course of formation of the tabular silver halide grains. It is desirable that the solvent should be used in a proportion of from $10^{-3}$ to 1.0 wt %, especially from $10^{-2}$ to $10^{-1}$ wt %, based on the reaction solutions. As the proportionate amount of the solvent used is increased, the grain size distribution can approach a monodisperse distribution and the growth speed can be accelerated, while the grain thickness shows a tendency to increase.

Known silver halide solvents can be used in the present invention. Those prevailingly used include ammonia, thioethers, thioureas, thiocyanates, thiazolinethiones and so on. For details of thioethers, U.S. Pat. Nos. 3,271,157, 3,574,628 and 3,790,387 can be referred to. For details of thioureas, JP-A-53-82408 and JP-A-55-77737 (U.S. Pat. No. 4,284,717) can be referred to. For details of thiocyanates, U.S. Pat. Nos. 2,222,264, 2,448,534 and 3,320,069 can be referred to. For details of thiazolinethiones, JP-A-53-144319 (British Patent 1,586,412) can be referred to.

In the process of forming or physically ripening the silver halide grains, cadmium salts, zinc salts, lead salts, thallium salts, iridium salts and complexes, rhodium salts and complexes, or/and iron salts and complexes may be present.

In producing the tabular silver halide grains used in the present invention, a method of increasing the addition speeds, amounts and concentrations of the silver salt solution (e.g., an aqueous solution of $AgNO_3$) and a halide solution (e.g., an aqueous solution of KBr) is preferably adopted for the purpose of promoting the grain growth. For the details of such a method, U.S. Pat. Nos. 1,335,925, 3,650,757, 3,672,900 and 4,242,445, JP-A-55-142329 (U.S. Pat. No. 4,301,241), JP-A-55-158124, and so on can be referred to.

The photographic emulsions used in the present invention can contain various compounds for the purpose of preventing of fog in the production, storage or photographic processing of the photographic materials, or for the purpose of the stabilizing the photographic characteristics thereof. For these purposes, various compounds which are known as antifoggants or stabilizers can be used, including azoles such as benzothiazolium salts, nitroimidazoles, triazoles, benzotriazoles, benzimidazoles (especially those substituted with a nitro group or a halogen atom), etc.; heterocyclic mercapto compounds such as mercaptothiazoles, mercaptobenzothiazoles, mercaptobenzimidazoles, mercaptothiadiazoles, mercaptotetrazoles (especially 1-phenyl-5-mercaptotetrazole), mercaptopyrimidines, etc.; the above-cited heterocyclic mercapto compounds containing a water-soluble group such as carboxyl, sulfo or the like; thioketo compounds such as oxazolinethione; azaindenes such as triazaindenes, tetrazaindenes (especially 4-hydroxysubstituted (1,3,3a,7)-tetrazaindenes), etc.; benzenethiosulfonic acids; benzenesulfinic acid; and so on. For further details of specific examples of such compounds and ways of using them, U.S. Pat. Nos. 3,954,474, 3,982,947 and 4,021,248, and JP-B-52-28660 can be referred to.

The above-described emulsions used in the present invention are preferably monodisperse emulsions.

The term "monodisperse emulsion" in the contest of the present invention refers to an emulsion having such a size distribution that the variation coefficient ($S/\bar{r}$) of the diameter of the silver halide grains is at most 0.25. Herein, $\bar{r}$ is an average grain diameter and S is the standard deviation of concerning the grain diameters. More specifically, when the number of the emulsion grains with a diameter $r_i$ is $n_i$, the average grain diameter $\bar{r}$ is define as:

$$\bar{r} = \frac{\Sigma n_i \times r_i}{\Sigma n_i},$$

and the standard deviation S of the distribution among grain diameters is defined as $$S = \sqrt{\frac{\Sigma(\bar{r} - r_i)^2 \times n_i}{\Sigma n_i}}$$

The term "diameter" of each emulsion grain as used in the present invention refers to the projected-area corresponding diameter which is determined from the projected areas of the grains by taking photomicrographs of silver halide emulsion grains (usually with an electron microscope) in a manner well-known in the art, as described in T. H. James, et al., *The Theory of the Photographic Processes*, 3rd. Ed., pp. 36–43, Macmillan (1966). As described in the above-cited book, the projected-area corresponding diameter used herein is defined as the diameter of a circle having the same area as the projected area of each silver halide grain. Therefore, even in the case where the silver halide grains have a form other than a sphere (e.g., the form of a cube, an octahedron, a tetradecahedron or a tabular, or a form resembling a potato), it is possible to determine the average grain diameter and the standard deviation thereof in the same way as described above.

The variation coefficient of the grain diameter of the silver halide grains is controlled to 0.25 or less, preferably 0.20 or less, and more preferably 0.15 or less.

It is preferred in particular that the tabular grain silver halide emulsions used in the present invention be monodisperse hexagonal tabular emulsions as disclosed in JP-A-63-151618 (U.S. Pat. No. 4,797,354).

The hexagonal tabular silver halide grains used herein are characterized by their (111) faces having a hexagonal form having a ratio between adjacent sides of, at most, 2. The term "ratio between adjacent sides" refers to the ratio of length of the side having the longest length to the length of the side having the shortest length among the sides of a hexagon. The hexagonal tabular silver halide grains used in the present invention may have somewhat roundish corners so long as the ratio between adjacent sides is at most 2. In the case where the corners are roundish, the length of a side is defined as the distance between the point at which the extended line of the linear portion of said side intersects with the extended line of the linear portion of the side adjacent thereto, and the other point at which the other extended line of the linear portion of said side intersects with the extended line of the linear portion of the other side adjacent thereto. It is desirable that every side of the hexagons of the hexagonal tabular grains have a substantially linear portion the length of which is at least one-half, particularly at least four-fifths, the whole length thereof. The ratio between adjacent sides is preferably in the range of 1 to 1.5 in the present invention.

The tabular grain silver halide emulsions of the present invention are, in general, chemically sensitized.

Chemical sensitization is carried out after the formation of the foregoing silver halide emulsions. However, the emulsions formed may be washed with water prior to chemical sensitization.

Chemical sensitization is described in detail in *Research Disclosure* No. 17643, page 23 (December 1978) and ibid., No. 18716, right column of page 648 (November 1979), and can be effected by using a sulfur sensitizer, a selenium sensitizer, a tellurium sensitizer, a gold sensitizer, a platinum sensitizer, a palladium sensitizer, an iridium sensitizer or a combination of two or more thereof under conditions of pAg 5 to 10, pH 5 to 8 and a temperature of 30° to 80° C.

Moreover, it is desirable that the tabular grain silver halide emulsions used in of the present invention be chemically sensitized in the presence of spectral sensitizing dyes. Methods of chemically sensitizing silver halide emulsions in the presence of spectral sensitizing dyes are disclosed, e.g., in U.S. Pat. Nos. 4,425,426 and 4,442,201, JP-A-59-9658, JP-A-61-103149 and JP-A-61-133941. Spectral sensitizing dyes which can be used may include any of those conventionally used for silver halide photographic materials, and specific examples thereof are disclosed in *Research Disclosure*, No. 17643, pages 23 and 24, and ibid., No. 18716, right column of page 648 to right column of page 649.

Spectral sensitizing dyes may be used individually or as mixtures of several thereof.

Spectral sensitizing dyes may be added at any stage of emulsion-making. More specifically, they may be added at a stage prior to the beginning of chemical sensitization (e.g., during the grain formation, at the conclusion of the grain formation, or after a washing step), in the course of chemical sensitization, or at the conclusion of chemical sensitization. However, it is advantageous to add them during a period from the conclusion of grain formation to the beginning of chemical sensitization, or at the conclusion of chemical sensitization.

With respect to the amount of spectral sensitizing dyes to be added, it may be chosen arbitrarily, but it is preferable that the amount should correspond to 30 to 100%, particularly 50 to 90%, of the saturated adsorption capacity.

The tabular grain silver halide emulsions used in the present invention are, in general, spectrally sensitized. Spectral sensitizing dyes which can be used herein, in analogy to those described above, include the dyes disclosed in the above-cited two references. To the foregoing emulsions which have undergone chemical sensitization in the presence of spectral sensitizing dyes, the same kind or different kinds of dyes may or may not be further added for the purpose of spectral sensitization.

Each of the emulsions for use in the present invention may be used in a light-sensitive emulsion layer independently or in combination with at least two other emulsions differing in average grain size or average silver iodide content. Using an emulsion mixture as described above is advantageous in terms of gradation control, graininess control over the entire exposure region from the low exposure area to the high exposure area, the control of color-development dependence (e.g., the dependence upon the development time, the dependence of the developing agent upon the developer constituents such as sodium sulfite and so on, or the dependence upon the pH of the developer), and so on.

In addition, it is especially desirable that the emulsions of the present invention be below 20% with respect to the relative standard deviation of the silver iodide contents in the grains present therein. As for the relative standard deviation of iodide contents, there are descriptions in JP-A-60-143332 and JP-A-60-254032.

The photographic materials of the present invention comprise a support having thereon at least one color sensitive layer selected from blue-sensitive, green-sensitive and red-sensitive layers and, in addition, at least one light-sensitive layer constituted of at least two silver halide emulsion layers which are substantially the same in respect of color sensitivity but different in photographic speed. Said light-sensitive layer is a unit light-sensitive layer having sensitivity to any of blue, green, red and infrared light. As for the order of arrangement of such unit light-sensitive layers in a multilayer silver halide color photographic material, it is general practice to arrange a support, a red-sensitive layer, a green-sensitive layer and a blue-sensitive layer, in this order. However, such an order as cited above may be reversed, if needed. Also, it is possible to use an order of arrangement in which any two of the constituent layers having the same color sensitivity have a light-sensitive layer differing in color sensitivity therebetween.

Moreover, light-insensitive layers including various kinds of interlayers may be provided between the foregoing silver halide light-sensitive layers, and at the topmost and the lowermost positions thereof.

Such interlayers may contain couplers and DIR compounds as disclosed in JP-A-61-43748 (U.S. Pat. No. 4,652,515), JP-A-59-113438 (U.S. Pat. No. 4,543,323), JP-A-59-113440 (U.S. Pat. No. 4,543,323), JP-A-61-20037 and JP-A-61-20038. As is conventional, they may contain conventional color stain inhibitors.

In the photographic materials of the present invention, it is desirable that each of the foregoing color sensitive layers should be a unit light-sensitive layer constituted of at least two, preferably at least three silver halide emulsion layers which substantially differ from one another in photographic speed, and a plurality of silver halide emulsion layers which constitute each of said unit light-sensitive layers should assume a two-layer structure consisting of a fast emulsion layer and a slow emulsion layer, as disclosed in West German Patent 1,121,470 or British Patent 923,045. In general, it is preferred to arrange the constituent layers of each unit light-sensitive layer so that the photographic speed decreases in the direction of the support. Also, a light-insensitive layer may be sandwiched between the silver halide emulsion layers of each unit light-sensitive layer. On the other hand, it is also possible to dispose a slow emulsion layer on the side far from the support and to dispose a fast emulsion layer on the side near to the support, as disclosed, e.g., in JP-A-57-112751, JP-A-62-200350, JP-A-62-206541 and JP-A-62-206543.

More specifically, a low-speed blue-sensitive layer (BL), a high-speed blue-sensitive layer (BH), a high-speed green-sensitive layer (GH), a low-speed green-sensitive layer (GL), a high-speed red-sensitive layer (RH) and a low-speed red-sensitive layer (RL) can be arranged in that order from the farthest side of the support. Also, the arranging order of BH/BL/GL/GH/RH/RL/Support, that of BH/BL/GH/GL/RL/RH/Support, and so on may be employed.

In addition, the arranging order of Blue-sensitive layer/GH/RH/GL/RL/Support as disclosed in JP-B-55-34932 and that of Blue-sensitive layer/GL/RL/GH/RH/Support as disclosed in JP-A-56-25738 and JP-A-62-63936 can be used.

As for the arrangement of three layers differing in photographic speed, as disclosed in JP-B-49-15495, it is possible to arrange them so that the photographic speed may be decreased stepwise in the direction of the support, that is, to dispose a silver halide emulsion layer of the highest speed as the upper layer, a silver halide emulsion layer having a speed lower than that of the upper layer as the intermediate layer, and a silver halide emulsion layer having a speed lower than that of the intermediate layer as the lowest layer. In another case wherein the unit light-sensitive layer has a three-layer structure, a medium-speed emulsion layer, a high-speed emulsion layer and a low-speed emulsion layer may be arranged in that order from the far side of the support, as disclosed in JP-A-59-202464.

In addition, an arranging order of high-speed emulsion layer/low-speed emulsion layer/medium-speed emulsion layer or an arranging order of low-speed emulsion layer/medium-speed emulsion layer/high-speed emulsion layer may be adopted. Also, in the case where a unit light-sensitive layer is constituted by four or more constituent layers, various arranging orders may be adopted similarly to the above-described cases.

For the purpose of making an improvement in color reproducibility, it is desirable that a donor layer (CL) having an interlayer effect which differs in distribution of spectral sensitivities from a main light-sensitive layer such as BL, GL, RL or so on should be arranged in the position adjacent or near to the main light-sensitive layer.

As described above, the optimal layer structure and arrangement can be chosen from various ones depending on the end-use purpose of the photographic material.

As for the grains other than the tabular grains, which can be contained in photographic emulsion layers which constitute the photographic materials used in the present invention, the silver halide thereof is preferably silver iodobromide, iodochloride or iodochlorobromide having a silver iodide content of about 30 mol % at the most. In particular, silver iodobromide or iodochlorobromide having a silver iodide content of from about 2 mol % to about 25 mol % is preferred over others.

The crystal structure of the grains may be uniform throughout, or the interior and the surface of the grains may differ in halide composition, or the grains may assume a layer structure. Further, silver halide grains in which crystal surfaces differing in halide composition are fused together through epitaxial growth, or emulsion grains in which silver halide grains are fused together with a salt other than silver halide, such as silver thiocyanate, lead oxide or the like may be used. A mixture of grains with various crystal forms may be used.

Though the emulsions may be a surface latent image type in which the latent image is formed predominantly at the surface of the grains, an internal latent image type in which the latent image is formed mainly inside the grains or the type which form the latent image at the surface of the grains as well as inside the grains, the above-described emulsions are necessarily negative-type emulsions. As for the emulsions of an internal latent image type, those of a core/shell type as disclosed in JP-A-63-264740 may be used. Methods for making such internal latent image type core/shell emulsions are disclosed in JP-A-59-133542. The thickness of the shell in these emulsion grains is preferably in the range of 3 to 40 nm, particularly 5 to 20 nm, though it depends on the photographic processing the grains are to undergo.

Silver halide emulsions which have undergone physical ripening, chemical ripening and spectral sensitization treatments are generally used in this art. Additives used in these treatments are described in *Research Disclosure* Nos. 17643, 18716 and 307105, and pages on which they are described are summarized in the table shown hereinafter.

In the photographic materials of the present invention, two or more emulsions differing in at least one among various characteristics including grain size, grain size distribution, halogen composition, grain form and sensitivity can be used in the same layer in the form of a mixture.

Silver halide grains which are fogged at the surface thereof, as disclosed in U.S. Pat. No. 4,082,553, silver halide grains which are fogged inside thereof, as disclosed in U.S. Pat. No. 4,626,498 and JP-A-59-214852, and colloidal silver can be used to advantage in light-sensitive silver halide emulsion layers and/or hydrophilic colloid layers which are substantially insensitive to light. The expression "silver halide grains which are fogged at the surface or inside thereof" refers to silver halide grains which can be developed uniformly (non-imagewise), irrespective of whether they are present in the unexposed part or exposed part of the photographic material. Methods for preparing silver halide grains which are fogged inside or at the surface thereof are disclosed in U.S. Pat. No. 4,626,498 and JP-A-59-214852.

The halogen composition in the core of core/shell emulsion grains which are fogged inside thereof may be uniform throughout, or may have a distribution of halide compositions. As for the silver halide which constitutes silver halide grains fogged inside or at the surface thereof, any of silver chloride, silver chlorobromide, silver iodobromide and silver chloroiodobromide can be used. These fogged silver halide grains are not particularly limited with respect to grain size, but preferably have an average grain size within the range of 0.01 to 0.75 μm, particularly 0.05 to 0.6 μm. Also, they do not have any particular restriction as to the grain form. Therefore, they may have a regular crystal form and may be a polydisperse system. However, it is preferable that they should be a monodisperse system. (The terminology monodisperse system as used herein refers to a system wherein at least 95%, by weight or number, of the grains have their individual sizes within the range of ±40% of the average grain size.)

In the present invention, it is desirable that light-insensitive fine grain silver halide should be used. The term light-insensitive fine grain silver halide refers to fine grains of silver halide which are insensitive to the image wise exposure for forming dye images and are not substantially developed upon development-processing. Additionally, it is preferred that such fine grains should not be fogged in advance.

The light-insensitive fine grain silver halide has a silver bromide content in the range of 0 to 100 mol %, and may contain silver chloride and/or silver iodide), if desired. Preferably, it has a silver iodide content of 0.5 to 10 mol %.

It is desirable that such light-insensitive fine grain silver halide as described above should have an average grain size (the average of the diameters of the circles having the same areas as the projected areas of the grains) of 0.01 to 0.5 μm, particularly 0.02 to 0.2 μm.

The fine grain silver halide can be prepared in the same manner as conventional light-sensitive silver halides. In this case, it is unnecessary that the surface of silver halide grains be sensitized optically and undergo spectral sensitization. However, it is desirable that known stabilizers, including compounds of triazole, azaindene, benzothiazolium or mercapto type, zinc compounds and so on, be added prior to the addition of these fine grains to a coating composition. In the layer containing such fine grains silver halide, colloidal silver can be incorporated to advantage.

The silver coverage of the photographic materials used in the present invention is preferably from 3.0 to 6.0 g/m$^2$, particularly preferably from 3.0 to 4.5 g/m$^2$. The present invention is particularly effective for photographic materials having such a high silver coverage as described above.

The effects of the present invention is particularly remarkable when a color mixing inhibitor is not used in an intermediate light-insensitive layer or used in a very small ratio of the amount of the inhibitor to the silver coverage of the light-sensitive emulsion layer. More specifically, it is preferable that the molar ratio of the inhibitor in an intermediate layer to the silver coverage of a unit of the silver halide emulsion layers having the same color sensitivity (wherein the intermediate layer is adjasent to the silver halide emulsion layer which is the farthest layer from the support) is 0 to 0.015, more preferably 0 to 0.01, and the total silver coverage of the photographic material is 3.0 to 6.0 g/m$^2$.

In addition, other known photographic additives usable in the present invention are described in the above-cited three volumes of Research Disclosure, and the pages on which such additives are described are summarized in the following table.

| Additives | RD 17643 | RD 18716 | RD 307105 |
|---|---|---|---|
| 1. Chemical Sensitizers | p. 23 | p. 648, right column | p. 866 |
| 2. Sensitivity Increasing Agents | | p. 648, right column | |
| 3. Spectral Sensitizers and Supersensitizers | pp. 23–24 | p. 648, right column, to p. 649, right column | pp. 866–868 |
| 4. Brightening Agents | p. 24 | p. 647, right column | p. 868 |
| 5. Antifoggants and Stabilizers | pp. 24–25 | p. 649, right column | pp. 868–870 |
| 6. Light Absorbents, Filter dyes and UV Absorbents | pp. 25–26 | p. 649, right column, to p. 650, left column | p. 873 |
| 7. Stain Inhibitors | p. 25, right column | p. 650, left to right column | p. 872 |
| 8. Dye Image Stabilizers | p. 25 | p. 650, left column | p. 872 |
| 9. Hardeners | p. 26 | p. 651, left column | pp. 874–875 |
| 10. Binders | p. 26 | p. 651, left column | pp. 873–874 |
| 11. Plasticizers and Lubricants | p. 27 | p. 650, right column | p. 876 |
| 12. Coating Aids and Surfactants | pp. 26–27 | p. 650, right column | pp. 875–876 |
| 13. Antistatic Agents | p. 27 | p. 650, right column | pp. 876–877 |
| 14. Matting Agents | | | pp. 878–879 |

In order to prevent photographic properties from deteriorating due to formaldehyde gas, it is desirable that a compound capable of fixing formaldehyde gas through a reaction therewith, as disclosed in U.S. Pat. Nos. 4,411,987 and 4,435,503, be incorporated in the photographic materials.

Further, the photographic materials of the present invention preferably contain mercapto compounds as disclosed in U.S. Pat. Nos. 4,740,454 and 4,788,132, JP-A-62-18539 and JP-A-01-283551.

Furthermore, the photographic materials of the present invention preferably contain compounds as disclosed in JP-A-01-106052, which can release a fogging agent, a development accelerator, a silver halide solvent or a precursor thereof, irrespective of the quantity of the developed silver which is produced by development-processing.

In addition, the photographic materials of the present invention preferably contain dyes dispersed in accordance with the method disclosed in WO(PCT) 88/04794 or Published PCT Application (in Japan)-01-502912, or dyes as disclosed in EP-A-0317308, U.S. Pat. No. 4,420,555, or JP-A-01-259358.

Various kinds of color couplers can be used in the present invention, and specific examples thereof are disclosed in the patents cited in the foregoing *Research Disclosure*, No. 17643 (Items VII-C to VII-G) and No. 307105 (Items VII-C to VII-G).

As for the yellow couplers, those disclosed, e.g., in U.S. Pat. Nos. 3,933,501, 4,022,620, 4,326,024, 4,401,752 and 4,248,961, JP-B-58-10739, British Patents 1,425,020 and 1,476,760, U.S. Pat. Nos. 3,973,968, 4,314,023 and 4,511,649, and EP-A-0249473 are preferred.

As for the magenta couplers, 5-pyrazolone compounds and pyrazoloazole compounds are preferred. In particular, those disclosed in U.S. Pat. Nos. 4,310,619 and 4,351,897, European Patent 73,636, U.S. Pat. Nos. 3,061,432 and 3,725,067, *Research Disclosure*, No. 24220 (June 1984), JP-A-60-33552, *Research Disclosure*, No. 24230 (June 1984), JP-A-60-43659, JP-A-61-72238, JP-A-60-35730, JP-A-55-118034, JP-A-60-185951, U.S. Pat. Nos. 4,500,630, 4,540,654 and 4,556,630, WO(PCT) 88/04795 can be used to advantage.

Cyan couplers which can be preferably used include those of the phenol and naphthol types, as disclosed, e.g., in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Application (OLS) 3,329,729, EP-A-0121365, EP-A-0249453, U.S. Pat. Nos. 3,446,622, 4,333,999, 4,775,616, 4,451,559, 4,427,767, 4,690,889, 4,254,212 and 4,296,199, and JP-A-61-42658. In addition, pyrazoloazole type cyan couplers disclosed in JP-A-64-553, JP-A-64-554, JP-A-64-555 and JP-A-64-556, and imidazole type cyan couplers disclosed in U.S. Pat. No. 4,818,672 can be used.

Typical examples of dye-forming couplers which assume a polymerized form are disclosed in U.S. Pat. Nos. 3,451,820, 4,080,211, 4,367,282, 4,409,320 and 4,576,910, British Patent 2,102,137, EP-A-0341188, and so on.

As for the couplers which can form dyes of moderate diffusibility, those disclosed in U.S. Pat. No. 4,366,237, British Patent 2,125,570, European Patent 96,570 and West German Patent Application (OLS) 3,234,533 may be used to advantage.

As for the colored couplers for compensating unnecessary absorptions of the formed dyes, those disclosed, e.g., in *Research Disclosure*, No. 17643 (Item VII-G) and No. 307105 (Item VII-G), U.S. Pat. No. 4,163,670, JP-B-57-39413, U.S. Pat. Nos. 4,004,929 and 4,138,258, and British Patent 1,146,368 are preferred. In addition, it is desirable to use the couplers capable of compensating unnecessary absorptions of the formed dyes by fluorescent dyes released upon a coupling reaction, which are disclosed in U.S. Pat. No. 4,774,181; and the couplers having as a splitting-off group a dye precursor moiety capable of forming a dye by a reaction with a color developing agent, which are disclosed in U.S. Pat. No. 4,777,120.

Also, couplers capable of releasing a photographically useful group in proportion to the progress of the coupling reaction can be used to advantage in the present invention.

Bleach accelerator-releasing couplers as described in *Research Disclosure*, Nos. 11449 and 24241, JP-A-61-201247 and so on are effective in reducing the time required for the processing with a processing bath having bleachability. In particular, their effects are remarkable in the case where they are added to the photographic materials utilizing the aforementioned tabular silver halide grains.

As for the couplers capable of imagewise releasing a nucleating agent or a development accelerator upon development, those disclosed in British Patents 2,097,140 and 2,131,188, JP-A-59-157638 and JP-A-59-170840 are preferred. Also, compounds of the kind which can release a fogging agent, a development accelerator, a silver halide solvent and so on by undergoing a redox reaction with an oxidized developing agent, as disclosed in JP-A-60-107029, JP-A-60-252340, JP-A-01-44940 and JP-A-01-45687 may be used.

Other compounds which can be used in the photographic materials of the present invention include competing couplers as disclosed in U.S. Pat. No. 4,130,427; polyequivalent couplers as disclosed in U.S. Pat. Nos. 4,283,472, 4,338,393 and 4,310,618; DIR redox compound-releasing couplers, DIR coupler-releasing couplers, DIR coupler-releasing redox compounds or DIR redox compound-releasing redox compounds as disclosed in JP-A-60-185950 and JP-A-62-24252; couplers capable of releasing a dye which can recover its color after elimination as disclosed in EP-A-0173302 and EP-A-0313308; ligand-releasing couplers as disclosed in U.S. Pat. No. 4,555,477; leuco dye-releasing couplers as disclosed in JP-A-63-75747; fluorescent dye-releasing couplers as disclosed in U.S. Pat. No. 4,774,181; and so Couplers used in the present invention can be introduced into the photographic materials using various known dispersion methods.

Examples of high boiling solvents which can be used in the oil-in-water dispersion method are described, e.g., in U.S. Pat. No. 2,322,027.

More specifically, high boiling organic solvents having a boiling point of 175° C. or higher under ordinary pressure which can be used in the oil-in-water dispersion method include phthalic acid esters (e.g., dibutyl phthalate, dicyclohexyl phthalate, di-2-ethylhexyl phthalate, decyl phthalate, bis(2,4-di-t-amylphenyl)phthalate, bis(2,4-di-t-amylphenyl-)isophthalate, bis(1,1-diethylpropyl)phthalate), phosphoric or phosphonic acid esters (e.g., triphenyl phosphate, tricrsyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, di-2-ethylhexylphenyl phosphonate), benzoic acid esters (e.g., 2-ethylhexylbenzoate, dodecylbenzoate, 2-ethylhexyl-p-hydroxybenzoate), amides (e.g., N,N-diethyldodecanamide, N,N-diethyllaurylamide, N-tetradecylpyrrolidone), alcohols or phenols (e.g., isostearyl alcohol, 2,4-di-tert-amylphenol), aliphatic carboxylic acid esters (e.g., bis(2-ethylhexyl)cebacate, dioctyl azelate, glycerol tributyrate, isostearyl lactate, trioctyl citrate), aniline derivatives (e.g., N,N-dibutyl-2-butoxy-5-tert-octylaniline), hydrocarbons (e.g., paraffin, dodecylbenzene, diisopropylnaphthalene) and so on. In addition, organic solvents having a boiling point of from about 30° C., preferably about 50° C., to about 160° C. can be used as auxiliary solvents, with typical examples including ethyl acetate, butyl acetate, ethyl propionate, methyl ethyl ketone, cyclohexanone, 2-ethoxyethyl acetate, dimethylformamide, and so on.

As for the latex dispersion method, dispersing processes and effects thereof, and latexes used as impregnants are described specifically in U.S. Pat. No. 4,199,363, West German Patent Application (OLS) Nos. 2,541,274 and 2,541,230, and so on.

To the color photographic materials of the present invention, it is desirable to add various kinds of antiseptics or antimolds, e.g., phenetyl alcohol, and compounds disclosed in JP-A-63-257747, JP-A-62-272248 and JP-A-01-809411, namely 1,2-benzisothiazoline-3-one, n-butyl p-hydroxybenzoate, phenol, 4-chloro-3,5-dimethylphenol 2-phenoxyethanol and 2-(4-thiazolyl)benzimidazole.

The present invention can be applied to various color photographic materials. Representative examples of such photographic materials are color negative films for amateur or motion picture use, color reversal films for slide or television use, color papers, color positive films, color reversal papers and so on. Particularly, the present invention is preferably applied to a color photographic material for photographing.

Supports which can be properly used in the present invention are described, e.g., in the above-cited references, namely *Research Disclosure*, No. 17643 (page 28), *Research Disclosure*, No. 18716 (from the right column on page 647 to the left column on page 648) and *Research Disclosure*, No. 307105 (page 897).

As for the photographic materials of the present invention, it is desirable that the total thickness of all the hydrophilic colloid layers present on the side of the emulsion layers should be 28 μm or less, more preferably 23 μm or less, most preferably 18 μm or less, and particularly preferably 16 μm or less. Moreover, it is advantageous that the film swelling speed T½ should be 30 seconds or less, preferably 20 seconds or less. The term film thickness refers to the film thickness measured after 2 days' standing under humidity adjusted to 55% RH at 25° C., and the film swelling speed T½ can be determined in certain manners known in the art. For example, the measurement can be effected by the use of a swellometer of the type described in A. Green et al., *Photgr. Sci Eng.*, Vol 19, No. 2, pp. 124–129, and T½ is defined as the time required to reach one-half the saturated film thickness which is taken as 90% of the maximum swollen film thickness attained when the film is processed with a color developer at 30° C. for 3 minutes and 15 seconds.

The film swelling speed T½ can be adjusted to a proper value by adding a hardener to gelatin as binder, or by changing the conditions of preservation after coating. Additionally, the swelling degree is preferably from 150 to 400%. The swelling degree can be calculated from the maximum swollen film thickness determined under the above-described conditions, according to the following equation:

$$\frac{\text{(maximum swollen film thickness} - \text{film thickness)}}{\text{film thickness}}.$$

For the photographic materials of the present invention, it is also desirable that hydrophilic colloid layers (called a backing layer) having a total dry thickness of from 2 to 20 μm should be provided on the side opposite to the emulsion layer side. In such a backing layer, the above-described light absorbers, filter dyes, ultraviolet absorbers, antistatic agents, hardeners, binders, plasticizers, lubricants coating aids, surfactants and so on are preferably incorporated. A suitable swelling degree of the backing layer ranges from 150 to 500%.

When photographic processing is conducted continuously using the silver halide color photographic material of the present invention and using the developing agent represented by formula (I), the variation of the desilvering time is very small.

Now, the invention will be illustrated in detail by reference to the following examples.

EXAMPLE 1

On a cellulose triacetate film support provided with a subbing layer, the layers having the compositions described below were coated in the order of description to prepare a multilayer color photographic material named Sample 101.

Composition of Constituent Layers:

The main ingredients used in each layer were grouped into the following classes:

ExC: Cyan couplers

HBS: High boiling solvents

ExS: Sensitizing dyes

H: Hardeners

UV: Ultraviolet absorbents

The number shown to the right of each ingredient refers to the coverage of said ingredient expressed in g/m$^2$. As for the silver halide, the coverage thereof is expressed in g/m$^2$ on a silver basis. As for the sensitizing dyes, on the other hand, the coverage thereof is expressed in moles per mole of silver halide contained in the same layer.

| | |
|---|---|
| **First Layer (antihalation layer)** | |
| Black colloidal silver | Ag 0.15 |
| Gelatin | 1.40 |
| ExF-1 | $2.0 \times 10^{-3}$ |
| HBS-1 | 0.20 |
| **Second Layer (interlayer)** | |
| Emulsion e | Ag 0.065 |
| 2,5-Di-t-pentadecylhydroquinone | 0.18 |
| ExC-2 | 0.020 |
| UV-1 | 0.060 |
| UV-2 | 0.080 |
| UV-3 | 0.10 |
| HBS-1 | 0.10 |
| HBS-2 | 0.020 |
| Gelatin | 1.04 |
| **Third Layer (low-speed red-sensitive emulsion layer)** | |
| Emulsion a | Ag 0.25 |
| Emulsion b | Ag 0.25 |
| ExS-1 | $6.9 \times 10^{-5}$ |
| ExS-2 | $1.8 \times 10^{-5}$ |
| ExS-3 | $3.1 \times 10^{-4}$ |
| ExC-1 | 0.17 |
| ExC-3 | 0.030 |
| ExC-4 | 0.10 |
| ExC-5 | 0.020 |
| IV-7 (DIR coupler of the invention) | 0.012 |
| Cpd-2 | 0.025 |
| HBS-1 | 0.10 |
| Gelatin | 0.87 |
| **Fourth Layer (medium-speed red-sensitive emulsion layer)** | |
| Emulsion c | Ag 0.70 |
| ExS-1 | $3.5 \times 10^{-4}$ |
| ExS-2 | $1.6 \times 10^{-5}$ |
| ExS-3 | $5.1 \times 10^{-4}$ |
| ExC-1 | 0.13 |
| ExC-2 | 0.060 |
| ExC-3 | 0.0070 |
| ExC-4 | 0.090 |
| ExC-5 | 0.025 |
| IV-7 (DIR coupler of the invention) | 0.0074 |
| Cpd-2 | 0.023 |
| HBS-1 | 0.10 |
| Gelatin | 0.75 |
| **Fifth Layer (high-speed red-sensitive emulsion layer)** | |
| Emulsion d | Ag 1.40 |
| ExS-1 | $2.4 \times 10^{-4}$ |
| ExS-2 | $1.0 \times 10^{-4}$ |
| ExS-3 | $3.4 \times 10^{-4}$ |
| ExC-1 | 0.12 |
| ExC-3 | 0.045 |
| IV-7 (DIR coupler of the invention) | 0.025 |
| Cpd-2 | 0.050 |
| HBS-1 | 0.22 |
| HBS-2 | 0.10 |
| Gelatin | 1.20 |

-continued

| | |
|---|---|
| **Sixth Layer (first protective layer)** | |
| Emulsion e | Ag 0.20 |
| UV-4 | 0.11 |
| UV-5 | 0.17 |
| HBS-1 | $5.0 \times 10^{-2}$ |
| Gelatin | 1.00 |
| **Seventh Layer (second protective layer)** | |
| H-1 | 0.40 |
| B-1 (diameter: about 1.7 μm) | $5.0 \times 10^{-2}$ |
| B-2 (diameter: about 1.7 μm) | 0.10 |
| B-3 | 0.10 |
| S-1 | 0.20 |
| Gelatin | 1.20 |

In order to improve upon the storage (keeping) quality, the processability, the stress resistance, the antimold and antibacterial property, the antistatic property and the coating facility, the following additives, W-1 to W-3, B-4 to B-6, F-1 to F-17, an iron salt, a lead salt, a gold salt, a platinum salt, an iridium salt and a rhodium salt were incorporated properly into each layer.

The main features of Emulsions a, b, c, d and e used are summarized in Table 1.

TABLE 1

| Emulsion* | Average AgI Content | Average Grain Diameter | Variation Coefficient of Grain Diameter | Average of Diameter/thickness Ratio | [Ratio among Ag Contents in Core, Intermediate and Shell parts] | and (Ratio among AgI Contents in said parts) | Structure and Form of Emulsion Grains |
|---|---|---|---|---|---|---|---|
| a | 4.2% | 0.42 μm | 30% | 1 | [1/3] | (13/1) | Double-Layer Structure and Octahedral Form |
| b | 8.8% | 0.71 μm | 16% | 1 | [3/7] | (25/2) | Double-Layer Structure and Octahedral Form |
| c | 9.2% | 0.62 μm | 28% | 1.8 | [12/59/29] | (0/11/8) | Triple-Layer Structure and Octahedral Form |
| d | 9.1% | 0.86 μm | 25% | 1.4 | [8/59/33] | (0/11/8) | Triple-Layer Structure and Octahedral Form |
| e | 1.0% | 0.07 μm | 15% | 1 | — | | Uniform Structure and Fine Granular Form |

*:AgBrI emulsion

Additionally, Emulsions a to e shown in Table 1 had underwent:

(1) reduction sensitization with thiourea dioxide and thiosulfonic acid at the time of grain formation in the same manner as described in the Examples of JP-A-02-191938, and (2) gold sensitization, sulfur sensitization and selenium sensitization in the presence of sodium thiocyanate and the spectral sensitizing dyes incorporated in the light-sensitive layers to which they were applied, respectively, in the same manner as described in the Examples of JP-A-03-237450.

As for the emulsion grains having a grain-structure and a regular crystal form, transition lines as disclosed in JP-A-03-237450 were observed with a high tension electron microscope.

ExC-1
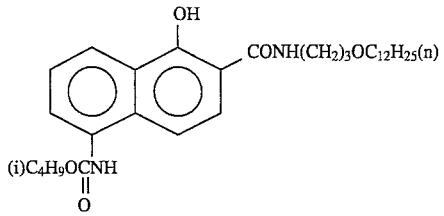
ExC-2
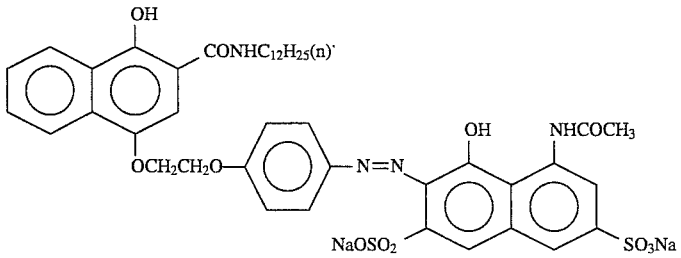
ExC-3
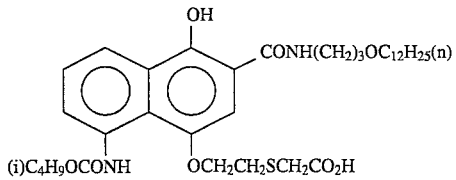
ExC-4
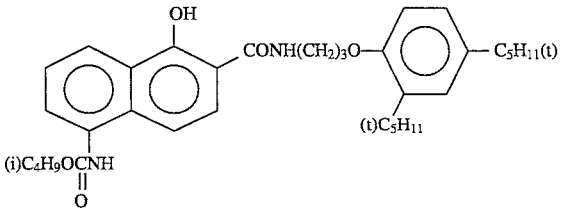
ExC-5
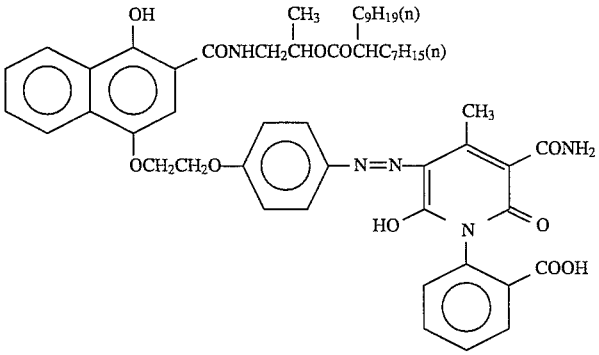
ExF-1
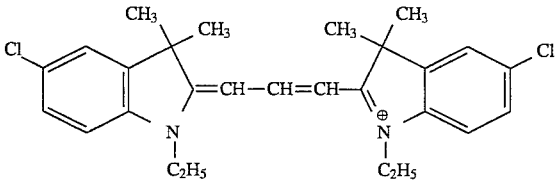
Cpd-2
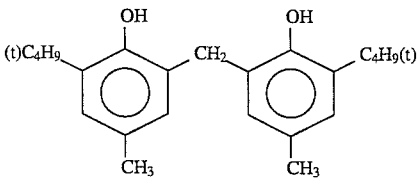
UV-1
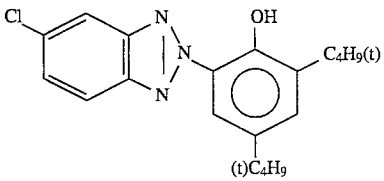

-continued
UV-2
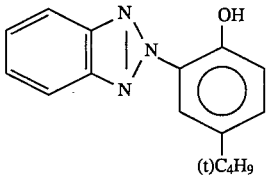
UV-3
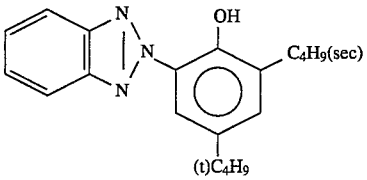
UV-4
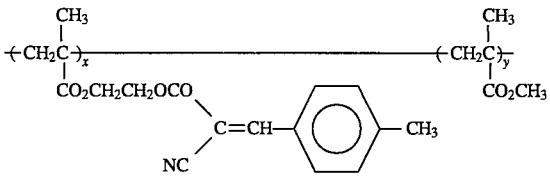
x:y = 70:30 (by wt%;
the same hereinafter
UV-5
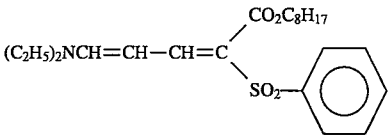
Tricresyl Phosphate
HBS-1
ExS-1
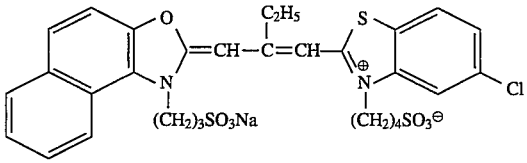
Di-n-butyl phthalate
HBS-2
ExS-2
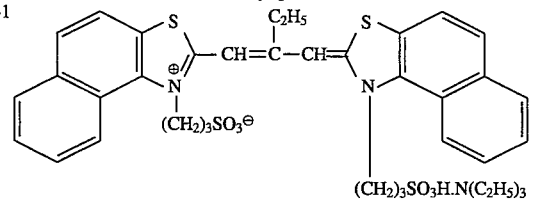
ExS-3
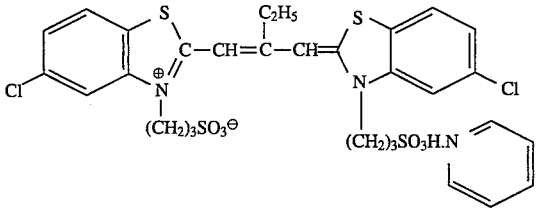
S-1
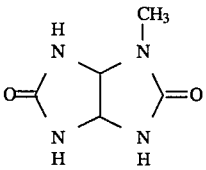
H-1
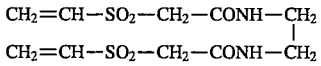
B-1
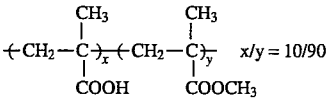
x/y = 10/90
B-2
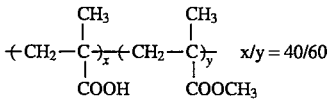
x/y = 40/60
B-3
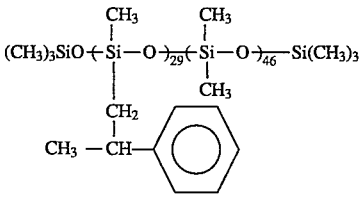
B-4
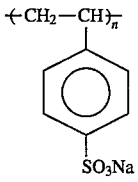
B-5
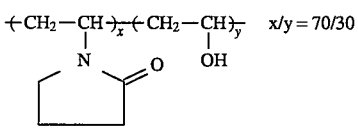
x/y = 70/30
B-6
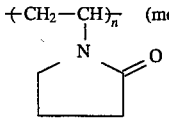
(mol. wt. about 10,000)

-continued
$C_8F_{17}SO_2NHCH_2CH_2CH_2OCH_2CH_2\overset{\oplus}{N}(CH_3)_3$
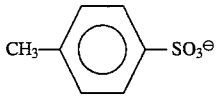
W-1
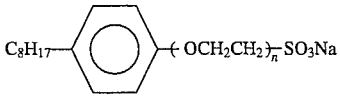
n = 2~4 (a mixture of n = 2 to 4)
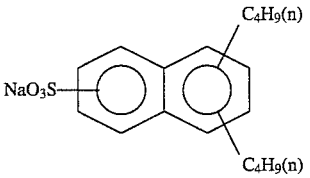
W-3
(a mixture)
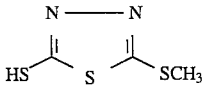
F-1
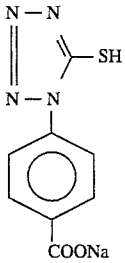
F-2
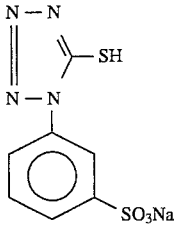
F-3
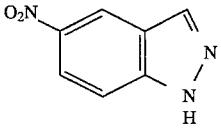
F-4
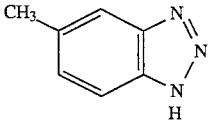
F-5
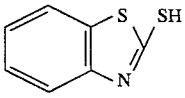
F-6
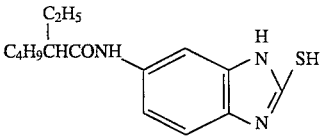
F-7
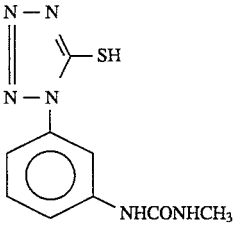
F-8
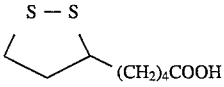
F-9
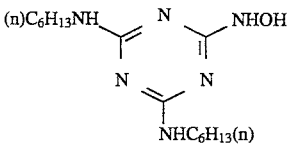
F-10
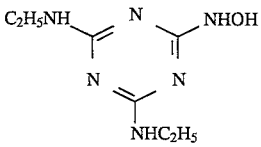
F-11
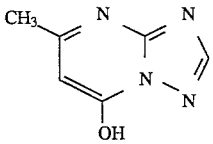
F-12
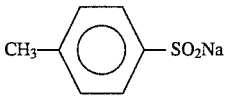
F-13

-continued

F-14

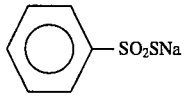

F-15

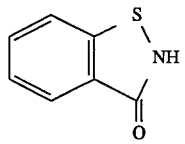

F-16

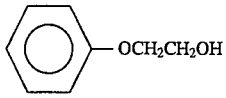

F-17

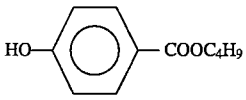

Samples 102 to 108 were prepared in the same manner as Sample 101, except that the DIR coupler IV-7 incorporated in the third, fourth and fifth layers was replaced by equimolecular amounts of DIR couplers of the present invention set forth in Table 2, respectively. These samples each were subjected to imagewise exposure to red light, and then to the photographic processing described below.

The sharpness of each of the thus processed samples was evaluated according to the conventional MTF method. The MTF value of the cyan image at 20 cycles/mm was determined. The determination of MTF values was carried out in accordance with the method described in *The Theory of Photographic Process*, 4th. ed. pp. 529–618 (published by Macmillan).

Processing Conditions:

| Processing Step | Processing Time | Processing Temperature |
|---|---|---|
| Color development | 3 min. 15 sec. | 38° C. |
| Bleaching | 3 min. 00 sec. | 38° C. |
| Washing | 30 sec. | 24° C. |
| Fixation | 3 min. 00 sec. | 38° C. |
| Washing with water (1) | 30 sec. | 24° C. |
| Washing with water (2) | 30 sec. | 24° C. |
| Stabilization | 30 sec. | 38° C. |
| Drying | 4 min. 20 sec. | 55° C. |

The composition of each processing bath used is described below.

Color Developer:

| | |
|---|---|
| Diethylenetriaminepentaacetic acid | 1.0 g |
| 1-Hydroxyethylidene-1,1-diphosphonic acid | 3.0 g |
| Sodium sulfite | 4.0 g |
| Potassium carbonate | 30.0 g |
| Potassium bromide | 1.4 g |
| Potassium iodide | 1.5 mg |
| Hydroxylamine sulfate | 2.4 g |
| 4-[N-ethyl-N-β-hydroxyethylamino]-2-methylaniline sulfate (D-5) | 4.5 g |
| Water to make | 1.0 l |
| pH | 10.05 |

Bleaching Bath:

| | |
|---|---|
| Ammonium ethylenediaminetetraacetato-ferrate(III) trihydrate | 100.0 g |
| Disodium ethylenediaminetetraacetate | 10.0 g |
| 3-Mercapto-1,2,4-triazole | 0.08 g |
| Ammonium bromide | 140.0 g |

-continued

| | |
|---|---|
| Ammonium nitrate | 30.0 g |
| Aqueous ammonia (27%) | 6.5 ml |
| Water to make | 1.0 l |
| pH | 6.0 |

Fixing Solution:

| | |
|---|---|
| Disodium ethylenediaminetetraacetate | 0.5 g |
| Ammonium sulfite | 20.0 g |
| Aqueous solution of ammonium thio-sulfate (700 g/l) | 290.0 ml |
| Water to make | 1.0 l |
| pH | 6.7 |

Stabilizing Solution:

| | |
|---|---|
| Sodium p-toluenesulfinate | 0.03 g |
| Polyoxyethylene-p-monononylphenylether (average polymerization degree: 10) | 0.2 g |
| Disodium ethylenediaminetetraacetate | 0.05 g |
| 1,2,4-Triazole | 1.3 g |
| 1,4-Bis(1,2,4-triazole-l-ylmethyl)-piperazine | 0.75 g |
| Water to make | 1.0 l |
| pH | 8.5 |

Further, the photographic processing as described above was performed using other color developers prepared similarly to the foregoing color developer, except that equimolecular amounts of the developing agents of the present invention as set forth in Table 2 were used respectively in place of 4-[N-ethyl-N-β-hydroxyethylamino]-2-methylaniline (D-5) in the foregoing color developer. MTF of the thus processed samples were determined and are shown in Table 2.

TABLE 2

| Sample No. | DIR Coupler | Developing Agent | | | | | | | | |
|---|---|---|---|---|---|---|---|---|---|---|
| | | D-5 | I-2 | I-5 | I-7 | I-11 | I-12 | I-15 | I-20 | I-33 |
| 101 | IV-7 | 0.90 | 0.98* | 0.99* | 0.98* | 1.00* | 1.04* | 1.00* | 0.97* | 1.01* |
| 102 | — | 0.72 | 0.74 | 0.75 | 0.74 | 0.74 | 0.75 | 0.75 | 0.73 | 0.74 |
| 103 | III-1 | 0.90 | 0.99* | 0.99* | 0.97* | 0.99* | 1.03* | 1.01* | 0.96* | 1.00* |
| 104 | III-6 | 0.87 | 0.95* | 0.97* | 0.95* | 0.98* | 1.01* | 0.99* | 0.95* | 0.98* |
| 105 | III-8 | 0.91 | 1.00* | 1.00* | 1.00* | 1.00* | 1.04* | 1.02* | 0.98* | 1.00* |
| 106 | III-12 | 0.89 | 0.98* | 0.97* | 0.97* | 0.98* | 1.03* | 1.00* | 0.96* | 0.99* |
| 107 | IV-2 | 0.90 | 0.98* | 0.97* | 0.98* | 1.00* | 1.03* | 1.02* | 0.96* | 0.99* |
| 108 | V-2 | 0.91 | 1.00* | 0.99* | 1.00* | 1.01* | 1.05* | 1.03* | 0.98* | 1.00* |

*:This invention

As can be seen from Table 2, only a slight improvement upon sharpness was produced in Sample 102, in which no DIR coupler of the present invention was contained, even when any one of the present color developing agents was used in place of the conventional color developing agent D-5 in the color developer.

On the other hand, an improvement in sharpness was brought about when each sample in which any one of the DIR couplers of the present invention was incorporated was processed with a color developer containing any one of the present color developing agents of the present invention. These improvements were greater than the improvement brought about when each sample was processed with the color developer containing the conventional color developing agent D-5. That is, sharpness was improved much more than expected by subjecting a color photographic material containing a DIR coupler specified by the present invention to color development with a developing agent specified by the present invention.

EXAMPLE 2

Core/shell type tabular grain silver iodobromide emulsions 1 to 5 were prepared as follows.

While a water solution prepared by dissolving 30 g of inert gelatin and 6 g of potassium bromide in 1 l of distilled water was being stirred at 75° C., 35 ml of a water solution containing 5.0 g of silver nitrate and 35 ml of a water solution containing 3.2 g of potassium bromide and 0.98 g of potassium iodide were added thereto over a 30-second period at a flow rate of 70 ml/min. Then, the pAg of the reaction mixture was raised to 10, and the resulting mixture was ripened for 30 minutes to prepare a seed emulsion.

To the seed emulsion, a prescribed portion of 1 l of an aqueous solution containing 145 g of silver nitrate and the equimolar amount of an aqueous solution containing a mixture of potassium bromide and potassium iodide were added at an addition speed close to the critical growth speed under a prescribed temperature and a prescribed pAg value to prepare an intended tabular grain core emulsion. Successively thereto, the residual aqueous solution of silver nitrate and an aqueous solution of a potassium bromide-potassium iodide mixture having a composition different from that of the mixture used upon preparation of the core emulsion were added to the core emulsion in equimolar amounts at an addition speed close to the critical growth speed, resulting in covering the core to prepare an intended core/shell type tabular grain silver iodobromide emulsion.

The aspect ratio of the emulsion grains was controlled by properly choosing the pAg values at the stages of forming the core and the shell respectively.

The main features of the thus prepared tabular grain emulsions are summarized in Table 3.

TABLE 3

| Emulsion Name | Average Aspect Ratio[1)] | Average Grain Diameter | Average Grain Thickness | Average Iodide Content |
|---|---|---|---|---|
| 1 | 2.1/1 | 1.03 μm | 0.47 μm | 9.1 mol % |
| 2 | 3.6/1 | 1.23 μm | 0.33 μm | 9.1 mol % |
| 3 | 5.1/1 | 1.34 μm | 0.26 μm | 9.1 mol % |
| 4 | 8.2/1 | 1.61 μm | 0.20 μm | 9.1 mol % |
| 5 | 10.5/1 | 1.76 μm | 0.15 μm | 9.1 mol % |

[1)]:1,000 emulsion grains were examined for their respective aspect ratios, and a number of grains corresponding to 50% of the total projected area of the chosen grains were selected in decreasing order of aspect ratio, and the average of the individual aspect ratios of the selected grains was calculated.

Preparation of Samples 201 to 205:

Samples 201 to 205 were prepared in the same manner as Sample 102 prepared in Example 1, except that only the emulsion d incorporated in the fifth layer was replaced by the emulsions 1 to 5 shown in Table 3 respectively.

These samples each were subjected to imagewise exposure to red light, and then to photographic processing in the same ways as in Example 1. The color developing agents used therein are shown in Table 4.

For evaluation of sharpness of each of the thus processed samples, MTF values of the cyan images formed therein at 40 cycles/mm were determined using the same method as in Example 1. The results obtained are shown in Table 4.

TABLE 4

| Sample No. | Emulsion in 5th Layer | Average Aspect Ratio | Color Developing Agent | | | | | | |
|---|---|---|---|---|---|---|---|---|---|
| | | | D-5 | I-2 | I-12 | I-13 | I-15 | I-20 | I-26 |
| 102 | d | 1.4 | 0.33 | 0.35 | 0.35 | 0.36 | 0.35 | 0.34 | 0.35 |
| 201 | 1 | 2.1 | 0.34 | 0.40* | 0.50* | 0.42* | 0.41* | 0.39* | 0.39* |
| 202 | 2 | 3.6 | 0.36 | 0.43* | 0.53* | 0.44* | 0.45* | 0.42* | 0.43* |

TABLE 4-continued

| Sample No. | Emulsion in 5th Layer | Average Aspect Ratio | Color Developing Agent D-5 | I-2 | I-12 | I-13 | I-15 | I-20 | I-26 |
|---|---|---|---|---|---|---|---|---|---|
| 203 | 3 | 5.1 | 0.40 | 0.47* | 0.57* | 0.49* | 0.50* | 0.46* | 0.46* |
| 204 | 4 | 8.2 | 0.42 | 0.51* | 0.59* | 0.53* | 0.54* | 0.50* | 0.49* |
| 205 | 5 | 10.5 | 0.40 | 0.47* | 0.56* | 0.50* | 0.49* | 0.45* | 0.46* |

*:This invention

As can be seen from Table 4, only slight improvement upon sharpness was produced in Sample 102, in which the octahedral grain emulsion having an average aspect ratio less than 2 was used, even when using any one of the color developing agents of the present invention in place of the conventional color developing agent D-5 in the color developer. On the other hand, a great improvement on sharpness was brought about in every sample using a tabular grain emulsion having an average aspect ratio greater than 2 by processing said sample with a color developer containing any one of the present color developing agents of the present invention in place of the conventional color developing agent D-5.

EXAMPLE 3

Sample 301 was prepared in the same manner as Sample 203 prepared in Example 2, except that a DIR coupler of the present invention IV-7 was added to the third, fourth and fifth layers respectively in an amount corresponding to 0.012 g/m$^2$. In carrying out photographic processing in the same way as in Example 1, color developing agents of the present invention, I-2, I-5, I-7, I-11, I-12, I-15, I-20 and I-30, were each used in color development. All the images formed through the color development using the color developing agents of the present invention respectively were superior in sharpness to those formed in Sample 203.

Further, Samples 302 to 307 were prepared in the same manner as Sample 301, except that IV-7 in the third, fourth and fifth layers was replaced by equimolar amounts of color developing agents of the present invention, III-1, III-6, III-8, III-12, IV-2 and V-2, respectively. In subjecting these samples to photographic processing in the same way as in Example 1, color developing agents of the present invention, I-2, I-5, I-7, I-11, I-12, I-15, I-20 and I-30, were each used in color development. All the images formed through the color development using the color developing agents of the present invention respectively were superior in sharpness to those formed in Sample 203.

EXAMPLE 4

On a cellulose triacetate film support provided with a subbing layer, the layers having the compositions described below were coated to prepare a multilayer color photographic material named Sample 401.

Composition of Constituent Layers:

The main ingredients used in each layer were grouped into the following classes;

ExC: Cyan couplers

UV: Ultraviolet absorbents

ExM: Magenta couplers

HBS: High boiling solvents

ExY: Yellow couplers

H: Gelatin hardeners

ExS: Sensitizing dyes

The number shown to the right of each ingredient refers to the coverage of said ingredient expressed in g/m$^2$. As for the silver halide, the coverage thereof is expressed in g/m$^2$ on a silver basis. As for the sensitizing dyes, on the other hand, the coverage thereof is expressed in moles Der mole of silver halide contained in the same layer.

| | |
|---|---|
| **First Layer (antihalation layer)** | |
| Black colloidal silver | Ag 0.18 |
| Gelatin | 1.40 |
| ExM-1 | 0.18 |
| ExF-1 | $2.0 \times 10^{-3}$ |
| **Second Layer (interlayer)** | |
| Emulsion G | Ag 0.065 |
| 2,5-Di-t-pentadecylhydroquinone | 0.18 |
| ExC-2 | 0.020 |
| UV-1 | 0.060 |
| UV-2 | 0.080 |
| UV-3 | 0.10 |
| HBS-1 | 0.10 |
| HBS-2 | 0.020 |
| Gelatin | 1.04 |
| **Third Layer (low-speed red-sensitive emulsion layer)** | |
| Emulsion A | Ag 0.25 |
| Emulsion B | Ag 0.25 |
| ExS-1 | $6.9 \times 10^{-5}$ |
| ExS-2 | $1.8 \times 10^{-5}$ |
| ExS-3 | $3.1 \times 10^{-4}$ |
| ExC-1 | 0.17 |
| ExC-4 | 0.17 |
| ExC-7 | 0.020 |
| UV-1 | 0.070 |
| UV-2 | 0.050 |
| UV-3 | 0.070 |
| HBS-1 | 0.060 |
| Gelatin | 0.87 |
| **Fourth Layer (medium-speed red-sensitive emulsion layer)** | |
| Emulsion D | Ag 0.80 |
| ExS-1 | $3.5 \times 10^{-4}$ |
| ExS-2 | $1.6 \times 10^{-5}$ |
| ExS-3 | $5.1 \times 10^{-4}$ |
| ExC-1 | 0.20 |
| ExC-2 | 0.050 |
| ExC-4 | 0.20 |
| ExC-5 | 0.050 |
| ExC-7 | 0.015 |
| UV-1 | 0.070 |
| UV-2 | 0.053 |
| UV-3 | 0.070 |
| Gelatin | 1.30 |
| **Fifth Layer (high-speed red-sensitive emulsion layer)** | |
| Emulsion E | Ag 1.40 |
| ExS-1 | $2.4 \times 10^{-4}$ |
| ExS-2 | $1.0 \times 10^{-4}$ |
| ExS-3 | $3.4 \times 10^{-4}$ |
| ExC-1 | 0.097 |

-continued

| | | |
|---|---|---|
| ExC-2 | | 0.010 |
| ExC-3 | | 0.065 |
| ExC-6 | | 0.020 |
| HBS-1 | | 0.22 |
| HBS-2 | | 0.10 |
| Gelatin | | 1.63 |
| Sixth layer (interlayer) | | |
| Cpd-1 | | 0.030 |
| HBS-1 | | 0.20 |
| Gelatin | | 0.80 |
| Seventh Layer (low-speed green-sensitive emulsion layer) | | |
| Emulsion C | Ag | 0.30 |
| ExS-4 | | $2.6 \times 10^{-5}$ |
| ExS-5 | | $1.8 \times 10^{-4}$ |
| ExS-6 | | $6.9 \times 10^{-4}$ |
| ExM-1 | | 0.021 |
| ExM-2 | | 0.26 |
| ExM-3 | | 0.030 |
| EXY-1 | | 0.025 |
| HBS-1 | | 0.10 |
| HBS-3 | | 0.010 |
| Gelatin | | 0.63 |
| Eighth Layer (medium-speed green-sensitive emulsion layer) | | |
| Emulsion D | Ag | 0.55 |
| ExS-4 | | $2.2 \times 10^{-5}$ |
| ExS-5 | | $1.5 \times 10^{-4}$ |
| ExS-6 | | $5.8 \times 10^{-4}$ |
| ExM-2 | | 0.094 |
| ExM-3 | | 0.026 |
| ExY-1 | | 0.018 |
| HBS-1 | | 0.16 |
| HBS-3 | | $8.0 \times 10^{-3}$ |
| Gelatin | | 0.50 |
| Ninth Layer (high-speed green-sensitive emulsion layer) | | |
| Emulsion E | Ag | 1.55 |
| ExS-4 | | $4.0 \times 10^{-5}$ |
| ExS-5 | | $1.0 \times 10^{-4}$ |
| ExS-6 | | $3.9 \times 10^{-4}$ |
| ExC-1 | | 0.015 |
| ExM-1 | | 0.013 |
| ExM-4 | | 0.065 |
| ExM-5 | | 0.019 |
| HBS-1 | | 0.25 |
| HBS-2 | | 0.10 |
| Gelatin | | 1.54 |
| Tenth layer (yellow filter layer) | | |
| Yellow colloidal silver | Ag | 0.030 |
| Cpd-1 | | 0.070 |
| HBS-1 | | 0.030 |
| Gelatin | | 0.95 |
| Eleventh layer (low-speed blue-sensitive emulsion layer) | | |
| Emulsion C | Ag | 0.18 |
| ExS-7 | | $8.6 \times 10^{-4}$ |
| ExY-1 | | 0.042 |
| ExY-2 | | 0.72 |
| HBS-1 | | 0.28 |
| Gelatin | | 1.10 |

-continued

| | | |
|---|---|---|
| Twelfth layer (medium-speed blue-sensitive emulsion layer) | | |
| Emulsion D | Ag | 0.40 |
| ExS-7 | | $7.4 \times 10^{-4}$ |
| ExC-7 | | $7.0 \times 10^{-3}$ |
| ExY-2 | | 0.15 |
| HBS-1 | | 0.050 |
| Gelatin | | 0.78 |
| Thirteenth layer (high-speed blue-sensitive emulsion layer) | | |
| Emulsion F | Ag | 0.70 |
| ExS-7 | | $2.8 \times 10^{-4}$ |
| ExY-2 | | 0.20 |
| HBS-1 | | 0.070 |
| Gelatin | | 0.69 |
| Fourteenth layer (first protective layer) | | |
| Emulsion G | Ag | 0.20 |
| UV-4 | | 0.11 |
| UV-5 | | 0.17 |
| HBS-1 | | $5.0 \times 10^{-2}$ |
| Gelatin | | 1.00 |
| Fifteenth Layer (second protective layer) | | |
| H-1 | | 0.40 |
| B-1 (diameter: about 1.7 μm) | | $5.0 \times 10^{-2}$ |
| B-2 (diameter: about 1.7 μm) | | 0.10 |
| B-3 | | 0.10 |
| S-1 | | 0.20 |
| Gelatin | | 1.20 |

In order to improve upon the storage (keeping) quality, the processability, the stress resistance, the antimold and antibacterial property, the antistatic property and the coating facility, the following additives, W-1 to W-3, B-4 to B-6, F-1 to F-17, an iron salt, a lead salt, a gold salt, a platinum salt, an iridium salt and a rhodium salt were incorporated properly into each layer.

The main features of Emulsions A, B, C, D, E, F and G used are summarized in Table 5.

TABLE 5

| Emulsion* | Average AgI Content | Average Grain Diameter | Variation Coefficient of Grain Diameter | Average Diameter/ thickness Ratio | [Ratio among Ag Contents in Core, Intermediate and Shell parts] and (Ratio among AgI Contents in said parts) | | Structure and Form of Emulsion Grains |
|---|---|---|---|---|---|---|---|
| A | 4.0% | 0.45 μm | 27% | 1 | [1/3] | (13/1) | Double-Layer Structure and Octahedral Form |

TABLE 5-continued

| Emulsion* | Average AgI Content | Average Grain Diameter | Variation Coefficient of Grain Diameter | Average Diameter/ thickness Ratio | [Ratio among Ag Contents in Core, Intermediate and Shell parts] | and (Ratio among AgI Contents in said parts) | Structure and Form of Emulsion Grains |
|---|---|---|---|---|---|---|---|
| B | 8.9% | 0.70 μm | 14% | 1 | [3/7] | (25/2) | Double-Layer Structure and Octahedral Form |
| C | 2.0% | 0.55 μm | 25% | 7 | — | | Uniform Structure and Tabular Form |
| D | 9.0% | 0.65 μm | 25% | 6 | [12/59/29] | (0/11/8) | Triple-Layer Structure and Octahedral Form |
| E | 9.0% | 0.85 μm | 23% | 5 | [8/59/33] | (0/11/8) | Triple-Layer Structure and Octahedral Form |
| F | 14.5% | 1.25 μm | 25% | 3 | [37/63] | (34/3) | Double-Layer Structure and Board-like Form |
| G | 1.0% | 0.07 μm | 15% | 1 | — | | Uniform Structure and Fine Granular Form |

*:AgBrI emulsion

Additionally, emulsions shown in Table 5 had underwent the followings:

(1) Emulsions A to F were subjected to reduction sensitization with thiourea dioxide and thiosulfonic acid at the time of grain formation in the same manner as described in the Examples of JP-A-02-191938, and (2) Emulsions A to F were subjected to gold sensitization, sulfur sensitization and selenium sensitization in the presence of sodium thiocyanate and the spectral sensitizing dyes incorporated in the light-sensitive layers, in the same manner as described in the Examples of JP-A-03-237450.

(3) Low molecular weight gelatin was used according on the Example in JP-A-1-158426 in preparing the tabular grains.

(4) Transition lines as disclosed in JP-A-03-237450 were observed under a high tension electron microscope in the tabular grains and the emulsion grains having a grain-structure and a regular crystal form.

ExC-1
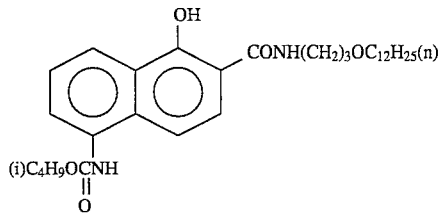
ExC-2
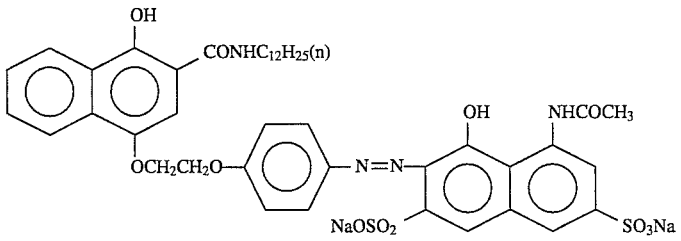
ExC-3
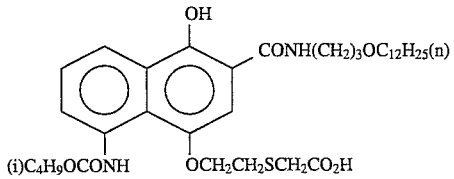
ExC-4
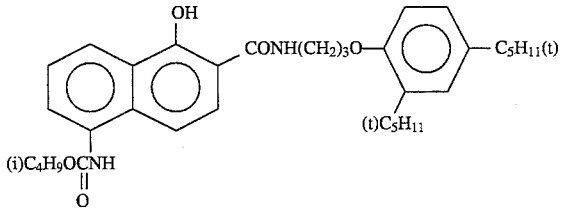
ExC-5
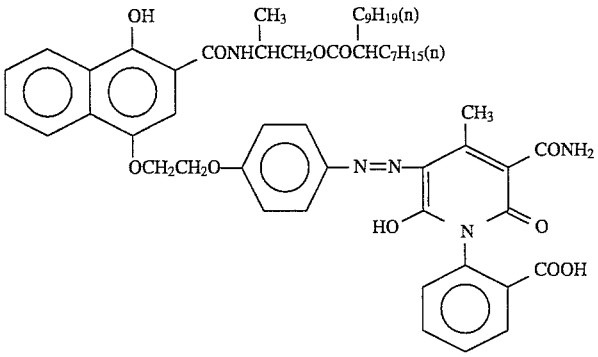
ExC-6
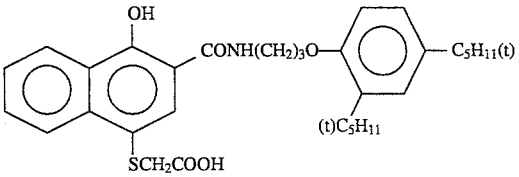

-continued
ExC-7
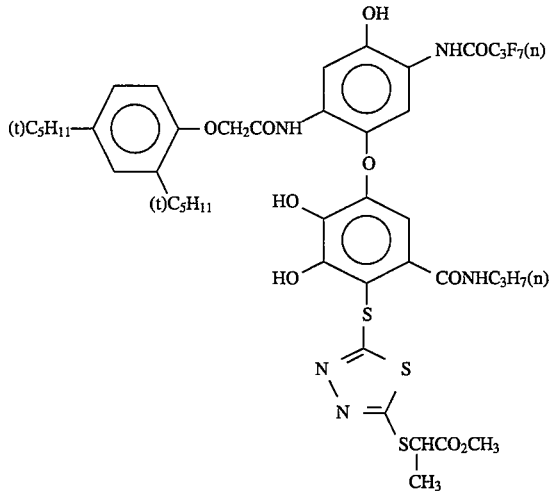
ExM-1
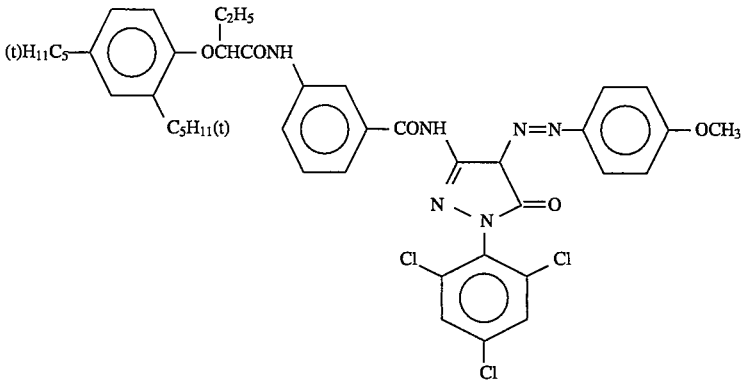
ExM-2
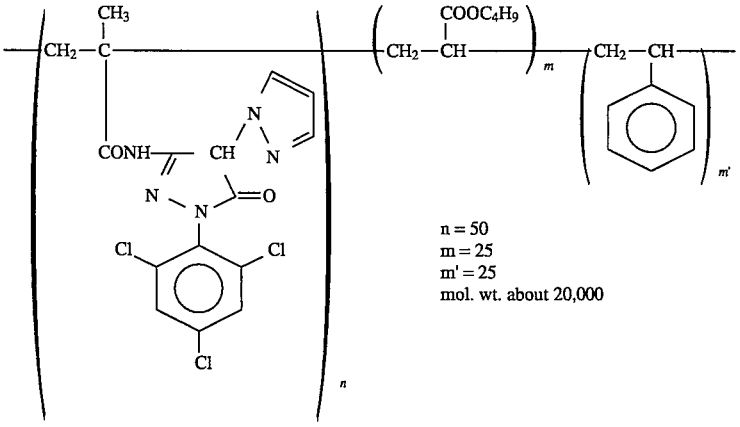

-continued
ExM-3
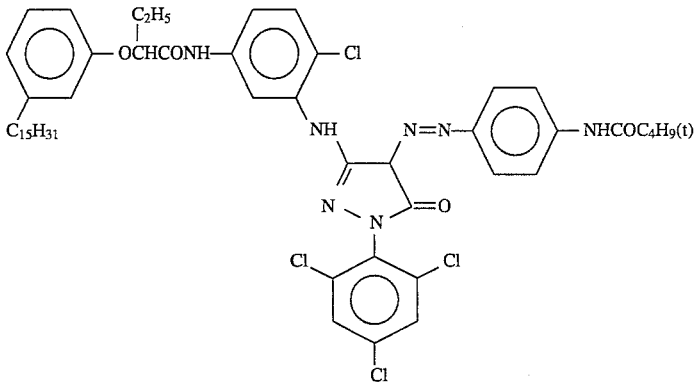
ExM-4
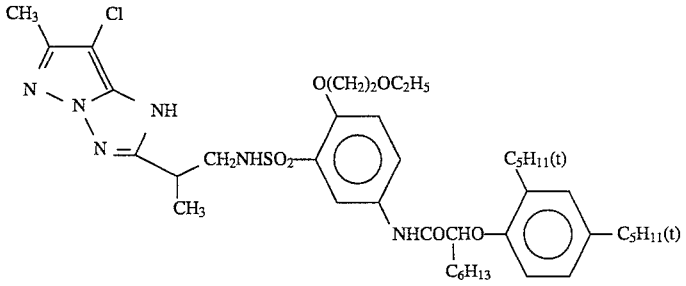
ExM-5
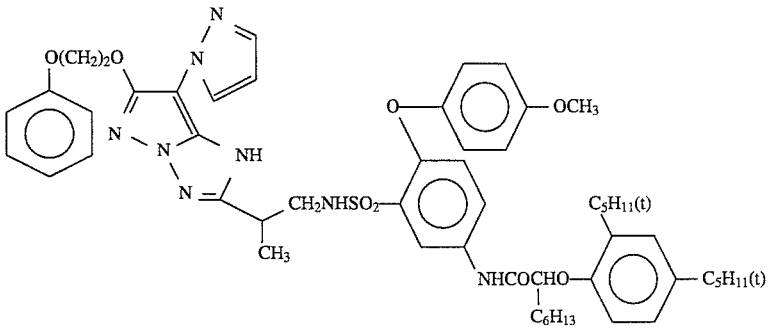
ExY-1
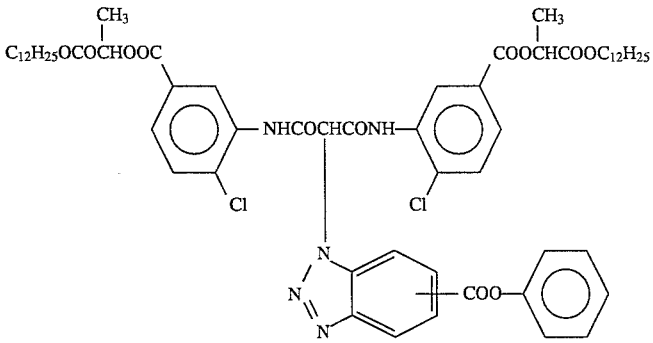

-continued
ExY-2
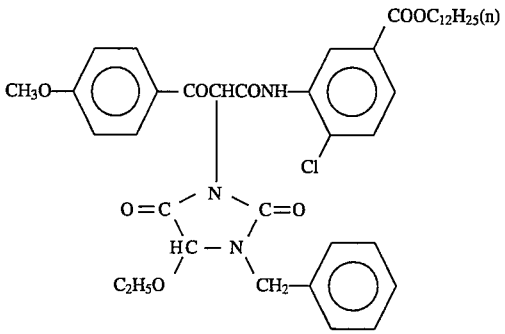
ExF-1
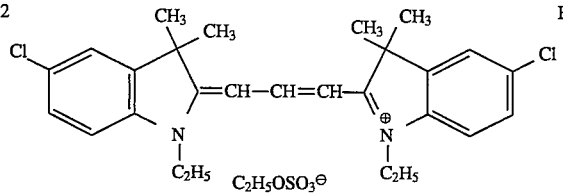
Cpd-1
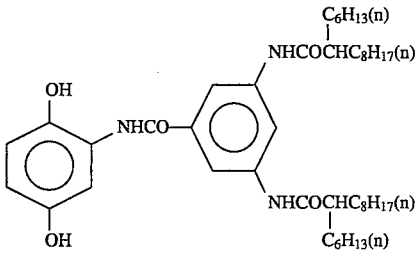
UV-1
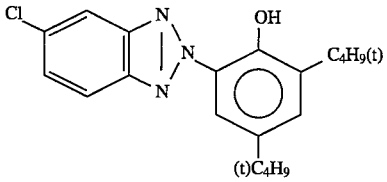
UV-2
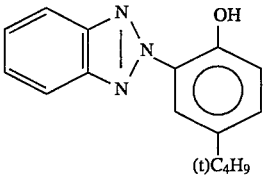
UV-3
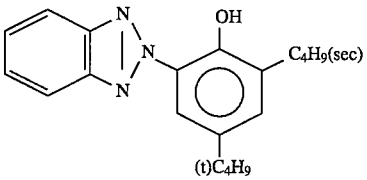
UV-4
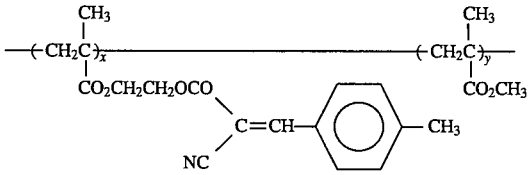
x:y = 70:30 (wt %)
UV-5
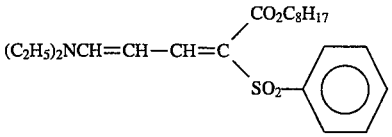
Tricresyl phosphate HBS-1
Di-n-butylphthalate HBS-2
HBS-3
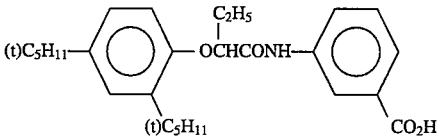
ExS-1
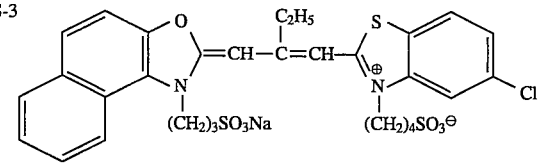
ExS-2
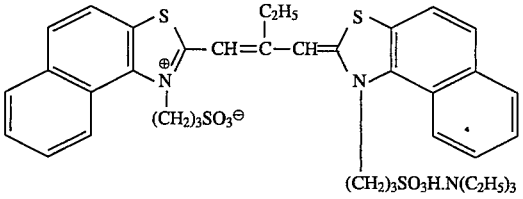
ExS-3
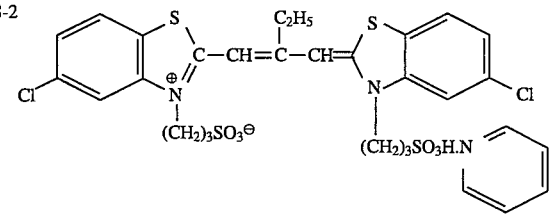
ExS-4
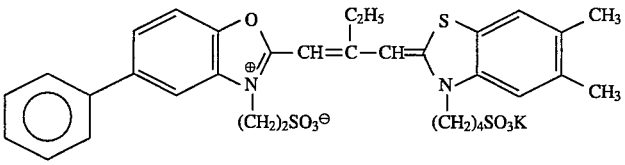

-continued
ExS-5
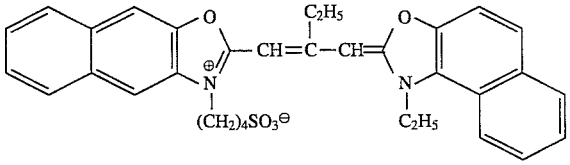
ExS-6
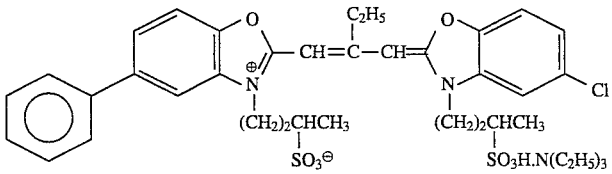
ExS-7
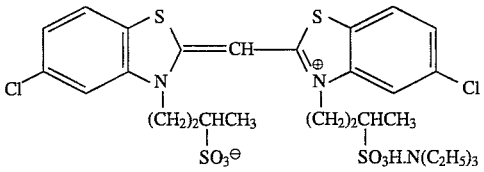
S-1
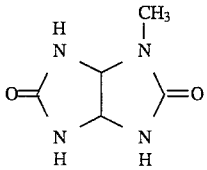
H-1
$CH_2{=}CH{-}SO_2{-}CH_2{-}CONH{-}CH_2$
$CH_2{=}CH{-}SO_2{-}CH_2{-}CONH{-}CH_2$
B-1
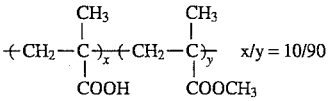
x/y = 10/90
B-2
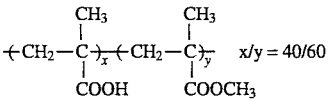
x/y = 40/60
B-3
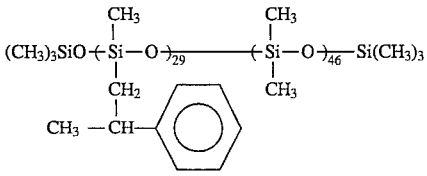
B-4
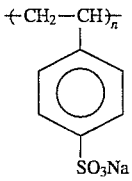
B-5
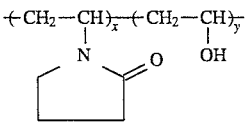
x/y = 70/30
B-6
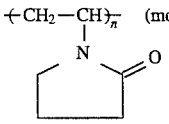
(mol. wt. about 10,000)
W-1
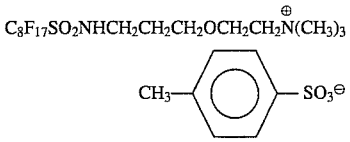
W-2
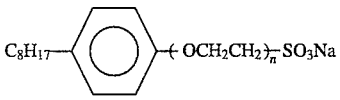
n = 2~4
W-3
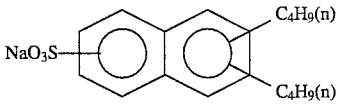
F-1
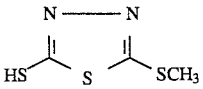
F-2
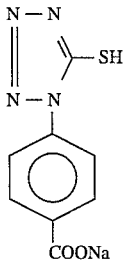

-continued

F-3

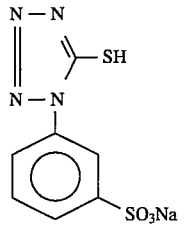

F-4

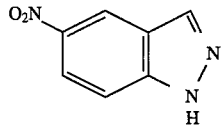

F-5

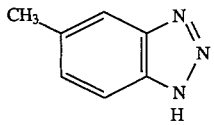

F-6

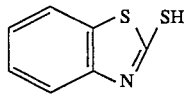

F-7

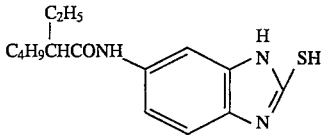

F-8

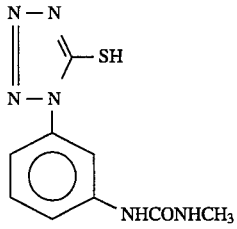

F-9

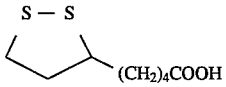

F-10

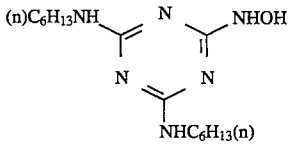

F-11

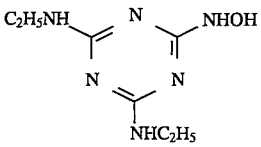

F-12

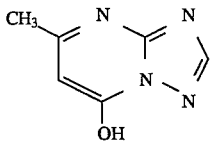

F-13

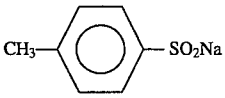

F-14

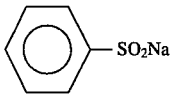

F-15

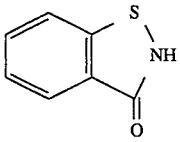

F-16

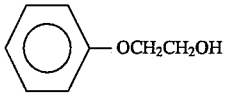

F-17

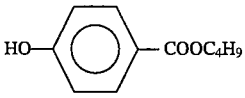

Samples 402 to 406 were prepared in the same manner as Sample 401, except that ExY-1 incorporated in the eleventh layer was replaced by equimolar amounts of DIR couplers of the present invention as set forth in Table 6, respectively. These samples each were subjected to wedgewise exposure, and then to the photographic processing described below.

The sharpness of each of the thus processed samples was evaluated using the MTF value of the yellow image at 5 cycles/mm. The determination of MTF values was carried out in accordance with the method described in *The Theory of Photographic Process*, 4th. ed. (published by Macmillan, written by C. E. K. Mees and T. H. James).

The results obtained are shown in Table 6.

The interlayer effect as a measure of the color reproducibility was evaluated as follows.

First, each of the samples was exposed uniformly to green light. In the exposure, the exposure amount was adjusted so as to give a green (G) density of 1.5. Further, the resulting samples each were subjected to imagewise (wedge) exposure to blue light. Then, they were subjected to the following photographic processing. As a result of it, the Characteristic Curve (1) of the yellow color image formed in each sample and the Density Curve (2) of the magenta color image formed therein, as shown in FIG. 1, were obtained.

More specifically, Curve (1) in FIG. 1 represents the characteristic curve of the yellow color image formed in the blue-sensitive emulsion layer of each sample when said emulsion layer was developed over the range from the unexposed area (point A) to an exposed area (point B), while Curve (2) is the density curve of the magenta image formed in the uniformly exposed green-sensitive emulsion layer when the blue-sensitive emulsion layer provided thereon was developed over the range from the unexposed area (point A) to an exposed area (point B). Therefore, said density curve provides a measure of the degree of retardation of development in the green-sensitive layer ($\Delta D_G$ defined below) which is caused in proportion to the development of the blue-sensitive layer.

The difference between the magenta density at the unexposed point A area (Da=1.5) and at the point B (Db), that is, $\Delta D_G$=Da−Db , was adopted as a measure of the interlayer effect.

The results obtained are shown in Table 6.

Processing Conditions:

| Processing Step | Processing Time | Processing Temperature |
|---|---|---|
| Color development | 3 min. 15 sec. | 38° C. |
| Bleaching | 3 min. 00 sec. | 38° C. |
| Washing with water | 30 sec. | 24° C. |
| Fixation | 3 min. 00 sec. | 38° C. |
| Washing with water (1) | 30 sec. | 24° C. |
| Washing with water (2) | 30 sec. | 24° C. |
| Stabilization | 30 sec. | 38° C. |
| Drying | 4 min. 20 sec. | 55° C. |

The composition of each processing solution used described below.

Color Developer:

| | |
|---|---|
| Diethylenetriaminepentaacetic acid | 1.0 g |
| 1-Hydroxyethylidene-1,1-diphosphonic acid | 3.0 g |
| Sodium sulfite | 4.0 g |
| Potassium carbonate | 30.0 g |
| Potassium bromide | 1.4 g |
| Potassium iodide | 1.5 mg |
| Hydroxylamine sulfate | 2.4 g |
| 4-[N-ethyl-N-β-hydroxyethylamino]-2-methylaniline sulfate (D-5) | 4.5 g |
| Water to make | 1.0 l |
| pH | 10.05 |

Bleaching Solution:

| | |
|---|---|
| Ammonium ethylenediaminetetraacetato-ferrate(III) trihydrate | 100.0 g |
| Disodium ethylenediaminetetraacetate | 10.0 g |
| 3-Mercapto-1,2,4-triazole | 0.08 g |
| Ammonium bromide | 140.0 g |
| Ammonium nitrate | 30.0 g |
| Aqueous ammonia (27%) | 6.5 ml |

-continued

| | |
|---|---|
| Water to make | 1.0 l |
| pH | 6.0 |

Fixing Solution:

| | |
|---|---|
| Disodium ethylenediaminetetraacetate | 0.5 g |
| Ammonium sulfite | 20.0 g |
| Aqueous solution of ammonium thio-sulfate (700 g/l) | 290.0 ml |
| Water to make | 1.0 l |
| pH | 6.7 |

Stabilizing Solution:

| | |
|---|---|
| Sodium p-toluenesulfinate | 0.03 g |
| Polyoxyethylene-p-monononylphenylether (average polymerization degree: 10) | 0.2 g |
| Disodium ethylenediaminetetraacetate | 0.05 g |
| 1,2,4-Triazole | 1.3 g |
| 1,4-Bis(1,2,4-triazole-l-ylmethyl)-piperazine | 0.75 g |
| Water to make | 1.0 l |
| pH | 8.5 |

Further, other color developers were prepared similarly to the foregoing color developer, except that equimolar amounts of the developing agents of the present invention as set forth in Table 6 were used respectively in place of sulfate of 4-[N-ethyl-N-β-hydroxyethylamino]-2-methylaniline (D-5) in the foregoing color developer. The foregoing samples 401 to 406 were each subjected to the same exposure as described above for the purpose of examining the sharpness and interlayer effect of each sample, and then to the same photographic processing as described above except that the color developers are different. The results obtained are summarized in Table 6.

TABLE 6

| Sample | Coupler in 11th | Color Developing Agent | | | | | | | | | | | |
|---|---|---|---|---|---|---|---|---|---|---|---|---|---|
| No. | Layer | D-5 | I-2 | I-5 | I-7 | I-11 | I-12 | I-13 | I-15 | I-20 | I-26 | I-33 | I-38 |
| 401 | ExY-1 | 1.12 | 1.25 | 1.26 | 1.24 | 1.29 | 1.28 | 1.19 | 1.21 | 1.27 | 1.23 | 1.20 | 1.18 |
| | | 0.31 | 0.32 | 0.32 | 0.33 | 0.34 | 0.34 | 0.32 | 0.32 | 0.33 | 0.32 | 0.32 | 0.32 |
| 402 | IV-1 | 1.11 | 1.28 | 1.28 | 1.27 | 1.29 | 1.30 | 1.28 | 1.28 | 1.28 | 1.27 | 1.26 | 1.25 |
| | | 0.31 | 0.34 | 0.35 | 0.34 | 0.37 | 0.36 | 0.35 | 0.34 | 0.35 | 0.34 | 0.35 | 0.34 |
| 403 | III-1 | 1.12 | 1.25 | 1.25 | 1.21 | 1.26 | 1.27 | 1.24 | 1.22 | 1.24 | 1.22 | 1.21 | 1.20 |
| | | 0.29 | 0.31 | 0.32 | 0.30 | 0.33 | 0.33 | 0.31 | 0.31 | 0.32 | 0.30 | 0.30 | 0.30 |
| 404 | III-2 | 1.12 | 1.23 | 1.24 | 1.25 | 1.28 | 1.28 | 1.23 | 1.21 | 1.26 | 1.22 | 1.20 | 1.19 |
| | | 0.31 | 0.33 | 0.32 | 0.32 | 0.33 | 0.33 | 0.32 | 0.32 | 0.32 | 0.32 | 0.32 | 0.32 |

TABLE 6-continued

| Sample No. | Coupler in 11th Layer | Color Developing Agent D-5 | I-2 | I-5 | I-7 | I-11 | I-12 | I-13 | I-15 | I-20 | I-26 | I-33 | I-38 |
|---|---|---|---|---|---|---|---|---|---|---|---|---|---|
| 405 | III-4 | 1.13 | 1.26 | 1.26 | 1.24 | 1.27 | 1.28 | 1.26 | 1.24 | 1.24 | 1.25 | 1.25 | 1.22 |
| | | 0.32 | 0.33 | 0.34 | 0.33 | 0.35 | 0.35 | 0.34 | 0.33 | 0.33 | 0.33 | 0.33 | 0.33 |
| 406 | III-6 | 1.12 | 1.23 | 1.24 | 1.22 | 1.26 | 1.27 | 1.24 | 1.22 | 1.25 | 1.23 | 1.20 | 1.19 |
| | | 0.31 | 0.32 | 0.32 | 0.33 | 0.34 | 0.34 | 0.32 | 0.33 | 0.33 | 0.32 | 0.33 | 0.33 |
| Remarks | | Comp | Inv | " | " | " | " | " | " | " | " | " | " |

Figures in upper row concerning each sample: MTF values.
Figures in lower row concerning each sample: Interlayer effect ($\Delta D_G$).
ExY-1 is included in the couplers represented by the general formula (III) of the present invention.
Comp: Comparative Example
Inv: Example of the present invention It is clear from Table 6 that great improvements in sharpness and interlayer effect were produced by using the color developing agents of the present invention, compared with the case of using the conventional developing agent D-5.

It was quite unexpected that the color developing agents of the present invention, though they in themselves have no effect upon improving in sharpness and the interlayer effect, were able to produce a synergistic effect thereupon when used in the development of photographic materials containing DIR compounds as specified by the present invention.

Additionally, it is also apparent from Table 6 that DIR couplers represented by the general formula (IV) are preferable to those represented by the general formula (III) in raising sharpness and the interlayer effect.

EXAMPLE 5

After the same samples as prepared in Example 4, namely Samples 401 to 406, were exposed imagewise, running processing solutions were prepared by continuously processing said samples with an automatic developing machine according to the processing method described below until the total amount of the replenisher used for color development became three times the volume of the color developing tank used.

| Processing Step | Processing Time | Processing Temperature | Amount Replenished* | Tank Volume |
|---|---|---|---|---|
| Color Development | 3 min. 15 sec. | 38° C. | 22 ml | 20 l |
| Bleaching | 3 min. 00 sec. | 38° C. | 25 ml | 40 l |
| Washing with water | 30 sec. | 24° C. | 1200 ml | 20 l |
| Fixation | 3 min. 00 sec. | 38° C. | 25 ml | 30 l |
| Washing with water (1) | 30 sec. | 24° C. | ** | 10 l |
| Washing with water (2) | 30 sec. | 24° C. | 1200 ml | 10 l |
| Stabilization | 30 sec. | 38° C. | 25 ml | 10 l |
| Drying | 4 min. 20 sec. | 55° C. | | |

*:per photographic material, 35 mm wide and 1 m long.
**:water was piped into the tank (1) from the tank (2) according to a counter-current method.

The composition of each processing solution used is described below.

| Color Developer: | Tank Solution | Replenisher |
|---|---|---|
| Diethylenetriaminepentaacetic acid | 1.0 g | 1.1 g |
| 1-Hydroxyethylidene-1,1-diphosphonic acid | 3.0 g | 3.2 g |
| Sodium sulfite | 4.0 g | 4.4 g |
| Potassium carbonate | 30.0 g | 37.0 g |
| Potassium bromide | 1.4 g | 0.3 g |
| Potassium iodide | 1.5 mg | — |
| Hydroxylamine sulfate | 2.4 g | 2.8 g |
| 4-[N-ethyl-N-β-hydroxyethylamino]-2-methylaniline sulfate | 4.5 g | 6.2 g |
| Water to make | 1.0 l | 1.0 l |
| pH | 10.05 | 10.15 |
| **Bleaching Solution:** | | |
| Ammonium ethylenediaminetetraacetatoferrate (III) trihydrate | 100.0 g | 120.0 g |
| Disodium ethylenediaminetetraacetate | 10.0 g | 11.0 g |
| 3-Mercapto-1,2,4-triazole | 0.08 g | 0.09 g |
| Ammonium bromide | 140.0 g | 160.0 g |
| Ammonium nitrate | 30.0 g | 35.0 g |
| Aqueous ammonia (27%) | 6.5 ml | 4.0 ml |
| Water to make | 1.0 l | 1.0 l |
| pH | 6.0 | 5.7 |
| **Fixing Solution:** | | |
| Disodium ethylenediaminetetraacetate | 0.5g | 0.7g |

| | | |
|---|---|---|
| Ammonium sulfite | 20.0 g | 22.0 g |
| Aqueous solution of ammonium thiosulfate (700 g/l) | 290.0ml | 320.0ml |
| Water to make | 1.0 l | 1.0 l |
| pH | 6.7 | 7.0 |

Stabilizing Solution: (Tank solution = Replenisher)

| | |
|---|---|
| Sodium p-toluenesulfinate | 0.03g |
| Polyoxyethylene-p-monononylphenylether (average polymerization degree: 10) | 0.2 g |
| Disodium ethylenediaminetetraacetate | 0.05g |
| 1,2,4-Triazole | 1.3 g |
| 1,4-Bis(1,2,4-triazole-1-ylmethyl)-piperazine | 0.75g |
| Water to make | 1.0 l |
| pH | 8.5 |

Then, other running solutions were prepared according to the same processing method as described above, except that 4-[N-ethyl-N-β-hydroxyethylamino]-2-methylaniline sulfate in the color developing solution was replaced by equimolar amounts of the developing agents of the present invention set forth in Table 6 respectively, until the total amount of the replenisher used for color development became three times the volume of the color developing tank used.

Samples 401 to 406 prepared in Example 4 which each had undergone the same kinds of photographic processing as in Example 4, except that the running solutions prepared in this example had been used in place of the processing solutions used in Example 1, respectively.

Each of the thus processed samples was examined for sharpness and the interlayer effect according to the same methods adopted in Example 4. The results obtained were almost equivalent to those attained in Example 4.

EXAMPLE 6

Samples 601 to 604 were prepared in the same manner as Sample 401 prepared in Example 4, except that the couplers of the present invention as set forth in Table 7 were added to both the low-speed and the medium-speed green-sensitive emulsion layers (7th and 8th layers).

TABLE 7

| Sample No. | Coupler | Amount added to 7th Layer (g/m$^2$) | Amount added to 8th Layer (g/m$^2$) |
|---|---|---|---|
| 601 | III-9 | 0.15 | $6.5 \times 10^{-3}$ |
| 602 | III-10 | 0.16 | $6.5 \times 10^{-3}$ |
| 603 | III-12 | 0.19 | $7.8 \times 10^{-3}$ |
| 604 | III-17 | 0.19 | $7.8 \times 10^{-3}$ |

In subjecting these samples to photographic processing in the same way as in Example 5, except that equimolar amounts of color developing agents of the present invention, I-2, I-5, I-7, I-11, I-12, I-13, I-15, I-21, I-25 and 1-30, were each used in place of 4-[N-ethyl-N-β-hydroxyethylamino]-2-methylaniline sulfate in the color development. All the images formed through the color development using the color developing agents of the present invention respectively were excellent in both sharpness and color reproducibility.

EXAMPLE 7

Sample 701 was prepared in the same manner as the multilayer color photographic material 9 described in Example 3 of JP-A-02-936415 (U.S. Pat. No. 5,071,736), and Samples 702 to 704 were further prepared in the same manner as Sample 701, except that ExM-10 incorporated in the donor layer to exert an interlayer effect upon the red-sensitive layer (10th layer) was replaced by the compounds set forth in Table 8, respectively.

TABLE 8

| Sample No. | Compound | *Amount added to 10th Layer |
|---|---|---|
| 701 | ExM-10 | 1.0 |
| 702 | III-9 | 1.0 |
| 703 | III-11 | 0.9 |
| 704 | III-12 | 0.9 |

*: Value expressed in terms of the ratio to the amount (by mole) of ExM-10.

In subjecting these samples to photographic processing in the same way as in Example 5, except that equimolar amounts of color developing agents of the present invention, I-2, I-5, I-7, I-11, I-12, I-13, I-15, I-19, I-20, I-29 and I-34, were each used in place of 4-[N-ethyl-N-β-hydroxyethylamino]-2-methylaniline sulfate in the color development. All the images formed through the color development using the present color developing agents respectively were excellent in sharpness.

EXAMPLE 8

Samples 802 to 805 were prepared in the same manner as Sample 401 prepared in Example 4, except that ExC-7 incorporated in the third layer as a low-speed red-sensitive emulsion layer, the fourth layer as a medium-speed red-sensitive emulsion layer, and the twelfth layer as a medium-speed blue-sensitive emulsion layer was replaced by equimolar amounts of the couplers set forth in Table 9, respectively.

After Sample 401 and Samples 802 to 805 were exposed wedgewise, the same continuous processing as in Example 5 was performed.

Further, running solutions were prepared according to the same processing method, except that 4-[N-ethyl-N-β-hydroxyethylamino]- 2-methylaniline sulfate was replaced by equimolar amounts of the developing agents as set forth in Table 9 respectively, until the total amount of the replenisher used for color development became three times the volume of the color developing tank used.

The sharpness of each of the thus processed samples was evaluated using the MTF value of the cyan image at 20 cycles/mm. The determination of MTF values was carried out in accordance with the method described in *The Theory of the Photographic Process*, 3rd. ed. (published by Macmillan, written by C. E. K. Mees and T. H. James). A value obtained by subtracting the magenta fog density from the density of the magenta color developed in the case where such an exposure as to give a cyan density of 1.5 was carried out was adopted as a measure of color turbidity.

The results obtained are summarized in Table 9.

TABLE 9

| Sample No. | Coupler in 3rd, 4th and 12th Layers | Color Developing Agent D-5 | I-2 | I-5 | I-7 | I-11 | I-12 | I-13 | I-15 | I-17 | I-21 | I-31 | I-49 |
|---|---|---|---|---|---|---|---|---|---|---|---|---|---|
| 401 | ExY-7 | 67 | 69 | 70 | 69 | 71 | 72 | 69 | 68 | 70 | 69 | 68 | 68 |
| | | 0.05 | 0.01 | 0.01 | 0.01 | 0.01 | 0.00 | 0.01 | 0.02 | 0.01 | 0.01 | 0.01 | 0.03 |
| 802 | III-18 | 61 | 63 | 62 | 62 | 65 | 65 | 62 | 62 | 62 | 63 | 62 | 62 |
| | | 0.14 | 0.12 | 0.13 | 0.13 | 0.11 | 0.10 | 0.12 | 0.12 | 0.13 | 0.12 | 0.13 | 0.13 |
| 803 | IV-7 | 68 | 69 | 71 | 69 | 73 | 74 | 70 | 69 | 69 | 70 | 69 | 69 |
| | | 0.04 | 0.02 | 0.02 | 0.03 | 0.01 | 0.01 | 0.02 | 0.02 | 0.03 | 0.02 | 0.03 | 0.03 |
| 804 | IV-14 | 67 | 69 | 70 | 70 | 72 | 73 | 69 | 69 | 70 | 69 | 68 | 68 |
| | | 0.05 | 0.01 | 0.02 | 0.02 | 0.01 | 0.00 | 0.03 | 0.03 | 0.02 | 0.02 | 0.03 | 0.04 |
| 805 | IV-15 | 65 | 68 | 67 | 67 | 71 | 73 | 68 | 69 | 69 | 67 | 67 | 67 |
| | | 0.05 | 0.02 | 0.01 | 0.03 | 0.01 | 0.00 | 0.02 | 0.03 | 0.03 | 0.04 | 0.04 | 0.04 |
| Remarks | | Comp | Inv | " | " | " | " | " | " | " | " | " | " |

Figures in upper row concerning each sample: MTF values.
Figures in lower row concerning each sample: Degree of color turbidity.
ExC-7 is included in the couplers represented by the general formula (V) of the present invention.
Comp: Comparative Example
Inv: Example of the present invention It is evident from Table 9 that the color developing agents of the present invention exhibited excellent effects upon improving sharpness and color reproducibility as represented by the degree of color turbidity. In addition, it can be seen from Table 9 that the foregoing effects became remarkable when image formation was carried out using the DIR couplers represented by the general formulae (IV) and (V), especially those represented by the general formula (V) (including ExC-7), in combination with the color developing agents represented by the general formula (I).

EXAMPLE 9

Core/shell type tabular grain silver iodobromide emulsions 1 to 5 were prepared as follows.

While an aqueous solution prepared by dissolving 30 g of inert gelatin and 6 g of potassium bromide in 1 l of distilled water was being stirred at 75° C., 35 ml of an aqueous solution containing 5.0 g of silver nitrate and 35 ml of an aqueous solution containing 3.2 g of potassium bromide and 0.98 g of potassium iodide were added thereto over a 30-second period at a flow rate of 70 ml/min. Then, the pAg of the reaction mixture was raised to 10, and the resulting mixture was ripened for 30 minutes to prepare a seed emulsion.

To the seed emulsion, a prescribed portion of an aqueous solution containing 145 g of silver nitrate in 1 l of the solution and the equimolar amount of an aqueous solution containing a mixture of potassium bromide and potassium iodide were added at an addition speed close to the critical growth speed under a prescribed temperature and a prescribed pAg value to prepare an intended tabular grain core emulsion. Successively thereto, the residual aqueous solution of silver nitrate and an aqueous solution of a potassium bromide-potassium iodide mixture having a composition different from that of the mixture used upon preparation of the core emulsion were added to the core emulsion in equimolar amounts at an addition speed close to the critical growth speed, resulting in covering the core to prepare an intended core/shell type tabular grain silver iodobromide emulsion 1 to 5.

The aspect ratio of the emulsion grains was controlled by properly choosing the pAg values at the stages of forming the core and the shell respectively.

The main features of the thus prepared tabular grain emulsions are summarized in Table 10.

TABLE 10

| Emulsion Name | Average Aspect Ratio[1)] | Average Aspect Ratio[2)] | Average Grain Diameter (μm) | Average Grain Thickness (μm) | Average Iodide Content (mol %) |
|---|---|---|---|---|---|
| 1 | 1.5/1 | 1.2/1 | 0.86 | 0.67 | 7.6 |
| 2 | 2.8/1 | 2.2/1 | 1.01 | 0.55 | 7.6 |
| 3 | 4.6/1 | 3.6/1 | 1.63 | 0.36 | 7.6 |
| 4 | 6.7/1 | 5.2/1 | 1.74 | 0.30 | 7.6 |
| 5 | 11.7/1 | 9.8/1 | 2.10 | 0.21 | 7.6 |

1): 1,000 emulsion grains were arbitrarily chosen from grains contained in each emulsion and examined for their respective aspect ratios, and a number of grains corresponding to 50% of the total projected area of the chosen grains were selected in decreasing order of aspect ratio, and the average of the individual aspect ratios of the selected grains was calculated.
2): This average aspect ratio was determined in the same manner as the average aspect ratio described in Note (1) immediately above, except that the average was based on a sampling of 1,000 arbitrarily chosen grains, and the number of grains selected in decreasing order of aspect ratio corresponded to 85% of the total projected area of chosen grains.

Preparation of Samples 901 to 905:

Samples 901 to 905 were prepared in the same manner as Sample 401 prepared in Example 4, except that Emulsions C, D, E and F incorporated in Sample 401 used in Example 4 were all replaced by the emulsions 1 to 5 shown in Table 10, respectively.

After uniform exposure to blue light, each of the thus prepared samples was subjected to imagewise exposure to red light, and thereafter examined to determine (1) the density of the yellow color developed in the area exposed in such an exposure amount as to give a density of 1.5 plus of the cyan fog density and (2) the density of the yellow color developed in the area corresponding to the area with the cyan fog density. The value obtained by subtracting the latter yellow color density from the former yellow color density was defined as the color turbidity and adopted as a measure of color reproducibility.

Each of the thus exposed samples was processed according to the same photographic processing method as adopted in Example 5, except that 4-[N-ethyl-N-β-hydroxyethylamino]- 2-methylaniline sulfate was replaced by equimolar amounts of the color developing agents of the present invention set forth in Table 11, respectively. The results obtained are summarized in Table 11.

TABLE 11

| Sample No. | Emulsion Replacement | Color Developing Agent D-5 | I-2 | I-5 | I-7 | I-11 | I-12 | I-13 | I-15 | I-22 | I-30 | I-37 |
|---|---|---|---|---|---|---|---|---|---|---|---|---|
| 901 | 1 | −0.08 | −0.11* | −0.10* | −0.10* | −0.11* | −0.11* | −0.10* | −0.10* | −0.10* | −0.10* | −0.10* |
| 902 | 2 | −0.04 | −0.07* | −0.07* | −0.07* | −0.09* | −0.09* | −0.08* | −0.07* | −0.07* | −0.08* | −0.07* |
| 903 | 3 | −0.03 | −0.08* | −0.07* | −0.08* | −0.11* | −0.10* | −0.08* | −0.07* | −0.08* | −0.07* | −0.07* |
| 904 | 4 | −0.03 | −0.09* | −0.08* | −0.08* | −0.11* | −0.11* | −0.09* | −0.08* | −0.08* | −0.08* | −0.09* |
| 905 | 5 | −0.03 | −0.09* | −0.09* | −0.09* | −0.11* | −0.11* | −0.09* | −0.09* | −0.10* | −0.09* | −0.09* |

*:This invention

As can be seen from Table 11, color turbidity became worse when photographic materials comprising tabular emulsion grains having an average aspect ratio of at least 2 (Samples 902 to 905) were developed with the conventional developing agent D-5. Such an aggravation of color turbidity as described above arose from the use of the color developing agents of the present invention, too. In most of the cases wherein the color developing agents of the present invention were used, however, a reduction of the extent of aggravation was observed. Moreover, there were cases in which some of the photographic materials almost recovered the aggravation of color turbidity arising from the use of tabular emulsion grains by the use of the color developing agents of the present invention in the photographic processing. That is to say, it is clear that the aggravation of color reproducibility, which is a defect arising from tabular emulsion grains, was able to be suppressed by the use of the color developing agents of the present invention.

In addition, it is apparent from Table 11 that the higher the aspect ratio of the tabular emulsion grains, the greater the effect of the present color developing agent of the present invention upon the recover from the aggravation of color turbidity.

EXAMPLE 10

Preparation of Sample 1001:

On a 127 μm-thick cellulose triacetate film support provided with a subbing layer, the layers having the compositions described below were coated to prepare a multilayer color photographic material named Sample 1001. The number to the right of each ingredient refers to the coverage of said ingredient expressed in amount per $m^2$. Additionally, the function of each compound added should not be construed as being limited to the denoted one.

| | |
|---|---|
| **First Layer (antihalation layer)** | |
| Black colloidal silver | 0.20 g |
| Gelatin | 1.9 g |
| Ultraviolet absorbent U-1 | 0.1 g |
| Ultraviolet absorbent U-3 | 0.04 g |
| Ultraviolet absorbent U-4 | 0.1 g |
| High boiling organic solvent Oil-1 | 0.1 g |
| Microcrystalline solid dispersion of Dye E-1 | 0.1 g |
| **Second Layer (interlayer)** | |
| Gelatin | 0.40 g |
| High boiling organic solvent Oil-3 | 0.1 g |
| Dye DD-4 | 0.4 mg |
| **Third Layer (interlayer)** | |
| Fine grain silver iodobromide emulsion fogged at the surface of the grains as well as on the inside thereof (average diameter: 0.06 μm, variation coefficient: 18%, AgI content: 1 mol %) | Ag 0.05 g |
| Gelatin | 0.4 g |
| **Fourth Layer (low-speed red-sensitive emulsion layer)** | |
| Emulsion A | Ag 0.1 g |
| Emulsion B | Ag 0.4 g |
| Gelatin | 0.8 g |
| Coupler C-1 | 0.15 g |
| Coupler C-2 | 0.05 g |
| Coupler C-3 | 0.05 g |
| Coupler C-9 | 0.05 g |
| High boiling organic solvent Oil-2 | 0.1 g |
| Additive P-1 | 0.1 g |
| **Fifth Layer (medium-speed red-sensitive emulsion layer)** | |
| Emulsion B | Ag 0.2 g |
| Emulsion C | Ag 0.3 g |
| Gelatin | 0.8 g |
| Coupler C-1 | 0.2 g |
| Coupler C-2 | 0.05 g |
| Coupler C-3 | 0.2 g |
| High boiling organic solvent Oil-2 | 0.1 g |
| Additive P-1 | 0.1 g |
| **Sixth Layer (high-speed red-sensitive emulsion layer)** | |
| Emulsion D | Ag 0.4 g |
| Gelatin | 1.1 g |
| Coupler C-1 | 0.3 g |
| Coupler C-2 | 0.1 g |
| Coupler C-3 | 0.7 g |
| Additive P-1 | 0.1 g |
| **Seventh Layer (interlayer)** | |
| Gelatin | 0.6 g |
| Additive M-1 | 0.3 g |
| Color stain inhibitor Cpd-I | 2.6 mg |
| Ultraviolet absorbent U-1 | 0.01 g |
| Ultraviolet absorbent U-2 | 0.002 g |
| Ultraviolet absorbent U-5 | 0.01 g |
| Dye DD-1 | 0.02 g |
| High boiling organic solvent Oil-1 | 0.02 g |
| **Eighth Layer (interlayer)** | |
| Fine grain silver iodobromide emulsion fogged at the surface of the grains as well as on the inside thereof (average diameter: 0.06 μm, variation coefficient: 16%, AgI content: 0.3 mol %) | Ag 0.02 g |
| Gelatin | 1.0 g |
| Additive P-1 | 0.2 g |
| Color stain inhibitor Cpd-A | 0.1 g |
| **Ninth Layer (low-speed green-sensitive emulsion layer)** | |
| Emulsion E | Ag 0.1 g |
| Emulsion F | Ag 0.2 g |
| Emulsion G | Ag 0.2 g |
| Gelatin | 0.5 g |
| Coupler C-4 | 0.1 g |
| Coupler C-7 | 0.05 g |
| Coupler C-8 | 0.20 g |

-continued

| | |
|---|---|
| Compound Cpd-B | 0.03 g |
| Compound Cpd-D | 0.02 g |
| Compound Cpd-E | 0.02 g |
| Compound Cpd-F | 0.02 g |
| Compound Cpd-G | 0.02 g |
| High boiling organic solvent Oil-1 | 0.1 g |
| High boiling organic solvent Oil-2 | 0.1 g |

Tenth Layer (medium-speed green-sensitive emulsion layer)

| | |
|---|---|
| Emulsion G | Ag 0.3 g |
| Emulsion H | Ag 0.1 g |
| Gelatin | 0.6 g |
| Coupler C-4 | 0.1 g |
| Coupler C-7 | 0.2 g |
| Coupler C-8 | 0.1 g |
| Compound Cpd-B | 0.03 g |
| Compound Cpd-D | 0.02 g |
| Compound Cpd-E | 0.02 g |
| Compound Cpd-F | 0.05 g |
| Compound Cpd-G | 0.05 g |
| High boiling organic solvent Oil-2 | 0.01 g |

Eleventh Layer (high-speed green-sensitive emulsion layer)

| | |
|---|---|
| Emulsion I | Ag 0.5 g |
| Gelatin | 1.0 g |
| Coupler C-4 | 0.3 g |
| Coupler C-7 | 0.1 g |
| Coupler C-8 | 0.1 g |
| Compound Cpd-B | 0.08 g |
| Compound Cpd-D | 0.02 g |
| Compound Cpd-E | 0.02 g |
| Compound Cpd-F | 0.02 g |
| Compound Cpd-G | 0.02 g |
| High boiling organic solvent Oil-1 | 0.02 g |
| High boiling organic solvent Oil-2 | 0.02 g |

Twelfth Layer (interlayer)

| | |
|---|---|
| Gelatin | 0.6 g |

Thirteenth Layer (yellow filter layer)

| | |
|---|---|
| Yellow colloidal silver | Ag 0.07 g |
| Gelatin | 1.1 g |
| Color stain inhibitor Cpd-A | 0.01 g |
| High boiling organic solvent Oil-1 | 0.01 g |
| Microcrystalline solid dispersion of Dye E-2 | 0.05 g |

Fourteenth Layer (interlayer)

| | |
|---|---|
| Gelatin | 0.6 g |

Fifteenth Layer (low-speed blue-sensitive emulsion layer)

| | |
|---|---|
| Emulsion J | Ag 0.2 g |
| Emulsion K | Ag 0.3 g |
| Emulsion L | Ag 0.1 g |
| Gelatin | 0.8 g |
| Coupler C-5 | 0.2 g |
| Coupler C-6 | 0.1 g |
| Coupler C-10 | 0.4 g |

Sixteenth Layer (medium-speed blue-sensitive emulsion layer)

| | |
|---|---|
| Emulsion L | Ag 0.1 g |
| Emulsion M | Ag 0.4 g |
| Gelatin | 0.9 g |
| Coupler C-5 | 0.3 g |
| Coupler C-6 | 0.1 g |
| Coupler C-10 | 0.1 g |

Seventeenth Layer (high-speed blue-sensitive emulsion layer)

| | |
|---|---|
| Emulsion N | Ag 0.4 g |
| Gelatin | 1.2 g |
| Coupler C-5 | 0.3 g |
| Coupler C-6 | 0.6 g |
| Coupler C-10 | 0.1 g |

-continued

Eighteenth Layer (first protective layer)

| | |
|---|---|
| Gelatin | 0.7 g |
| Ultraviolet absorbent U-1 | 0.2 g |
| Ultraviolet absorbent U-2 | 0.05 g |
| Ultraviolet absorbent U-5 | 0.3 g |
| Formaldehyde scavenger Cpd-H | 0.4 g |
| Dye DD-1 | 0.1 g |
| Dye DD-2 | 0.05 g |
| Dye DD-3 | 0.1 g |

Nineteenth Layer (second protective layer)

| | |
|---|---|
| Colloidal silver | Ag 0.1 mg |
| Fine grain silver iodobromide emulsion (average diameter: 0.06 μm, AgI content: 1 mol %) | Ag 0.1 g |
| Gelatin | 0.4 g |

Twentieth Layer (third protective layer)

| | |
|---|---|
| Gelatin | 0.4 g |
| Polymethylmethacrylate (average particle size: 1.5 μ) | 0.1 g |
| Methylmethacrylate/acrylic acid (4:6) Copolymer (average particle size: 1.5 μ) | 0.1 g |
| Silicone oil | 0.03 g |
| Surfactant W-1 | 3.0 mg |
| Surfactant W-2 | 0.03 g |

In addition to the above-described ingredients, each emulsion layer contained additives F-1 to F-8. Further, every layer contained a gelatin hardener H-1 and surfactants W-3 to W-6 as coating aids and emulsifiers.

Furthermore, phenol, 1,2-benzisothiazoline-3-one, 2-phenoxyethanol, phenetyl alcohol and butyl p-benzoate were added as antiseptics and antimolds to the photographic material.

The silver iodobromide emulsions used in Sample 1001 were as in Tables 12 and 13.

TABLE 12

| Emulsion Name | Main Features | Sphere corresp. Average Diameter (μm) | Variation Coefficient (%) | AgI Content (%) |
|---|---|---|---|---|
| A | monodisperse tetradecahedral grains | 0.28 | 16 | 3.7 |
| B | monodisperse cubic grains of internal latent-image type | 0.30 | 10 | 3.3 |
| C | monodisperse tabular grains with an average aspect ratio of 4.0 | 0.38 | 18 | 5.0 |
| D | tabular grains with an average aspect ratio of 8.0 | 0.68 | 25 | 2.0 |
| E | monodisperse cubic grains | 0.20 | 17 | 4.0 |
| F | monodisperse cubic grains | 0.23 | 16 | 4.0 |
| G | monodisperse cubic grains of internal latent-image type | 0.28 | 11 | 3.5 |
| H | monodisperse cubic grains of internal latent-image type | 0.22 | 9 | 3.5 |
| I | tabular grains with an average aspect ratio of 9.0 | 0.80 | 28 | 1.5 |
| J | monodisperse tetradecahedral grains | 0.30 | 18 | 4.0 |
| K | monodisperse tabular grains with an average aspect ratio of 7.0 | 0.45 | 17 | 4.0 |

TABLE 12-continued

| Emulsion Name | Main Features | Sphere corresp. Average Diameter (μm) | Variation Coefficient (%) | AgI Content (%) |
|---|---|---|---|---|
| L | monodisperse cubic grains of internal latent-image type | 0.46 | 14 | 3.5 |
| M | monodisperse tabular grains with an average aspect ratio of 10.0 | 0.55 | 13 | 4.0 |
| N | tabular grains with an average aspect ratio of 12.0 | 1.00 | 33 | 1.3 |

TABLE 13

Spectral sensitization of Emulsions A to N

| Emulsion Name | Sensitizing Dyes added | Amount (g) added per mole of Ag halide |
|---|---|---|
| A | S - 1 | 0.025 |
| | S - 2 | 0.25 |
| | S - 7 | 0.01 |
| B | S - 1 | 0.01 |
| | S - 2 | 0.25 |
| | S - 7 | 0.01 |
| C | S - 1 | 0.02 |
| | S - 2 | 0.25 |

TABLE 13-continued

Spectral sensitization of Emulsions A to N

| Emulsion Name | Sensitizing Dyes added | Amount (g) added per mole of Ag halide |
|---|---|---|
| | S - 7 | 0.01 |
| D | S - 1 | 0.01 |
| | S - 2 | 0.10 |
| | S - 7 | 0.01 |
| E | S - 3 | 0.5 |
| | S - 4 | 0.1 |
| F | S - 3 | 0.3 |
| | S - 4 | 0.1 |
| G | S - 3 | 0.25 |
| | S - 4 | 0.08 |
| | S - 8 | 0.05 |
| H | S - 3 | 0.2 |
| | S - 4 | 0.06 |
| | S - 8 | 0.05 |
| I | S - 3 | 0.3 |
| | S - 4 | 0.07 |
| | S - 8 | 0.1 |
| J | S - 6 | 0.2 |
| | S - 5 | 0.05 |
| K | S - 6 | 0.2 |
| | S - 5 | 0.05 |
| L | S - 6 | 0.22 |
| | S - 5 | 0.06 |
| M | S - 6 | 0.15 |
| | S - 5 | 0.04 |
| N | S - 6 | 0.22 |
| | S - 5 | 0.06 |

C-1

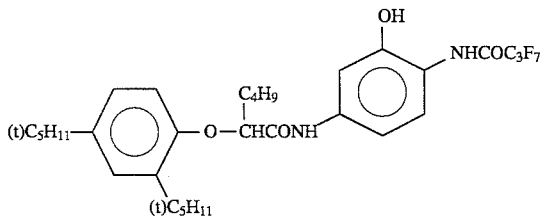

C-2

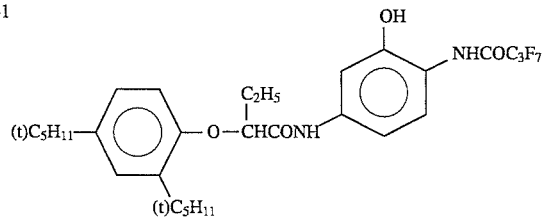

C-3

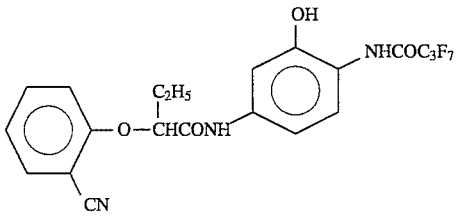

C-4

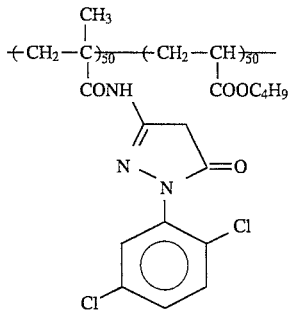

Figures: repeating unit fraction expressed in wt %
Average molecular weight: about 25,000

-continued
C-5
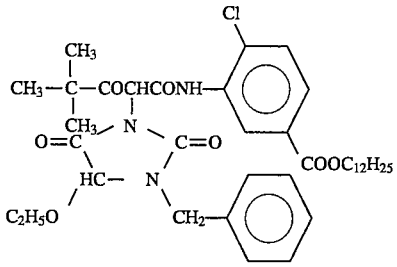
C-6
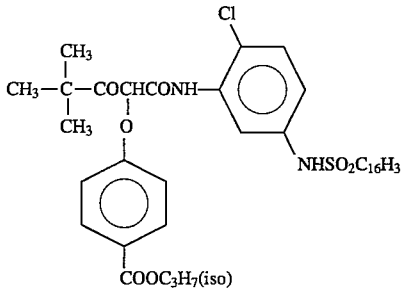
C-7
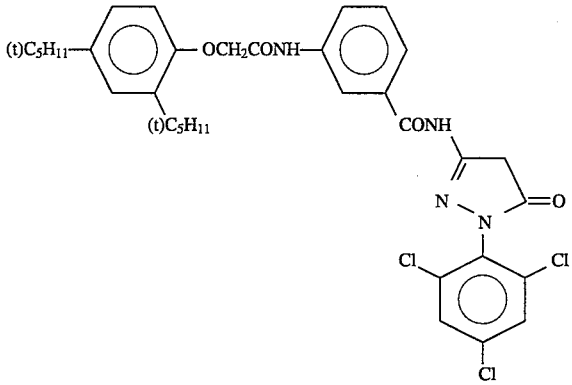
C-8
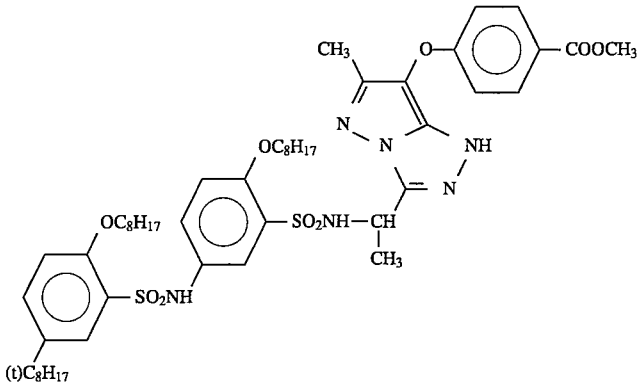
C-9
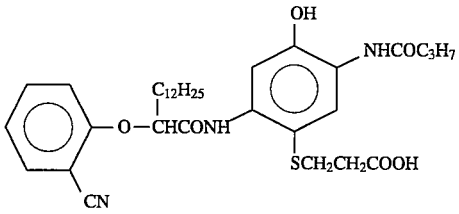
C-10
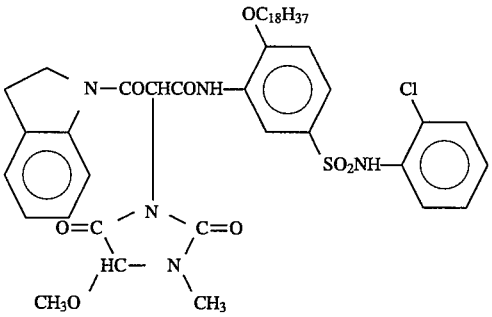
Dibutyl phthalate Oil-1
Tricresyl phosphate Oil-2
Oil-3
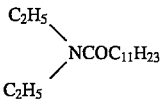
Cpd-A
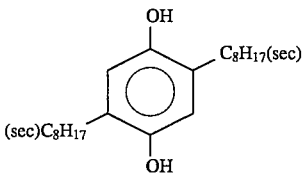

-continued
Cpd-B
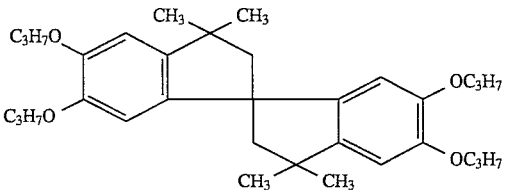
Cpd-D
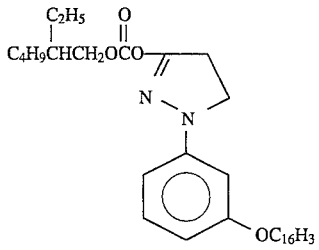
Cpd-E
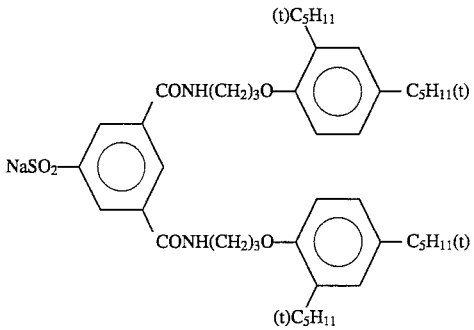
Cpd-F
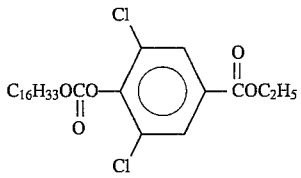
Cpd-G
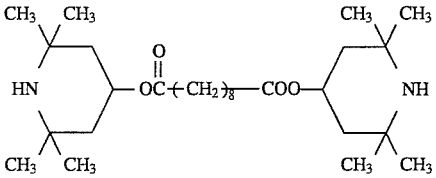
Cpd-H
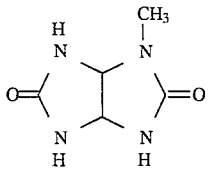
Cpd-I
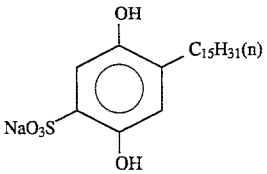
U-1
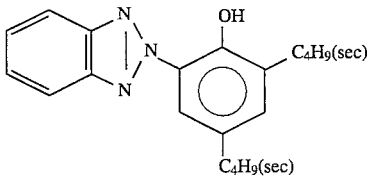
U-2
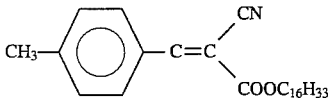
U-3
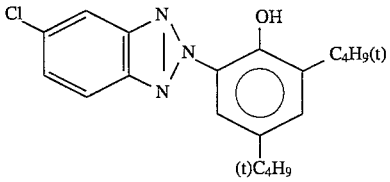
U-4
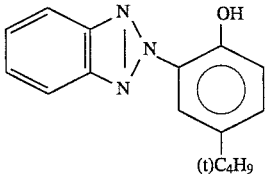
U-5
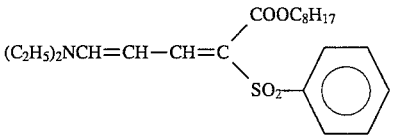
S-1
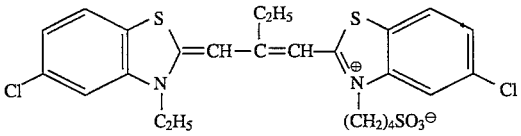
S-2
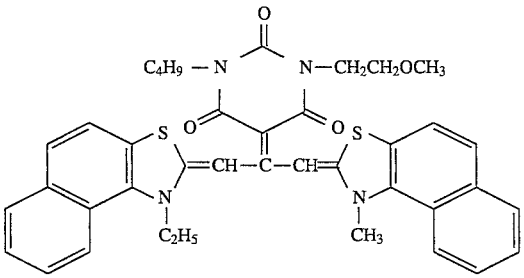

-continued
S-3
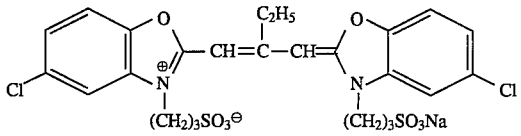
S-4
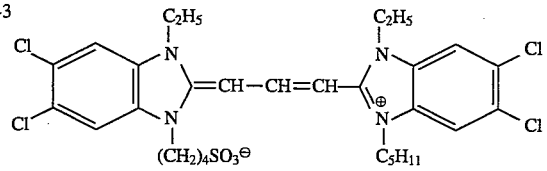
S-5
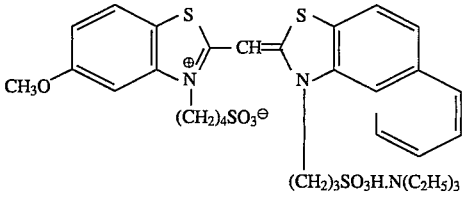
S-6
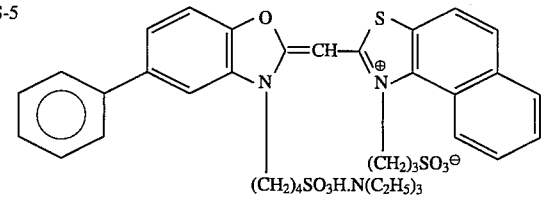
S-7
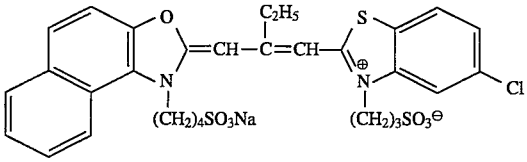
S-8
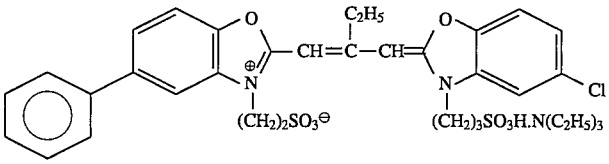
DD-1
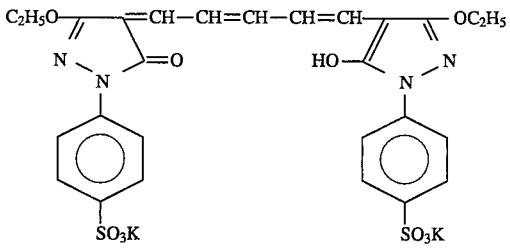
DD-2
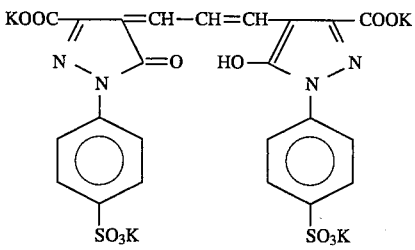
DD-3
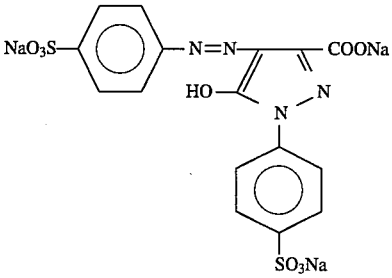
DD-4
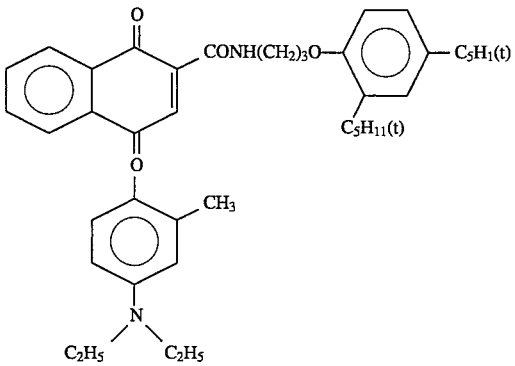
E-1
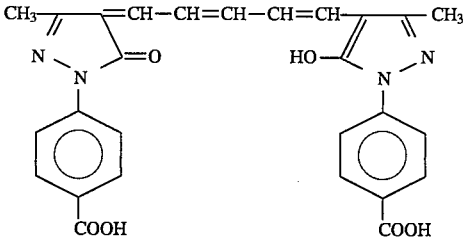
E-2
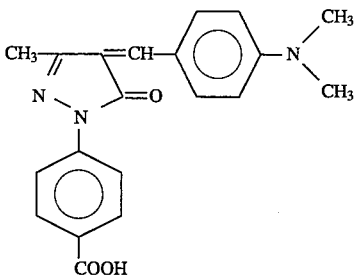

-continued
H-1
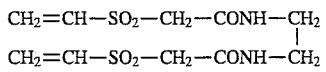
W-1
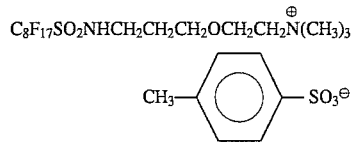
W-2
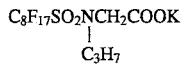
W-3
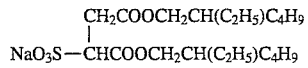
W-4
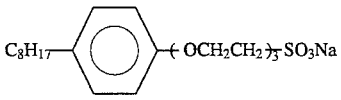
W-5
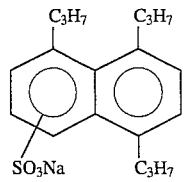
W-6
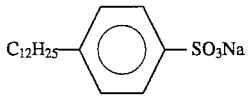
P-1
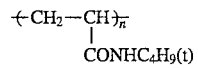
M-1
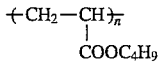
F-1
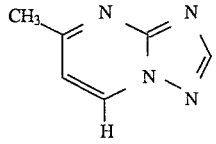
F-2
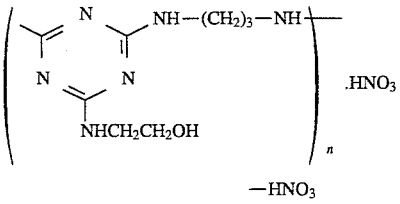
F-3
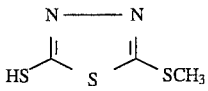
F-4
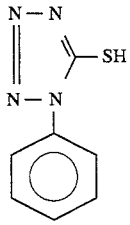
F-5
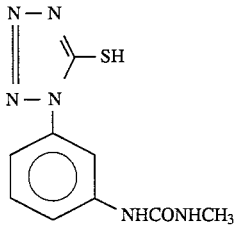
F-6
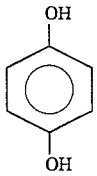
F-7
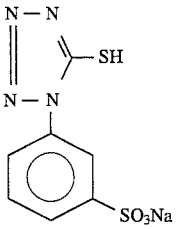
F-8
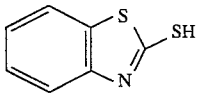
Preparation of Samples 1002 to 1006:
Samples 1002 to 1006 were prepared in the same manner as Sample 1001, except that the DIR compounds of the present invention set forth in Table 14, corresponding to those represented by the general formula (VI), were added in an amount of $0.1\times10^{-4}$ mole per $m^2$ to each of the 2nd, 4th, 7th, 9th and 11th layers, respectively.

TABLE 14

| Sample | DIR Compound added to 2nd, 4th, 7th, 9th and 11th Layers |
|---|---|
| 1001 | — |
| 1002 | VI - 1 |
| 1003 | VI - 2 |
| 1004 | VI - 6 |
| 1005 | VI - 24 |
| 1006 | VI - 29 |

The thus prepared samples each were made into 35 mm roll films charged in cartridges, and used for practical photographing. A color checker produced by Macbeth Co. was used as the subject. The photograph-taken films were subjected to eight kinds of photographic processing 1 to 8. The photographic processing 1 was constituted of the following steps, and performed under the conditions described below. The other seven kinds of photographic processing 2 to 8 were the same as the photographic processing 1, except that the compounds represented by formulae (I) of the present invention set forth in Table 15 were used in equimolar amounts in place of N-ethyl-N-hydroxypropyl-3-methyl-4-aminoaniline sulfate (the color developing agent I-2 of the present invention) as the color developing agent in the color developer. Thus, processed samples 1001-1 to 1006-8 were obtained. These practical samples were evaluated by ten evaluators in five grades with regard to color reproducibility. The mean of the thus obtained evaluation values concerning each practical sample was adopted as a measure of color reproducibility, and set forth in Table 16.

Photographic Processing 1:

| Processing Step | Time (min.) | Temperature (°C.) | Tank Volume (l) | Amount replenished (l/m$^2$) |
|---|---|---|---|---|
| Black-and-white development | 6 | 38 | 12 | 2.2 |
| First washing with water | 2 | 38 | 4 | 7.5 |
| Reversing | 2 | 38 | 4 | 1.1 |
| Color development | 6 | 38 | 12 | 2.2 |
| Compensation | 2 | 38 | 4 | 1.1 |
| Bleaching | 6 | 38 | 12 | 0.22 |
| Fixation | 4 | 38 | 8 | 1.1 |
| Second washing with water | 4 | 38 | 8 | 7.5 |
| Stabilization | 1 | 25 | 2 | 1.1 |

The composition of each processing solution used is described below.

Black-and-white Developer:

| | Tank Solution | Replenisher |
|---|---|---|
| Pentasodium nitrilo-N,N,N-trimethylenephosphonate | 2.0 g | 2.0 g |
| Potassium sulfite | 30 g | 30 g |
| Potassium hydroquinonemonosulfonate | 20 g | 20 g |
| Potassium carbonate | 33 g | 33 g |
| 1-Phenyl-4-ymethyl-4-hydroxymethyl-3-pyrazolidone | 2.0 g | 2.0 g |
| Potassium bromide | 2.5 g | 1.4 g |

-continued

Black-and-white Developer:

| | Tank Solution | Replenisher |
|---|---|---|
| Potassium thiocyanate | 1.2 g | 1.2 g |
| Potassium iodide | 2.0 mg | — |
| Water to make | 1,000 ml | 1,000 ml |
| pH | 9.60 | 9.60 |

The pH was adjusted with hydrochloric acid or potassium hydroxide.

Reversing Solution:

| | Tank Solution | Replenisher |
|---|---|---|
| Pentasodium nitrilo-N,N,N-trimethylenephosphonate | 3.0 g | 3.0 g |
| Stannous chloride dihydrate | 1.0 g | 1.0 g |
| p-Aminophenol | 0.1 g | 0.1 g |
| Sodium hydroxide | 8 g | 8 g |
| Glacial acetic acid | 15 ml | 15 ml |
| Water to make | 1,000 ml | 1,000 ml |
| PH | 6.00 | 6.00 |

The pH was adjusted with hydrochloric acid or sodium hydroxide.

Color Developer:

| | Tank Solution | Replenisher |
|---|---|---|
| Pentasodium nitrilo-N,N,N-trimethylenephosphonate | 2.0 g | 2.0 g |
| Sodium sulfite | 7.0 g | 7.0 g |
| Trisodium phosphate dodecahydrate | 36 g | 36 g |
| Potassium bromide | 1.0 g | — |
| Potassium iodide | 90 mg | — |
| Sodium hydroxide | 3.0 g | 3.0 g |
| Citrazinic acid | 1.5 g | 1.5 g |
| N-ethyl-N-hydroxypropyl-3-methyl-4-aminoaniline sulfate (color developing agent I-2 of the present invention) | 7.8 g | 7.8 g |
| 3,6-Dithia-1,8-octanediol | 1.0 g | 1.0 g |
| Water to make | 1,000 ml | 1,000 ml |
| pH | 11.80 | 12.00 |

The pH was adjusted with hydrochloric acid or potassium hydroxide.

Compensating Solution:

| | Tank Solution | Replenisher |
|---|---|---|
| Disodium ethylenediaminetetraacetate dihydrate | 8.0 g | 8.0 g |
| Sodium sulfite | 12 g | 12 g |
| 1-Thioglycerolsorbitan ester | 0.1 g | 0.1 g |
| Water to make | 1,000 ml | 1,000 ml |
| pH | 6.20 | 6.20 |

The pH was adjusted with hydrochloric acid or potassium hydroxide.

| Bleaching Solution: | Tank Solution | Replenisher |
|---|---|---|
| Disodium ethylenediamine-tetraacetate dihydrate | 2.0 g | 4.0 g |
| Potassium bromide | 100 g | 200 g |
| Ammonium ethylenediamine-tetraacetatoferrate(III) dihydrate | 120 g | 240 g |
| Ammonium nitrate | 10 g | 20 g |
| Water to make | 1,000 ml | 1,000 ml |
| pH | 5.70 | 5.50 |

The pH was adjusted with hydrochloric acid or sodium hydroxide.

| Fixing Bath: | Tank Solution | = | Replenisher |
|---|---|---|---|
| Ammonium thiosulfate | 8.0 g | | 8.0 g |
| Sodium sulfite | 5.0 g | | 5.0 g |
| Sodium hydrogen sulfite | 5.0 g | | 5.0 g |
| Water to make | 1,000 ml | | 1,000 ml |
| pH | 6.60 | | 6.60 |

The pH was adjusted with acetic acid or aqueous ammonia.

| Stabilizing Bath: | Tank Solution | = | Replenisher |
|---|---|---|---|
| Formaldehyde (37%) | 5.0 ml | | 5.0 ml |

-continued

| Stabilizing Bath: | Tank Solution | = | Replenisher |
|---|---|---|---|
| Polyoxyethylene-p-monononyl-phenyl ether (average polymerization degree: 10) | 0.5 ml | | 0.5 ml |
| Water to make | 1,000 ml | | 1,000 ml |
| pH | | no adjustment | |

In evaluating the color reproducibility of each practical sample in the photographic processing of each kind, the results of which are summarized in Table 16, samples were chosen which had undergone the photographic processing at the time when said processing had been continued using an automatic developing machine until the total amount of the replenisher used for color development had become three times the volume of the color developing tank used.

*Sorbitan Ester

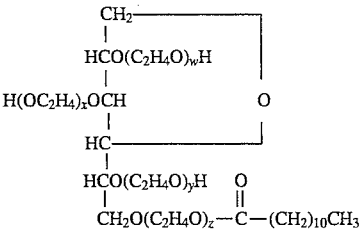

(w + x + y + z = 20)

TABLE 15

| Photographic Processing | Color Developing Agent |
|---|---|
| 2 | I - 3 |
| 3 | I - 5 |
| 4 | I - 11 |
| 5 | I - 12 |
| 6 | I - 15 |
| 7 | I - 21 |
| 8 | I - 26 |

TABLE 16

| Processed Sample | Compound added to 2nd, 4th, 7th, 9th, and 11th Layers | Color Developing Agent | Color Reproducibility* Cyan | Magenta | Yellow | Red | Green | Blue |
|---|---|---|---|---|---|---|---|---|
| 1001-1 | — | I-2 | 3 | 3 | 3 | 3 | 3 | 3 |
| 1002-1 | VI-1 | I-2 | 5 | 5 | 4 | 5 | 5 | 4 |
| 1003-1 | VI-2 | I-2 | 5 | 5 | 5 | 4 | 5 | 5 |
| 1004-1 | VI-6 | I-2 | 4 | 5 | 5 | 5 | 5 | 5 |
| 1005-1 | VI-24 | I-2 | 5 | 5 | 4 | 5 | 5 | 5 |
| 1006-1 | VI-29 | I-2 | 5 | 5 | 5 | 5 | 5 | 5 |
| 1001-2 | — | I-3 | 3 | 3 | 3 | 3 | 3 | 3 |
| 1002-2 | VI-1 | I-3 | 5 | 4 | 4 | 5 | 4 | 5 |
| 1003-2 | VI-2 | I-3 | 5 | 5 | 5 | 5 | 5 | 5 |
| 1004-2 | VI-6 | I-3 | 4 | 4 | 4 | 4 | 4 | 4 |
| 1005-2 | VI-24 | I-3 | 5 | 5 | 5 | 5 | 5 | 5 |
| 1006-2 | VI-29 | I-3 | 5 | 5 | 5 | 5 | 5 | 5 |
| 1001-3 | — | I-5 | 3 | 3 | 3 | 3 | 3 | 3 |
| 1002-3 | VI-1 | I-5 | 5 | 5 | 5 | 5 | 5 | 5 |
| 1003-3 | VI-2 | I-5 | 5 | 5 | 5 | 5 | 5 | 5 |
| 1004-3 | VI-6 | I-5 | 5 | 5 | 4 | 5 | 5 | 4 |
| 1005-3 | VI-24 | I-5 | 5 | 5 | 5 | 5 | 5 | 5 |
| 1006-3 | VI-29 | I-5 | 5 | 5 | 5 | 5 | 5 | 5 |

TABLE 16-continued

| Processed Sample | Compound added to 2nd, 4th, 7th, 9th, and 11th Layers | Color Developing Agent | Color Reproducibility* Cyan | Magenta | Yellow | Red | Green | Blue |
|---|---|---|---|---|---|---|---|---|
| 1001-4 | — | I-11 | 3 | 3 | 3 | 3 | 3 | 3 |
| 1002-4 | VI-1 | I-11 | 5 | 5 | 5 | 5 | 5 | 5 |
| 1003-4 | VI-2 | I-11 | 5 | 5 | 5 | 5 | 5 | 5 |
| 1004-4 | VI-6 | I-11 | 5 | 5 | 5 | 5 | 5 | 5 |
| 1005-4 | VI-24 | I-11 | 5 | 5 | 5 | 5 | 5 | 5 |
| 1006-4 | VI-29 | I-11 | 5 | 5 | 5 | 5 | 5 | 5 |
| 1001-5 | — | I-12 | 4 | 4 | 3 | 4 | 3 | 4 |
| 1002-5 | VI-1 | I-12 | 5 | 5 | 5 | 5 | 5 | 5 |
| 1003-5 | VI-2 | I-12 | 5 | 5 | 5 | 5 | 5 | 5 |
| 1004-5 | VI-6 | I-12 | 5 | 5 | 5 | 5 | 5 | 5 |
| 1005-5 | VI-24 | I-12 | 5 | 5 | 5 | 5 | 5 | 5 |
| 1006-5 | VI-29 | I-12 | 5 | 5 | 5 | 5 | 5 | 5 |
| 1001-6 | — | I-15 | 3 | 4 | 3 | 3 | 3 | 3 |
| 1002-6 | VI-1 | I-15 | 5 | 5 | 5 | 5 | 5 | 5 |
| 1003-6 | VI-2 | I-15 | 5 | 5 | 5 | 5 | 5 | 5 |
| 1004-6 | VI-6 | I-15 | 5 | 4 | 4 | 5 | 4 | 4 |
| 1005-6 | VI-24 | I-15 | 5 | 5 | 5 | 5 | 5 | 5 |
| 1006-6 | VI-29 | I-15 | 5 | 5 | 5 | 5 | 5 | 5 |
| 1001-7 | — | I-21 | 3 | 3 | 3 | 4 | 3 | 3 |
| 1002-7 | VI-1 | I-21 | 5 | 4 | 4 | 4 | 4 | 5 |
| 1003-7 | VI-2 | I-21 | 5 | 5 | 4 | 5 | 5 | 5 |
| 1004-7 | VI-6 | I-21 | 4 | 4 | 4 | 4 | 4 | 4 |
| 1005-7 | VI-24 | I-21 | 5 | 5 | 5 | 5 | 5 | 5 |
| 1006-7 | VI-29 | I-21 | 5 | 5 | 5 | 5 | 5 | 5 |
| 1001-8 | — | I-26 | 3 | 4 | 3 | 3 | 3 | 3 |
| 1002-8 | VI-1 | I-26 | 5 | 4 | 5 | 5 | 4 | 5 |
| 1003-8 | VI-2 | I-26 | 5 | 5 | 5 | 5 | 5 | 5 |
| 1004-8 | VI-6 | I-26 | 4 | 5 | 4 | 5 | 5 | 4 |
| 1005-8 | VI-24 | I-26 | 5 | 5 | 5 | 5 | 5 | 5 |
| 1006-8 | VI-29 | I-26 | 5 | 5 | 5 | 5 | 5 | 5 |

*1: inferior
2: somewhat inferior
3: equivalent
4: superior
5: very superior (all values are relative to the processed sample 1001-1)
All samples were those of the present invention As can be seen from Table 16, the color image forming methods according to the present invention were especially excellent in color reproducibility.

EXAMPLE 11

On a 220 μm-thick paper support laminated with polyethylene on both sides were coated the layers described below, from the first to the twelfth layers, to prepare a multilayer color photographic material (Sample 1101). The polyethylene laminate on the side of the first layer contained 15 wt % of anatase type titanium oxide as a white pigment and a slight amount of ultramarine as a bluish dye to impart to the support surface a chromaticity of 89.0, −0.18 and −0.73 expressed in the (L*, a*, b*) by color representing system.

The ingredients of each constituent layer and their coverage expressed in g/m$^2$ are described below. As for the silver halide emulsions, the figures in the right column are their coverage based on silver.

| | |
|---|---|
| First Layer (gelatin layer) | |
| Gelatin | 0.30 |
| Second Layer (antihalation layer) | |
| Black colloidal silver | 0.07 |
| Gelatin | 0.50 |

-continued

| | |
|---|---|
| Third Layer (slow red-sensitive layer) | |
| Silver chloroiodobromide emulsion spectrally sensitized with red sensitizing dyes (ExS-1, 2 and 3) (having a silver chloride content of 1 mol %, a silver iodide content of 4 mol %, an average grain size of 0.3 μm, 10% of grain size distribution, and a cubic crystal form with an iodide core type core shell structure) | 0.06 |
| Silver iodobromide emulsion spectrally sensitized with red sensitizing dyes (ExS-1, 2 and 3) (having a silver iodide content of 4 mol %, an average grain size of 0.5 μm, 15% of grain size distribution, and a cubic crystal form) | 0.07 |
| Gelatin | 1.00 |
| Cyan coupler (ExC-1) | 0.14 |
| Cyan coupler (ExC-2) | 0.07 |
| Discoloration inhibitor (equal amounts of Cpd-2, 3 and 4) | 0.12 |
| Coupler dispersing medium (Cpd-6) | 0.0 3 |
| Coupler solvent (equal amounts of Solv-1, 2 and 3) | 0.06 |
| Development accelerator (Cpd-13) | 0.05 |
| Fourth Layer (fast red-sensitive layer) | |
| Silver iodobromide emulsion spectrally sensitized with red sensitizing dyes | 0.15 |

-continued

| | |
|---|---|
| (ExS-1, 2 and 3) (having a silver iodide content of 6 mol %, an average grain size of 0.8 μm, 20% of grain size distribution, and a tabular crystal form (aspect ratio = 8) with an iodide core type) | |
| Gelatin | 1.00 |
| Cyan coupler (ExC-1) | 0.10 |
| Cyan coupler (ExC-2) | 0.20 |
| Discoloration inhibitor (equal amounts of Cpd-2, 3 and 4) | 0.15 |
| Coupler dispersion medium (Cpd-6) | 0.03 |
| Coupler solvent (equal amounts of Solv-1, 2 and 3) | 0.10 |
| Fifth Layer (interlayer) | |
| Magenta colloidal silver | 0.02 |
| Gelatin | 1.00 |
| Color stain inhibitor (equal amounts of Cpd-7 and 16) | 0.08 |
| Color stain inhibitor solvent (equal amounts of Solv-4 and 5) | 0.16 |
| Polymer latex (Cpd-8) | 0.10 |
| Sixth Layer (slow green-sensitive layer) | |
| Silver chloroiodobromide emulsion spectrally sensitized with a green sensitizing dye (ExS-4) (having a silver chloride content of 1 mol %, a silver iodide content of 2.5 mol %, an average grain size of 0.28 μm, 8% of grain size distribution, and a cubic crystal form with a iodide core type core/shell structure) | 0.04 |
| Silver iodobromide emulsion spectrally sensitized with a green sensitizing dye (ExS-4) (having a silver iodide content of 2.5 mol %, an average grain size of 0.48 μm, 12% of grain size distribution, and a cubic crystal form) | 0.06 |
| Gelatin | 0.80 |
| Magenta coupler (equal amounts of ExM-1 and 2) | 0.10 |
| Discoloration inhibitor (Cpd-9) | 0.10 |
| Stain inhibitor (equal amounts of Cpd-10 and 11) | 0.01 |
| Stain inhibitor (Cpd-5) | 0.001 |
| Stain inhibitor (Cpd-12) | 0.01 |
| Coupler dispersion medium (Cpd-6) | 0.05 |
| Coupler solvent (equal amounts of Solv-4 and 6) | 0.15 |
| Seventh Layer (fast green-sensitive layer) | |
| Silver iodobromide emulsion spectrally sensitized with a green sensitizing dye (ExS-4) (having a silver iodide content of 3.5 mol %, an average grain size of 1.0 μm, 21% of grain size distribution, and a tabular crystal form (aspect ratio = 9), uniform iodide distribution) | 0.10 |
| Gelatin | 0.80 |
| Magenta coupler (equal amounts of ExM-1 and 2) | 0.10 |
| Discoloration inhibitor (Cpd-9) | 0.10 |
| Stain inhibitor (equal amounts of Cpd-10 and 11) | 0.02 |
| Stain inhibitor (Cpd-5) | 0.001 |
| Stain inhibitor (Cpd-12) | 0.01 |
| Coupler dispersion medium (Cpd-6) | 0.05 |
| Coupler solvent (equal amounts Solv-4 and 6) | 0.15 |
| Eighth Layer (yellow filter layer) | |
| Yellow colloidal silver | 0.14 |
| Gelatin | 1.00 |
| Color mixing inhibitor (Cpd-7) | 0.06 |
| Color mixing inhibitor solvent (equal amounts of Solv-4 and 5) | 0.15 |
| Polymer latex (Cpd-8) | 0.10 |

-continued

| | |
|---|---|
| Ninth Layer (slow blue-sensitive layer) | |
| Silver chloroiodobromide emulsion spectrally sensitized with blue sensitizing dyes (ExS-5 and 6) (having a silver chloride content of 2 mol %, a silver iodide content of 2.5 mol %, an average grain size of 0.38 μm, 8% of grain size distribution, and a cubic crystal form with an iodide core type core/shell structure) | 0.07 |
| Silver iodobromide emulsion spectrally sensitized with green sensitizing dyes (ExS-5 and 6) (having a silver iodide content of 2.5 mol %, an average grain size of 0.55 μm, 11% grain size distribution, and a cubic crystal form) | 0.10 |
| Gelatin | 0.60 |
| Yellow coupler (equal amounts of ExY-1 and 2) | 0.20 |
| Stain inhibitor (Cpd-5) | 0.001 |
| Discoloration inhibitor (Cpd-14) | 0.10 |
| Coupler dispersion medium (Cpd-6) | 0.05 |
| Coupler solvent (Solv-2) | 0.05 |
| Tenth Layer (fast blue-sensitive layer) | |
| Silver iodobromide emulsion spectrally sensitized with blue sensitizing dyes (ExY-5 and 6) (having a silver iodide content of 2.5 mol %, an average grain size of 1.4 μm, 21% of grain size distribution, and a tabular crystal form (aspect ratio = 14)) | 0.25 |
| Gelatin | 1.20 |
| Yellow coupler (equal amounts of ExY-1 and 2) | 0.40 |
| Stain inhibitor (Cpd-5) | 0.002 |
| Discoloration inhibitor (Cpd-14) | 0.10 |
| Coupler dispersion medium (Cpd-6) | 0.15 |
| Coupler solvent (Solv-2) | 0.10 |
| Eleventh Layer (UV absorption layer) | |
| Gelatin | 1.50 |
| Ultraviolet absorbent (equal amounts of Cpd-1, 2, 4 and 15) | 1.00 |
| Color mixing inhibitor (equal amounts of Cpd-7 and 16) | 0.06 |
| Dispersion medium (Cpd-6) | |
| Ultraviolet absorbent solvent (Solv-1 and 2) | 0.15 |
| Irradiation preventing dye (equal amounts of Cpd-17 and 18) | 0.02 |
| Irradiation preventing dye (equal amounts of Cpd-19 and 20) | 0.02 |
| Twelfth Layer (protective layer) | |
| Fine grain silver chlorobromide (silver chloride content: 97 mol %, e averag grain size: 0.2 μm) | 0.07 |
| Modified Poval | 0.02 |
| Gelatin | 1.50 |
| Gelatin hardener (equal amounts H-1 and H-2) | 0.17 |

In addition, each constituent layer contained Alkanol XC ( a product of DuPont) and sodium alkylbenzenesulfonate as emulsifying dispersion assistants, and a succinic acid ester and Magefac F120 (a product of Dai-Nippon Ink & Chemicals, Inc.) as coating aids. In each layer containing silver halide or colloidal silver, Cpd-21, 22 and 23 were used as stabilizers.

The compounds used in this example are illustrated below.

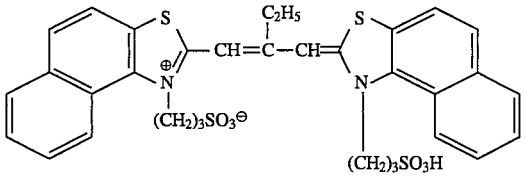
ExS-1
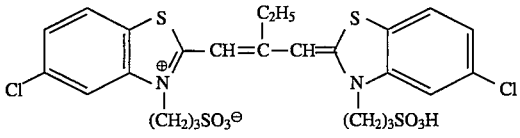
ExS-2
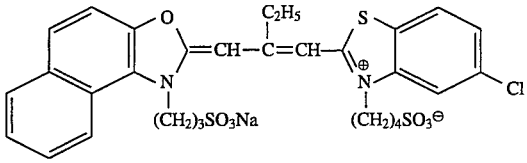
ExS-3
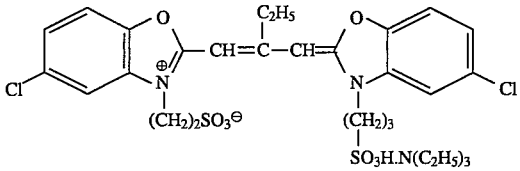
ExS-4
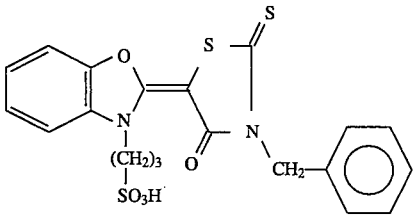
ExS-5
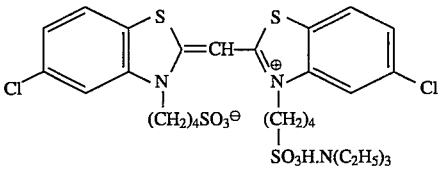
ExS-6
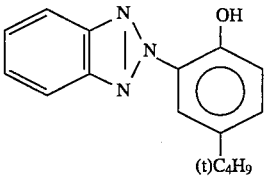
Cpd-1
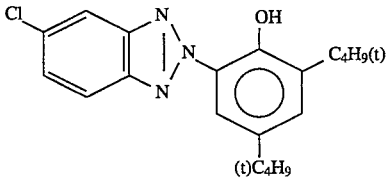
Cpd-2
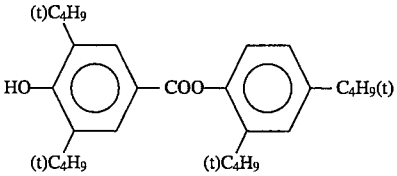
Cpd-3
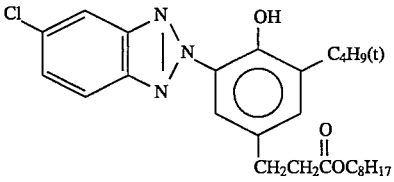
Cpd-4
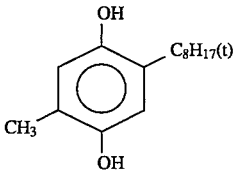
Cpd-5
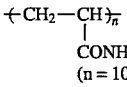
Cpd-6
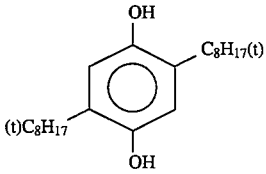
Cpd-7
Polyethylacrylate
(MW = 10,000~100,000)
Cpd-8
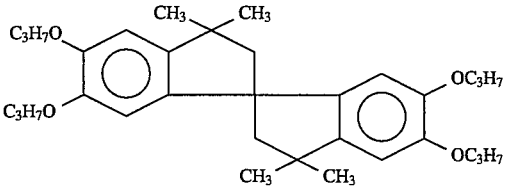
Cpd-9
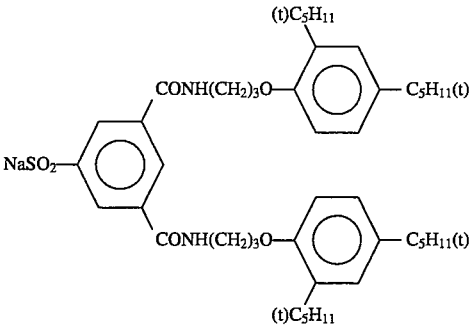
Cpd-10

-continued
Cpd-11
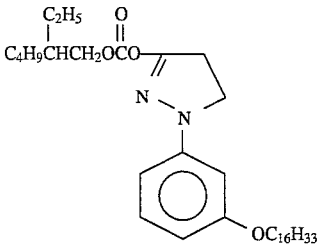
Cpd-12
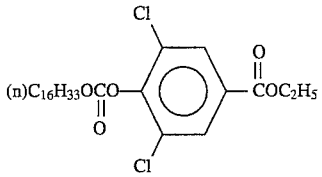
Cpd-13
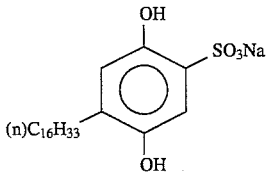
Cpd-14
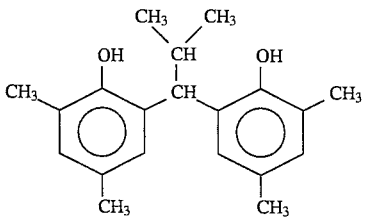
Cpd-15
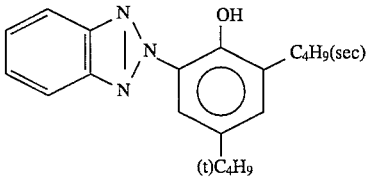
Cpd-16
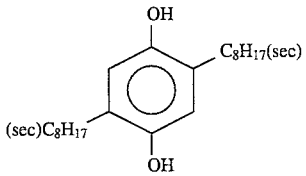
Cpd-17
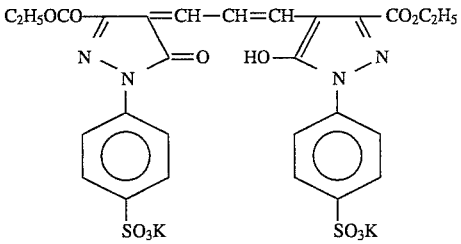
Cpd-18
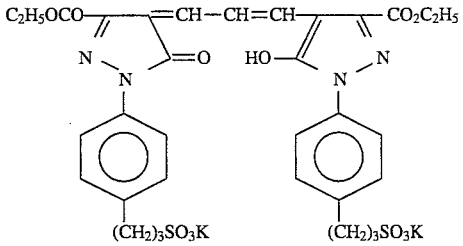
Cpd-19
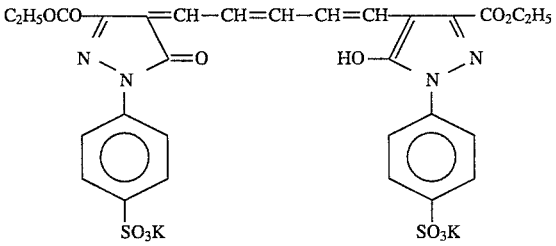

-continued
Cpd-20
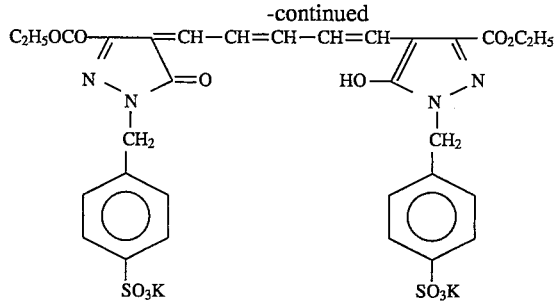
Cpd-21
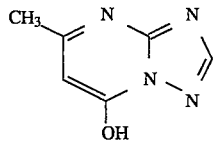
Cpd-22
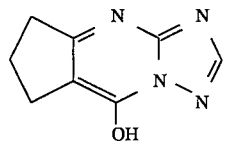
Cpd-23
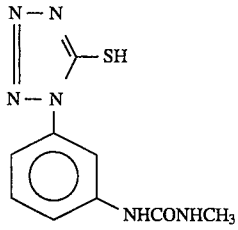
Cpd-24
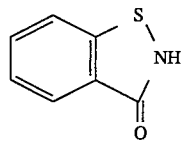
Cpd-25
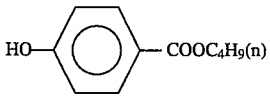
Cpd-26
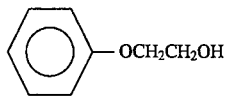
ExC-1
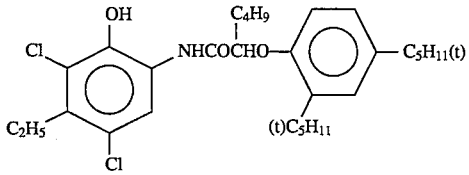
ExC-2
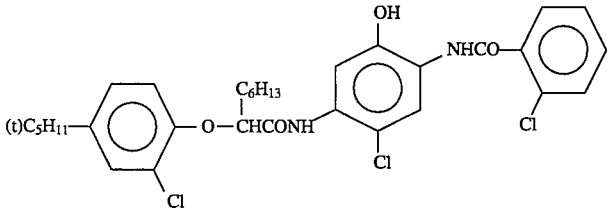
ExM-1
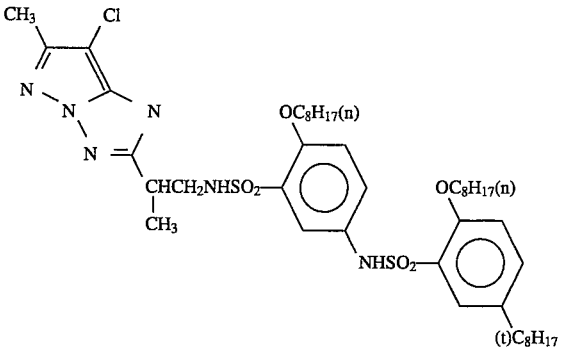

-continued

ExM-2

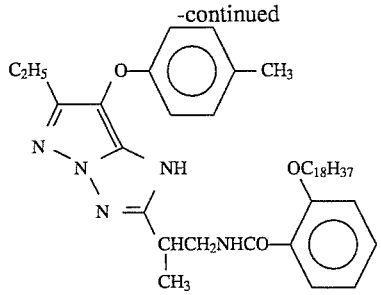

ExY-1

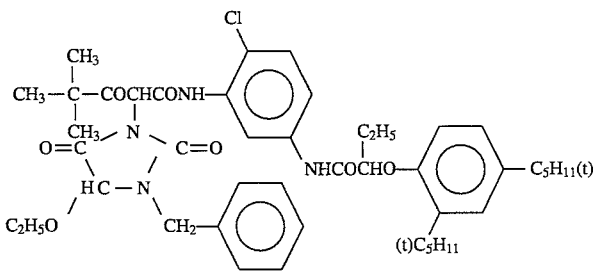

ExY-2

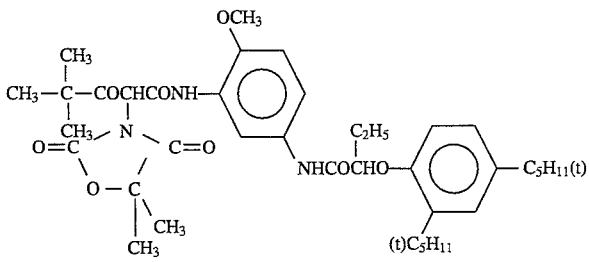

| | | | |
|---|---|---|---|
| Di(2-ethylhexyl) phthalate | Solv-1 | Trinonyl phosphate | Solv-2 |
| Di(3-methylhexyl) phthalate | Solv-3 | Tricresyl phosphate | Solv-4 |
| Dibutyl phthalate | Solv-5 | Trioctyl phosphate | Solv-6 |
| 1,2-Bis(vinylsulfonylacetamido)ethane | H-1 | Sodium salt of 4,6-dichloro-2-hydroxyl-1,3,5-triazine | H-2 |

Preparation of Samples 1102 to 1106:

Samples 1102 to 1106 were prepared in the same manner as Sample 1101, except that the present DIR compounds of the present invention as set forth in Table 17, corresponding to those represented by the general formula (VI), were added to each of the second, the third, the sixth and the ninth layers in an amount of $0.8\times10^{-5}$ mol/m$^2$, respectively.

TABLE 17

| Sample | DIR Compound added to 2nd, 3rd, 6th and 9th Layers |
|---|---|
| 1101 | — |
| 1102 | VI - 1 |
| 1103 | VI - 2 |
| 1104 | VI - 6 |
| 1105 | VI - 24 |
| 1406 | VI - 29 |

Then, a photograph of color checker produced by Macbeth Co. was taken with a coupler-in-emulsion type reversal film (RDP: products of Fuji Photo Film Co., Ltd.), and processed with CR-56P to obtain a positive film. The positive film obtained was printed on each of the foregoing samples 1101 to 1106. The thus printed films were subjected to six kinds of photographic processing 1 to 6. The photographic processing 1 was constituted of the following steps, and performed under the conditions described below. The other four kinds of photographic processing 2 to 5 were the same as the photographic processing 1, except that the compounds of the present invention set forth in Table 18, corresponding to those represented by the general formula (I) of the present invention, were used in equimolar amounts in place of N-ethyl-N-hydroxypropyl-3-methyl-4-aminoaniline sulfate (the color developing agent I-2 of the present invention) as color developing agent in the color developer. Thus, processed samples 1101-1 to 1106-5 were obtained. These practical samples were evaluated by ten evaluators in five grades with regard to color reproducibility. The mean of the thus obtained evaluation values concerning each practical sample was adopted as a measure of color reproducibility, and set forth in Table 18.

Photographic Processing 1:

| Processing Step | Time (sec.) | Temperature (°C.) | Tank Volume (l) | Amount replenished (ml/m$^2$) |
|---|---|---|---|---|
| First development | 75 | 38 | 8 | 330 |
| First washing with water (1) | 45 | 33 | 5 | — |
| First washing with water (2) | 45 | 33 | 5 | 5000 |

-continued

Photographic Processing 1:

| Processing Step | Time (sec.) | Temperature (°C.) | Tank Volume (l) | Amount replenished (ml/m²) |
|---|---|---|---|---|
| Reversal exposure | 15 | (100 lux) | | |
| Color development | 135 | 38 | 15 | 330 |
| Second washing | 45 | 33 | 5 | 1000 |
| Bleach-fix (1) | 60 | 38 | 7 | — |
| Bleach-fix (2) | 60 | 38 | 7 | 220 |
| Third washing with water (1) | 45 | 33 | 5 | — |
| Third washing with water (2) | 45 | 33 | 5 | — |
| Third washing with water (3) | 45 | 33 | 5 | 5000 |
| Drying | 45 | 75 | | |

The first and the third washing steps were carried out according to a counter current process. That is, the first washing bath (2) was replenished with water, and the water overflowing the first washing bath (2) was introduced into the first washing bath (1), while the third washing bath (3) was replenished with water, the water overflowing the third washing bath (3) was introduced into the third washing bath (2), and the water overflowing the third washing bath (2) was introduced into the third washing bath (1).

The composition of each processing solution used is described below.

| First Developer: | Tank Solution | Replenisher |
|---|---|---|
| Pentasodium nitrilo-N,N,N-trimethylenephosphonate | 1.0 g | 1.0 g |
| Pentasodium diethylenetriaminepentaacetic acid | 3.0 g | 3.0 g |
| Potassium sulfite | 30.0 g | 30.0 g |
| Potassium thiocyanate | 1.2 g | 1.2 g |
| Potassium carbonate | 35.0 g | 35.0 g |
| Potassium hydroquinonemonosulfonate | 25.0 g | 25.0 g |
| 1-Phenyl-4-hydroxymethyl-4-methyl-3-pyrazolidone | 2.0 g | 2.0 g |
| Potassium bromide | 0.5 g | — |
| Potassium iodide | 5.0 mg | — |
| Water to make | 1,000 ml | 1,000 ml |
| pH | 9.60 | 9.70 |

The pH was adjusted with hydrochloric acid or potassium hydroxide.

| Color Developer: | Tank Solution | Replenisher |
|---|---|---|
| Benzyl alcohol | 15.0 ml | 15.0 ml |
| Diethylene glycol | 12.0 ml | 14.0 ml |
| 3,6-Dithia-1,8-octanediol | 0.20 g | 0.25 g |
| Pentasodium nitrilo-N,N,N-trimethylenephosphonate | 0.5 g | 0.5 g |
| Pentasodium diethylenetriaminepentaacetate | 2.0 g | 2.0 g |
| Sodium sulfite | 2.0 g | 2.5 g |
| Hydroxylamine sulfate | 3.0 g | 3.6 g |
| N-ethyl-N-hydroxypropyl-3-methyl-4-aminoaniline.3/2 sulfate monohydrate (color developing agent I-2 of the) present invention) | 3.5 g | 5.6 g |
| Brightening agent (diaminostilbene type) | 1.0 g | 1.2 g |
| Potassium bromide | 0.5 g | — |
| Potassium iodide | 1.0 mg | — |
| Water to make | 1000 ml | 1000 ml |
| pH | 10.25 | 10.40 |

The pH was adjusted with hydrochloric acid or potassium hydroxide.

| Bleach-Fix Solution (Tank solution = Replenisher): | |
|---|---|
| Disodium ethylenediaminetetraacetate dihydrate | 5.0 g |
| Ammonium ethylenediaminetetraacetatoferrate (III) monohydrate | 80.0 g |
| Sodium sulfite | 15.0 g |
| Ammonium thiosulfate (700 g/l) | 160 ml |
| 2-Mercapto-1,3,4-triazole | 0.5 g |
| Water to make | 1000 ml |
| pH | 6.50 |

The pH was adjusted with acetic acid or aqueous ammonia.

In evaluating color reproducibility of each practical sample in the photographic processing of each kind, the results of which are summarized in Table 18, a sample was chosen which had undergone the photographic processing at the time when said processing had been continued using an automatic developing machine until the total amount of the replenisher used for color development had become three times the volume of the color developing tank used.

TABLE 18

| Processed Sample | Compound added to 2nd, 3rd, 6th and 9th Layers | Color Developing Agent | Color Reproducibility* | | | | | |
|---|---|---|---|---|---|---|---|---|
| | | | Cyan | Magenta | Yellow | Red | Green | Blue |
| 1101-1 | — | I-2 | 3 | 3 | 3 | 3 | 3 | 3 |
| 1102-1 | VI-1 | I-2 | 5 | 5 | 4 | 5 | 5 | 4 |
| 1103-1 | VI-2 | I-2 | 5 | 5 | 4 | 4 | 5 | 4 |
| 1104-1 | VI-6 | I-2 | 4 | 5 | 5 | 4 | 5 | 5 |
| 1105-1 | VI-24 | I-2 | 5 | 5 | 4 | 5 | 4 | 5 |
| 1106-1 | VI-29 | I-2 | 5 | 5 | 5 | 5 | 5 | 5 |
| 1101-2 | — | I-12 | 3 | 4 | 3 | 4 | 3 | 3 |
| 1102-2 | VI-1 | I-12 | 5 | 4 | 4 | 5 | 4 | 5 |

TABLE 18-continued

| Processed Sample | Compound added to 2nd, 3rd, 6th and 9th Layers | Color Developing Agent | Color Reproducibility* | | | | | |
|---|---|---|---|---|---|---|---|---|
| | | | Cyan | Magenta | Yellow | Red | Green | Blue |
| 1103-2 | VI-2 | I-12 | 5 | 5 | 5 | 5 | 5 | 5 |
| 1104-2 | VI-6 | I-12 | 4 | 4 | 4 | 4 | 4 | 4 |
| 1105-2 | VI-24 | I-12 | 5 | 5 | 5 | 5 | 5 | 5 |
| 1106-2 | VI-29 | I-12 | 4 | 5 | 4 | 5 | 5 | 5 |
| 1101-3 | — | I-22 | 3 | 4 | 3 | 3 | 3 | 3 |
| 1102-3 | VI-1 | I-22 | 4 | 5 | 5 | 4 | 4 | 5 |
| 1103-3 | VI-2 | I-22 | 5 | 5 | 5 | 5 | 5 | 5 |
| 1104-3 | VI-6 | I-22 | 5 | 5 | 4 | 4 | 4 | 4 |
| 1105-3 | VI-24 | I-22 | 5 | 4 | 5 | 4 | 5 | 5 |
| 1106-3 | VI-29 | I-22 | 5 | 4 | 5 | 4 | 4 | 5 |
| 1101-4 | — | I-32 | 3 | 3 | 3 | 4 | 3 | 3 |
| 1102-4 | VI-1 | I-32 | 5 | 4 | 4 | 5 | 4 | 5 |
| 1103-4 | VI-2 | I-32 | 4 | 4 | 4 | 5 | 4 | 5 |
| 1104-4 | VI-6 | I-32 | 4 | 4 | 4 | 4 | 4 | 4 |
| 1105-4 | VI-24 | I-32 | 5 | 5 | 4 | 5 | 5 | 5 |
| 1106-4 | VI-29 | I-32 | 5 | 4 | 5 | 4 | 4 | 5 |
| 1101-5 | — | I-34 | 3 | 4 | 3 | 3 | 3 | 3 |
| 1102-5 | VI-1 | I-34 | 4 | 4 | 4 | 4 | 5 | 4 |
| 1103-5 | VI-2 | I-34 | 5 | 4 | 5 | 4 | 4 | 5 |
| 1104-5 | VI-6 | I-34 | 4 | 4 | 4 | 4 | 4 | 4 |
| 1105-5 | VI-24 | I-34 | 5 | 4 | 5 | 4 | 5 | 5 |
| 1106-5 | VI-29 | I-34 | 4 | 4 | 4 | 4 | 4 | 5 |

*1: inferior
2: somewhat inferior
3: equivalent
4: superior
5: very superior (all of the values are relative to the processed sample 1101-1)
All samples were those of the present invention.

As can be seen from Table 18, the color image forming methods according to the present invention were especially excellent in color reproducibility.

While the invention has been described in detail and with reference to specific embodiments thereof, it will be apparent to one skilled in the art that various changes and modifications can be made therein without departing from the spirit and scope thereof.

What is claimed is:

1. A method of forming a color image which comprises:

providing a silver halide color photographic material which has on a support at least one emulsion layer unit constituted of at least two silver halide emulsion layers having the same color sensitivity and different photographic speeds, and wherein the silver halide grains in said emulsion layers are selected from the group consisting of light-sensitive silver iodobromide grains and light-sensitive silver chloriodobromide grains, and which contains at least one DIR compound represented by the following general formula (II) in at least one layer selected from said emulsion layer unit and other constituent layers;

exposing said color photographic material; and processing said color photographic material with a color developer containing at least one compound represented by the following general formula XI as a developing agent for silver halide color photography:

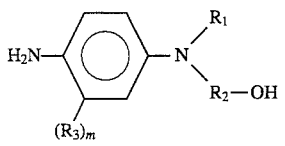

(XI)

wherein $R_1$ represents a straight-chain or branched alkyl group containing 1 to 6 carbon atoms, or a straight-chain or branched hydroxyalkyl group containing 3 to 6 carbon atoms; $R_2$ represents a straight-chain or branched alkylene group containing 3 to 6 carbon atoms, or a straight-chain or branched hydroxyalkylene group containing 3 to 6 carbon atoms; $R_3$ represents an alkyl group having 1 to 4 carbon atoms; and m represents 1;

A—Q (II)

wherein A represents a group capable of causing cleavage of Q by reacting with an oxidation product of an aromatic primary amine developing agent; and Q represents a development inhibitor moiety or a group capable of releasing a development inhibitor moiety.

2. The color image forming method claimed in claim 1, wherein said emulsion layer unit comprises a tabular grain emulsion which contains tabular silver halide grains having an average aspect ratio of at least 2 in a proportion of at least 50%, on a projected area basis, of the silver halide grains contained in the tabular grain emulsion.

3. The color image forming method claimed in claim 2, wherein said emulsion layer unit constitutes at least three silver halide emulsion layers having the same color sensitivity and different photographic speeds.

4. The color image forming method claimed in claim 2, wherein the diameter of said tabular grains is 0.3 to 10.0 μm.

5. The color image forming method claimed in claim 4, wherein $R_1$ represents a straight chain or branched alkyl group having 1 to 4 carbon atoms, $R_2$ represents a tetramethylene group, $R_3$ represents a methyl group or an ethyl group, and m is 1.

6. The color image forming method claimed in claim 1, wherein said emulsion layer unit constitutes at least three silver halide emulsion layers having the same color sensitivity and different photographic speeds.

7. The color image forming method claimed in claim 1, wherein the content of silver iodide in said silver halide grains is 2 to 30 mol %.

8. The color image forming method claimed in claim 7, wherein $R_1$ represents a straight chain or branched alkyl group having 1 to 4 carbon atoms, $R_2$ represents a tetramethylene group, $R_3$ represents a methyl group or an ethyl group, and m is 1.

9. The color image forming method claimed in claim 1, wherein $R_1$ represents a straight chain or branched alkyl group having 1 to 4 carbon atoms, $R_2$ represents a tetramethylene group, $R_3$ represents a methyl group or an ethyl group, and m is 1.

10. The color image forming method claimed in claim 1, wherein the amount of the compound represented by formula (XI) in the color developer is 0.1 to 20 g per liter of the developer.

11. The color image forming method claimed in claim 1, wherein the compounds represented by formula (II) are selected from the group consisting of compounds represented by formulae (III), (IV) and (V):

A-DI (III)

A-$(TIME)_a$-DI (IV)

A-$(TIME)_i$-RED-DI (V)

wherein A represents a coupler moiety which can release DI, $(TIME)_a$-DI, $(TIME)_i$-RED-DI or -RED-DI (when i=0) by a coupling reaction with an oxidation product of an aromatic primary amine developing agent, TIME represents a timing group capable of breaking the bond with DI or RED-DI after the release from A by the coupling reaction, RED represents a group capable of breaking the bond with DI by reacting with the oxidation product of a developing agent after splits off from A or TIME, DI represents a development inhibitor moiety, a represents 1 or 2, i represents 0 or 1, and when a is 2, the two (TIME) groups represent the same moiety or different moieties.

12. The color image forming method as in claim 11, wherein said coupler moiety is selected from the group consisting of coupler moieties of a pivaloylacetanilide coupler, a benzoylacetanilide coupler, malone diester coupler, malone diamide coupler, dibenzoylmethane coupler, benzothiazolylacetamide coupler, malone ester monoamide coupler, benzoxazolylacetamide coupler, benzimidazolylacetamide coupler, cycloalkanoylacetamide coupler, a 5-pyrazolone coupler, a pyrazlolobenzimidazole coupler, a pyrazolotriazole coupler, a pyrazoloimidazole coupler, a cyanoacetophenone coupler, a phenyl coupler, a naphthol coupler, an indanone coupler, and an acetophenone coupler.

13. The color image forming method claimed in claim 11, wherein said coupler moiety is selected from the group consisting of couplers represented by formulae (Cp-1), (Cp-2), (Cp-3), (Cp-4), (Cp-5), (Cp-6), (Cp-7), (Cp-8), (Cp-9), and (Cp-10):

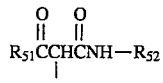
(Cp-1)

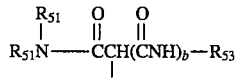
(Cp-2)

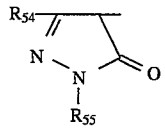
(Cp-3)

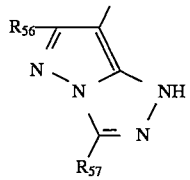
(Cp-4)

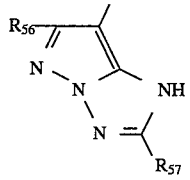
(Cp-5)

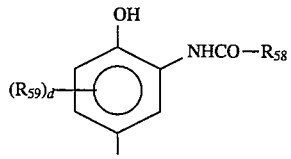
(Cp-6)

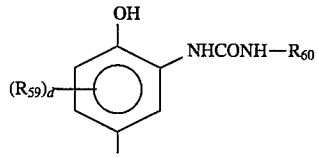
(Cp-7)

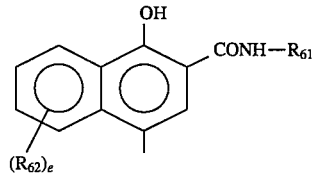
(Cp-8)

-continued (Cp-9)

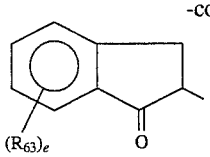

(Cp-10)

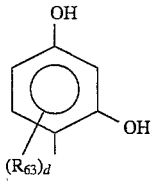

wherein $R_{51}$ has the same meaning as $R_{41}$, $R_{52}$ and $R_{53}$ each have the same meaning as $R_{43}$, b represents 0 or 1, $R_{54}$ represents the same meaning as $R_{41}$, $R_{41}CO(R_{43})N$—, $R_{41}SO_2(R_{43})N$—, $R_{41}(R_{43})N$—, $R_{41}S$—, $R_{43}O$— or $R_{45}(R_{43})NCON(R_{44})$—, $R_{55}$ has the same meaning as $R_{41}$, $R_{56}$ and $R_{57}$ each has the same meaning as $R_{43}$, or represents $R_{41}S$—, $R_{43}O$—, $R_{41}CO(R_{43})N$— or $R_{41}SO_2(R_{43})N$—, $R_{58}$ has the same meaning as $R_{41}$, $R_{59}$ represents a group having the same meaning as $R_{41}$, or represents $R_{41}CO(R_{43})N$—, $R_{41}OCO(R_{43})N$—, $R_{41}SO_2(R_{43})N$—, $R_{43}(R_{44})NCO(R_{45})N$—, $R_{41}O$—, $R_{41}S$—, a halogen atom or $R_{41}(R_{43})N$—, d represents 0 or an integer from 1 to 3, when d is 2 or 3, the plural $R_{59}$ groups represent the same substituent group or different ones, $R_{60}$ has the same meaning as $R_{41}$, $R_{61}$ has the same meaning as $R_{41}$, $R_{62}$ has the same meaning as $R_{41}$, or represents $R_{41}CONH$—, $R_{41}OCONH$—, $R_{41}SO_2NH$—, $R_{43}(R_{44})NCONH$—, $R_{43}(R_{44})NSO_2NH$—, $R_{43}O$—, $R_{41}S$—, a halogen atom or $R_{41}NH$—, $R_{63}$ has the same meaning as $R_{41}$, or represents $R_{43}CO(R_{44})N$—, $R_{43}(R_{44})NCO$—, $R_{41}SO_2(R_{43})N$—, $R_{41}(R_{43})NSO_2$—, $R_{41}SO_2$—, $R_{43}OCO$—, $R_{43}OSO_2$—, a halogen atom, a nitro group, a cyano group or $R_{43}CO$—, e represents 0 or an integer from 1 to 4, when a plurality of $R_{62}$ groups or $R_{63}$ groups are present, they are the same or different; wherein $R_{41}$ represents an alkyl group, an aryl group or a heterocyclic group, $R_{42}$ represents an aryl group or a heterocyclic group, and $R_{43}$, $R_{44}$ and $R_{45}$ each represents a hydrogen atom, an alkyl group, an aryl group or a heterocyclic group; said moiety may be in the form of a constitutional repeating unit to form bis, telomer or polymer form coupler moiety.

14. The color image forming method claimed in claim 1, wherein the compound represented by formula (II) are those which are represented by formula (VI);

$$B\text{-}(L)_n\text{-}(G)_m\text{-}(TIME)_t\text{-}X \quad (VI)$$

wherein B represents a redox moiety or a precursor thereof which enables the release of $-(TIME)_t-X$ only when it undergoes oxidation upon photographic development processing, Time represents a timing group, X represents a development inhibitor moiety, L represents a divalent linkage group, G represents an acidic group, and n, m and t each represents 0 or 1.

15. The color image forming method claimed in claim 1, wherein the amount of said DIR compound is $1.0\times10^{-7}$ to $1.0\times10^{-3}$ mol per $m^2$ of the photographic material.

* * * * *